US011198298B2

(12) United States Patent
Aoki et al.

(10) Patent No.: US 11,198,298 B2
(45) Date of Patent: Dec. 14, 2021

(54) CARTRIDGE AND LIQUID EJECTING APPARATUS

(71) Applicant: SEIKO EPSON CORPORATION, Tokyo (JP)

(72) Inventors: Yuji Aoki, Hara-mura (JP); Atsushi Yoshida, Matsumoto (JP); Naoki Naito, Ikeda-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/765,205

(22) PCT Filed: Nov. 15, 2018

(86) PCT No.: PCT/JP2018/042321
§ 371 (c)(1),
(2) Date: May 19, 2020

(87) PCT Pub. No.: WO2019/098287
PCT Pub. Date: May 23, 2019

(65) Prior Publication Data

US 2020/0276821 A1 Sep. 3, 2020

(30) Foreign Application Priority Data

Nov. 20, 2017 (JP) ..... JP2017-222387

(51) Int. Cl.
*B41J 2/175* (2006.01)
*B41J 29/13* (2006.01)

(52) U.S. Cl.
CPC ..... *B41J 2/1752* (2013.01); *B41J 2/1753* (2013.01); *B41J 2/17509* (2013.01);
(Continued)

(58) Field of Classification Search
CPC . B41J 2/01; B41J 2/175; B41J 2/17509; B41J 2/17513; B41J 2/1752;
(Continued)

(56) References Cited

U.S. PATENT DOCUMENTS 8,646,889 B2 2/2014 Aoki et al.
8,931,887 B2 1/2015 Aoki et al.
(Continued)

FOREIGN PATENT DOCUMENTS

CN 104985934 A 10/2015
CN 105829109 A 8/2016
(Continued)

OTHER PUBLICATIONS

Dec. 18, 2018 Search Report issued in International Patent Application No. PCT/JP2018/042321.

*Primary Examiner* — Anh T Vo
(74) *Attorney, Agent, or Firm* — Oliff PLC

(57) ABSTRACT

A technique for suppressing a contact failure between a contact portion and an apparatus-side terminal in a cartridge including a case, a liquid supply port, and a contact portion that is disposed at a corner where a front surface and a top surface intersect each other and is in contact with an apparatus-side terminal of a liquid ejecting apparatus, the liquid supply port is disposed at the center of the case in a width direction in which a first side surface and a second side surface oppose each other, and the contact portion is disposed at a position shifted to one side of the first side surface side and the second side surface side in the width direction.

8 Claims, 43 Drawing Sheets

(52) U.S. Cl.
CPC ..... *B41J 2/17523* (2013.01); *B41J 2/17533* (2013.01); *B41J 2/17546* (2013.01); *B41J 2/17553* (2013.01); *B41J 2/17559* (2013.01); *B41J 29/13* (2013.01); *B41J 2002/17516* (2013.01)

(58) Field of Classification Search
CPC .. B41J 2/17523; B41J 2/1753; B41J 2/17533; B41J 2/17546; B41J 2/17553; B41J 29/13; B41J 2002/17516
See application file for complete search history.

(56) References Cited

U.S. PATENT DOCUMENTS

| | | | |
|---|---|---|---|
| 8,955,951 | B2 | 2/2015 | Aoki et al. |
| 8,960,871 | B2 | 2/2015 | Karasawa et al. |
| 8,998,394 | B2 | 4/2015 | Ishizawa et al. |
| 9,004,659 | B2 | 4/2015 | Aoki et al. |
| 9,108,417 | B2 | 8/2015 | Aoki et al. |
| 9,266,337 | B2 | 2/2016 | Aoki et al. |
| 9,370,934 | B2 | 6/2016 | Asauchi et al. |
| 9,440,755 | B2 | 9/2016 | Aoki et al. |
| 9,821,557 | B2 | 11/2017 | Aoki et al. |
| 9,821,562 | B2 | 11/2017 | Nanjo et al. |
| 2001/0024225 | A1 | 9/2001 | Ishizawa et al. |
| 2007/0040874 | A1 | 2/2007 | Matsumoto |
| 2008/0151018 | A1* | 6/2008 | Aoki ..... B41J 2/17513 347/86 |
| 2008/0316249 | A1* | 12/2008 | Aoki ..... B41J 2/17513 347/19 |
| 2012/0056954 | A1 | 3/2012 | Asauchi et al. |
| 2014/0307031 | A1 | 10/2014 | Asauchi et al. |
| 2016/0200113 | A1 | 7/2016 | Nanjo et al. |
| 2016/0288514 | A1 | 10/2016 | Koizumi et al. |
| 2016/0311228 | A1 | 10/2016 | Aoki et al. |
| 2017/0096010 | A1 | 4/2017 | Nanjo et al. |
| 2017/0203577 | A1 | 7/2017 | Koizumi et al. |
| 2018/0043692 | A1 | 2/2018 | Aoki et al. |

FOREIGN PATENT DOCUMENTS

| | | | |
|---|---|---|---|
| CN | 106004057 | A | 10/2016 |
| JP | 2001-205819 | A | 7/2001 |
| JP | 2008-254395 | A | 10/2008 |
| JP | 2010-208261 | A | 9/2010 |
| JP | 3185521 | U | 8/2013 |
| JP | 5700168 | B2 | 4/2015 |
| JP | 2016-074228 | A | 5/2016 |
| JP | 2016-165906 | A | 9/2016 |
| JP | 6032301 | B2 | 11/2016 |
| JP | 2016-203498 | A | 12/2016 |
| JP | 2017-024423 | A | 2/2017 |
| JP | 2017-1/1/33 | A | 10/2017 |

* cited by examiner

CARTRIDGE AND LIQUID EJECTING APPARATUS

TECHNICAL FIELD

The present disclosure relates to a technology of a cartridge and a liquid ejecting apparatus.

BACKGROUND ART

In the related art, a cartridge for supplying ink to a printer has been known (for example, PTL 1).

CITATION LIST

Patent Literature

PTL 1: Japanese Unexamined Patent Application Publication No. 2017-024423

SUMMARY OF INVENTION

Technical Problem

In the related art, a cartridge includes a printing material lead-out tube and a circuit substrate that is in contact with an apparatus-side terminals. When the ink leaks from the printing material lead-out tube, there is a concern that the leaked ink adheres to the circuit substrate. When the ink adheres to the circuit substrate, there is a concern that a contact failure with the apparatus-side terminal occurs. Such a problem is not limited to a cartridge including a circuit substrate and a printing material lead-out tube, and is common to a cartridge including a contact portion that is in contact with an apparatus-side terminal of a liquid ejecting apparatus and a liquid supply port.

Solution to problem (1) According to one aspect of the present disclosure, there is provided a cartridge detachably mounted on a liquid ejecting apparatus. The cartridge includes: a case including a front surface and a back surface opposing each other, a top surface and a bottom surface intersecting the front surface and the back surface and opposing each other, and a first side surface and a second side surface intersecting the front surface, the back surface, the top surface, and the bottom surface and opposing each other; a liquid supply port that is disposed on the front surface, is coupled to a liquid introduction section of the liquid ejecting apparatus, and supplies a liquid to the liquid introduction section; and a contact portion that is disposed at a corner where the front surface and the top surface intersect each other and is in contact with an apparatus-side terminal of the liquid ejecting apparatus, the liquid supply port is disposed at the center of the case in a width direction in which the first side surface and the second side surface oppose each other, and the contact portion is disposed at a position shifted to one side of the first side surface and the second side surface in the width direction.

DESCRIPTION OF EMBODIMENTS

A. Embodiment

A-1: Configuration of Liquid Ejection System

Figure 1:
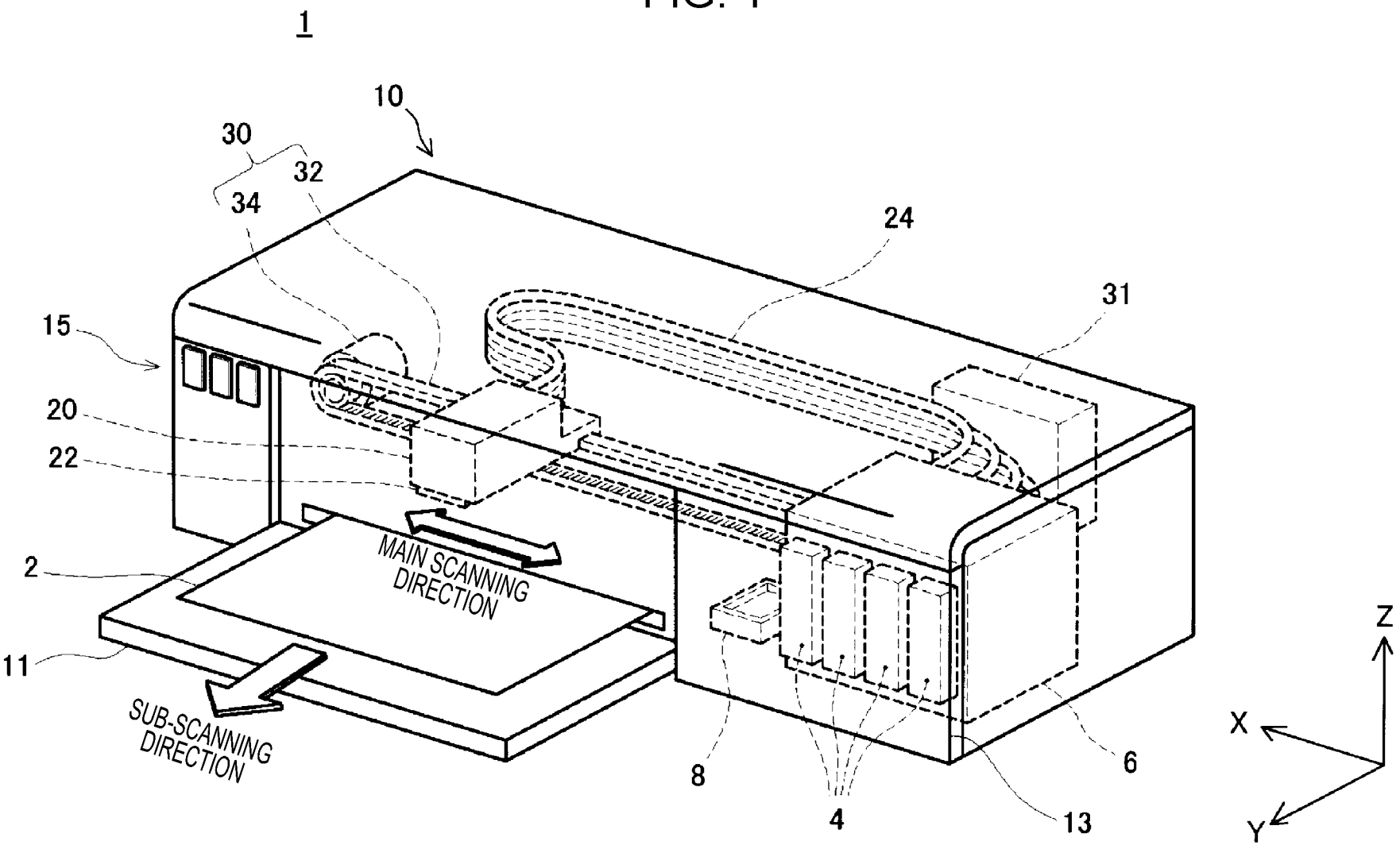
FIG. 1 is a schematic view of a liquid ejection system according to a first embodiment of the present disclosure.

FIG. 1 is a schematic view of a liquid ejection system 1 according to a first embodiment of the present disclosure. FIG. 1 illustrates XYZ axes which are three spatial axes orthogonal to each other. Directions in which the arrows of the X axis, the Y axis, and the Z axis are oriented are positive directions along the X axis, the Y axis, and the Z axis, respectively. The positive directions along the X, Y, and Z axes are referred to as a +X axis direction, a +Y axis direction, and a +Z axis direction, respectively. Directions opposite to the directions in which the arrows of the X axis, the Y axis, and the Z axis are oriented are negative directions along the X axis, the Y axis, and the Z axis, respectively. The negative directions along the X, Y, and Z axes are referred to as a −X axis direction, a −Y axis direction, and a −Z axis direction, respectively. The directions along the X axis, Y axis, and Z axis, which may be positive or negative, are called an X axis direction, a Y axis direction, and a Z axis direction, respectively. The same XYZ axes are attached to the drawings and descriptions illustrated hereafter, as necessary. The directions of the XYZ axes depicted in other drawings correspond to the directions of the XYZ axes of FIG. 1. The liquid ejection system 1 includes a printer 10 as a liquid ejecting apparatus and a cartridge 4.

The printer 10 of the present embodiment is an ink jet printer that discharges ink from a head 22. The printer 10 is a printer that performs printing on photo paper or the like. The printer 10 includes a mounting section 6, a control section 31, a carriage 20, the head 22, and a driving mechanism 30. Further, the printer 10 includes an operation button 15 for a user to operate an operation of the printer 10.

A plurality of cartridges 4 are detachably mounted on the mounting section 6, respectively. In the present embodiment, four types of cartridges 4 are mounted one by one corresponding to four colors (black, yellow, magenta, and cyan) of ink, that is, a total of four cartridges 4 are mounted on the mounting section 6. A mounting direction of the cartridge 4 to the mounting section 6 is the −Y axis direction, and a removing direction is the +Y axis direction. In another embodiment, three or less cartridges 4 or five or more cartridges 4 may be detachably mounted on the mounting section 6. Further, in the printer 10 of the present embodiment, a replacement cover 13 is provided on the front surface (a surface on the +Y axis direction side). When the +Z axis direction side of the replacement cover 13 is tilted toward a near side (+Y axis direction side), an opening of the mounting section 6 appears, and the cartridge 4 can be attached and detached. When the cartridge 4 is mounted on the mounting section 6, ink can be supplied to the head 22 provided on the carriage 20 via a tube 24. In the present example, when a pressurized fluid is introduced into the cartridge 4 from the printer 10, the ink is supplied to the head 22 from a liquid storage bag of the cartridge 4. In addition, the tube 24 is provided for each type of ink. A state where the cartridge 4 is mounted on the mounting section 6 is also referred to as a "mounted state".

The head 22 is provided with nozzles for each type of ink. The head 22 ejects ink from ejection nozzles toward a printing paper sheet 2 to print data such as characters or images. The detailed configuration of the cartridge 4 and the mounting section 6 will be described later. In the present embodiment, the printer 10 is a so-called "off-carriage type" printer in which the mounting section 6 does not interlock with the movement of the carriage 20. The present disclosure is also applicable to a so-called "on-carriage type" printer in which the mounting section 6 is provided on the carriage 20 and the mounting section 6 moves together with the carriage 20.

The control section 31 controls each section of the printer 10 and exchanges signals with the cartridge 4. The carriage 20 moves the head 22 relatively to the printing paper sheet 2.

The driving mechanism 30 reciprocates the carriage based on a control signal from the control section 31. The driving mechanism 30 includes a timing belt 32 and a drive motor 34. By transmitting the power of the drive motor 34 to the carriage 20 via the timing belt 32, the carriage 20 reciprocates in a main scanning direction (X axis direction). Further, the printer 10 includes a transport mechanism for moving the printing paper sheet 2 in a sub-scanning direction (+Y axis direction). When printing is performed, the printing paper sheet 2 is moved in the sub-scanning direction by the transport mechanism, and the printing paper sheet 2 after the printing is completed is output onto a front cover 11.

A region called a home position is provided at a position outside a printing region where the carriage 20 is moved in the main scanning direction, and a maintenance mechanism for performing maintenance such that printing can be performed normally is installed at the home position. The maintenance mechanism includes a cap member 8 that is pressed against a surface (nozzle surface) on which the nozzles are formed on the bottom surface side (the side facing the printing paper sheet 2) of the head 22 to form a closed space that surrounds the ejection nozzles. Further, the maintenance mechanism has an elevating mechanism (not illustrated) that elevates and lowers the cap member 8 in order to press the cap member against the nozzle surface of the head 22. Further, the maintenance mechanism has a suction pump (not illustrated) for introducing a negative pressure into the closed space formed by pressing the cap member 8 against the nozzle surface of the head 22.

In the present embodiment, in the use state of the liquid ejection system 1 (the printer 10 and the cartridge 4), the axis along the sub-scanning direction in which the printing paper sheet 2 is transported is set as the Y axis, and the axis along the vertical direction (up-down direction) is set as the Z axis, and the axis along the moving direction (left-right direction) of the carriage 20 is set as the X axis. Here, the "use state of the liquid ejection system 1" refers to a state where the liquid ejection system 1 is installed on a horizontal surface. In the present embodiment, the sub-scanning direction (forward direction) is set as the +Y axis direction, the direction opposite thereto (rearward direction) is set as the −Y axis direction, the direction (upward direction) upward from below in the vertical direction is set as the +Z axis direction, and the direction (downward direction) opposite thereto is set as the −Z axis direction. When the liquid ejection system 1 is viewed from the front side (+Y axis direction side), the direction from the right side to the left side is set as the +X axis direction, and the direction opposite thereto is set as the −X axis direction. Further, in the present embodiment, an insertion direction when the cartridge 4 is mounted on the mounting section 6 is also the −Y axis direction, and the direction when the cartridge 4 is removed from the mounting section 6 is also the +Y axis direction. Accordingly, in the mounting section 6, the −Y axis direction side is also referred to as a far side, and the +Y axis direction side is also referred to as a near side. In the present embodiment, an arrangement direction of the plurality of cartridges 4 is also the X axis direction.

Figure 2:
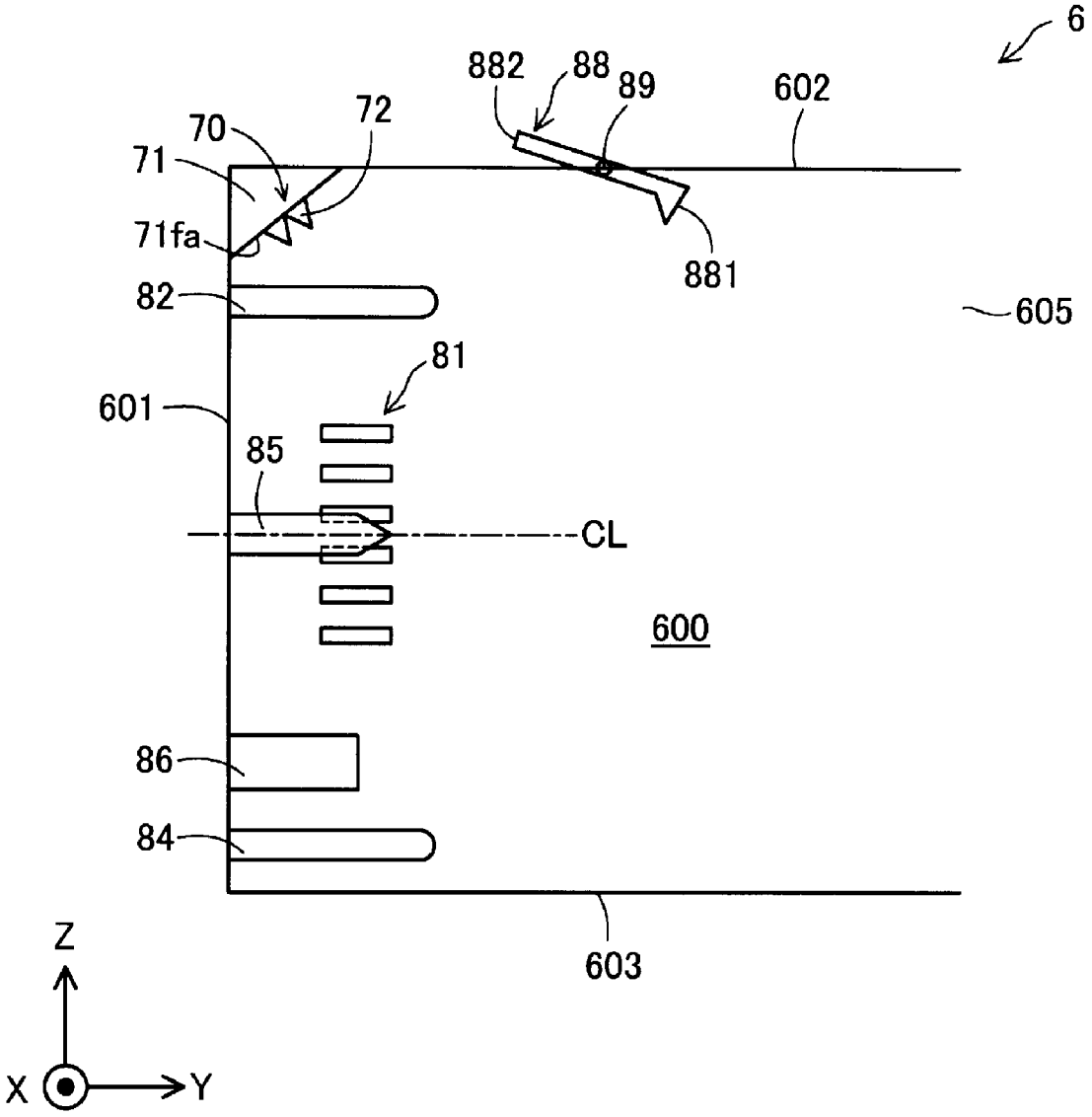
FIG. 2 is a schematic diagram illustrating a mounting section.
Figure 3:
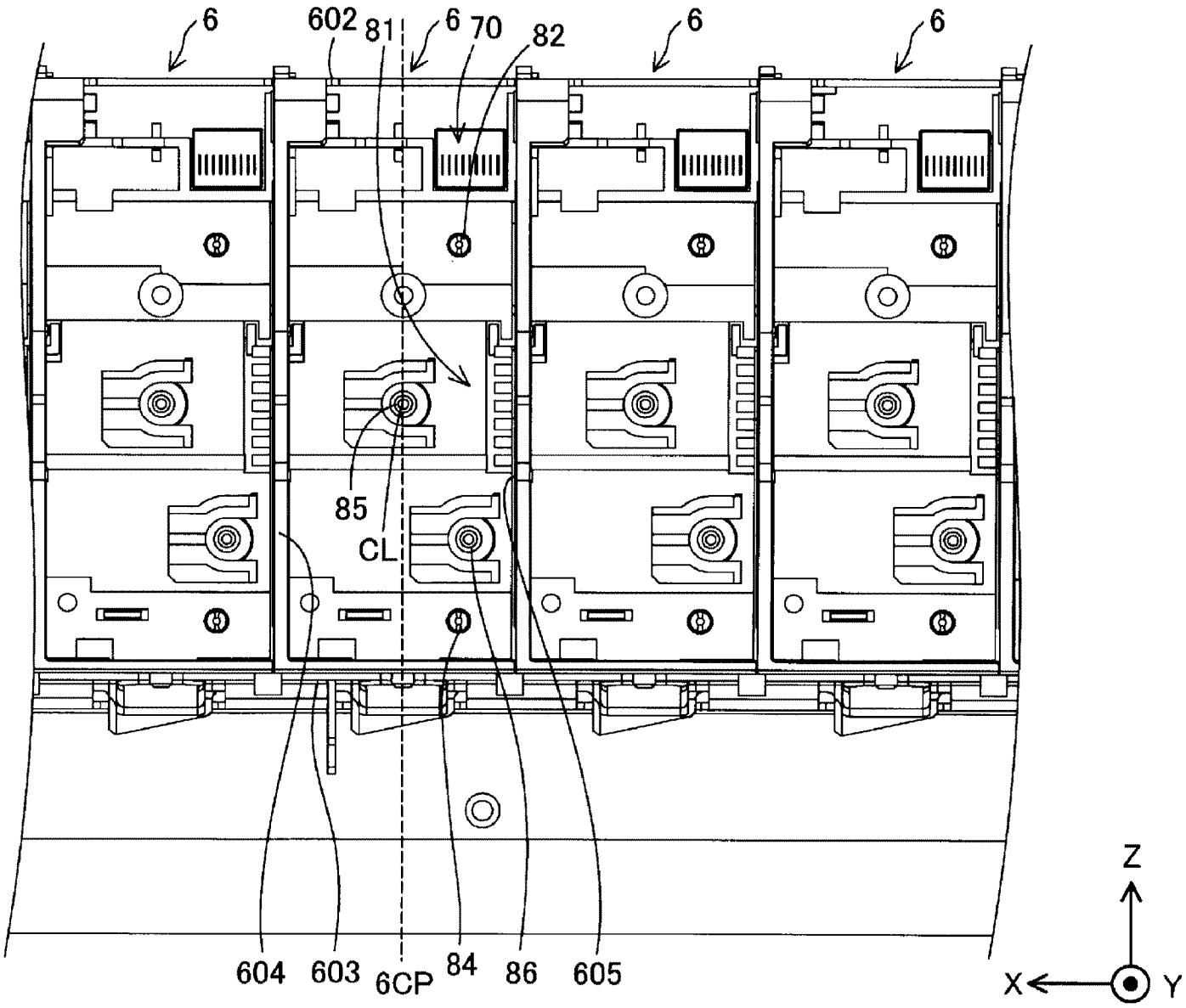
FIG. 3 is a front view of the mounting section.

A-2. Configuration of Mounting section:

FIG. 2 is a schematic diagram illustrating the mounting section 6. FIG. 3 is a front view of the mounting section 6. The mounting section 6 has a substantially rectangular parallelepiped shape, and forms a storage space 600 for storing the cartridge 4. The mounting section 6 (FIG. 2) includes a mounting section back wall (mounting section first wall) 601, a mounting section upper wall (mounting section second wall) 602, a mounting section bottom wall (mounting section third wall) 603, a mounting section left side wall (mounting section fourth wall) 604 (FIG. 3), a mounting section right side wall (mounting section fifth wall) 605 (FIG. 3), and a mounting section opening 606 (FIG. 2).

The mounting section back wall 601 (FIG. 2) is a wall positioned on the mounting direction side (−Y axis direction side). The mounting section opening 606 is a wall positioned on the removing direction side (+Y axis direction side) and opposes the mounting section back wall 601. The cartridge 4 is attached to and detached from the mounting section 6 through the mounting section opening 606. The mounting section upper wall 602 intersects the mounting section back wall 601 and is a wall on the vertically upward direction side (+Z axis direction side) of the mounting section 6. The mounting section bottom wall 603 is a wall that intersects the mounting section back wall 601 and is on the vertically downward side (−Z axis direction side) of the mounting section 6. The mounting section upper wall 602 and the mounting section bottom wall 603 oppose each other. The mounting section left side wall 604 (FIG. 3) intersects the mounting section back wall 601, the mounting section upper wall 602, and the mounting section bottom wall 603, and is positioned on the +X axis direction side. The mounting section right side wall 605 (FIG. 3) intersects the mounting section back wall 601, the mounting section upper wall 602, and the mounting section bottom wall 603, and is positioned on the −X axis direction side. The mounting section left side wall 604 and the mounting section right side wall 605 oppose each other in the X axis direction. In the mounting section 6, the X axis direction is the width direction, the Z axis direction is the height direction, and the Y axis direction is the depth direction.

The mounting section 6 (FIG. 2) further includes an engagement mechanism 88, an apparatus-side terminal portion 70, a first apparatus-side positioning section 82, a liquid introduction section 85, a second apparatus-side positioning section 84, an apparatus-side identification member 81, and a pressurizing section 86.

The engagement mechanism 88 regulates the movement of the cartridge 4 in the mounted state in the removing direction (+Y axis direction) by being engaged with the cartridge 4. The engagement mechanism 88 is disposed on the mounting section upper wall 602. The engagement mechanism 88 is a lever, and includes an operating section 882, a rotation shaft 89, and an apparatus-side engaging section 881. The operating section 882 is exposed to the outside of the mounting section 6 such that the user can operate the operating section. The operating section 882 is positioned at one end portion of the engagement mechanism 88. The apparatus-side engaging section 881 is positioned at the other end portion of the engagement mechanism 88 and on the inside of the mounting section 6. The engagement mechanism 88 has a spring member (not illustrated), and the apparatus-side engaging section 881 is disposed at a position illustrated in FIG. 2 by the force of the spring member. The user moves the apparatus-side engaging section 881 vertically upward with the rotation shaft 89 as a center against the force of the spring member by pushing the operating section 882 vertically downward. Accordingly, the engaged state between the cartridge 4 and the apparatus-side engaging section 881 can be released, and the user can remove the cartridge 4 from the mounting section 6.

In the mounted state of the cartridge 4, the apparatus-side terminal portion 70 comes into contact with and is electrically coupled to a circuit substrate (which will be described later) of the cartridge 4. The apparatus-side terminal portion 70 is disposed on the mounting section back wall 601. The apparatus-side terminal portion 70 may be disposed on the mounting section upper wall 602 or may be disposed between the mounting section back wall 601 and the mounting section upper wall 602. The apparatus-side terminal portion 70 includes a terminal holding section 71 and an apparatus-side terminal 72. The terminal holding section 71 is a member that holds the apparatus-side terminal 72. The apparatus-side terminal 72 is a metal plate member, and a part thereof is exposed from a surface 71*fa* of the terminal holding section 71. A plurality of apparatus-side terminals 72 are arranged. In the present embodiment, nine apparatus-side terminals 72 (only two are illustrated in the drawing) are provided. The apparatus-side terminal 72 has elasticity, and the degree of exposure (protrusion) from the surface 71*fa* can be changed by elastically deforming. A normal vector of the surface 70*fa* has the +Y axis direction component and the −Z axis direction component. The surface 70*fa* is inclined with respect to the mounting direction of the cartridge 4 to the mounting section 6 (−Y axis direction, horizontal direction).

The first apparatus-side positioning section 82 and the second apparatus-side positioning section 84 are respectively column-like members (columnar members) that extend from the mounting section back wall 601 in the +Y axis direction. The first apparatus-side positioning section 82 and the second apparatus-side positioning section 84 respectively extend in the +Y axis direction side of the apparatus-side identification member 81. In other words, the distal end portion of the first apparatus-side positioning section 82 and the distal end portion of the second apparatus-side positioning section 84 are respectively positioned in the +Y axis direction side of the apparatus-side identification member 81. The first apparatus-side positioning section 82 and the second apparatus-side positioning section 84 suppress displacement of the cartridge 4 within a plane (within a plane parallel to the X axis direction and the Z axis direction) orthogonal to the mounting direction during the mounting process of the cartridge 4 to the mounting section 6. The first apparatus-side positioning section 82 is positioned between the apparatus-side terminal 72 and the liquid introduction section 85 in the Z axis direction. The second apparatus-side positioning section 84 is positioned below the liquid introduction section 85 and the pressurizing section 86 in the Z axis direction. As illustrated in FIG. 3, the first apparatus-side positioning section 82 and the second apparatus-side positioning section 84 are respectively disposed between a center 6CP of the mounting section 6 and the mounting section right side wall 605 in the width direction, and is deviated from the center 6CP of the mounting section 6. In other words, the first apparatus-side positioning section 82 and the second apparatus-side positioning section 84 are respectively disposed to be shifted to one side (in the present embodiment, mounting section right side wall 605 side) of the mounting section left side wall 604 and the mounting section right side wall 605 in the width direction.

The liquid introduction section 85 (FIG. 2) is coupled to the liquid supply section by being inserted into a liquid supply section (which will be described later) of the cartridge 4. The liquid supplied from the liquid supply section is introduced into the liquid introduction section 85. The liquid introduction section 85 is a cylindrical member that extends from the mounting section back wall 601 in the +Y axis direction. A center axis CL of the liquid introduction section 85 is parallel to the Y axis direction. The liquid is introduced into the liquid introduction section 85 through an opening formed at the distal end portion (an end portion on the +Y axis direction side) of the liquid introduction section 85. The liquid introduced into the liquid introduction section 85 flows through the tube 24 provided in the printer 10 to the head 22 (FIG. 1). The center axis CL of the liquid introduction section 85 is positioned at the center 6CP of the mounting section 6 in the width direction (Y axis direction). In addition, "being positioned at the center 6CP" means both being positioned completely at the center 6CP and being slightly deviated from the center 6CP due to a tolerance or the like.

The apparatus-side identification member 81 is used to identify whether the correct type (ink color in the present embodiment) of the cartridge 4 is inserted into the storage space 600. The apparatus-side identification member 81 forms different shapes according to the color of the ink in the cartridge 4 to be mounted. Specifically, as illustrated in FIG. 3, each apparatus-side identification member 81 is formed by at least one or more ribs (projections). In each apparatus-side identification member 81, a pattern determined by the number and position of the ribs differs depending on the type of the cartridge 4 to be mounted. The cartridge 4 is also provided with an identification member (also referred to as a "cartridge-side identification member") formed by a rib. The identification member of the cartridge 4 has a different shape depending on the color of the ink to be stored. When the correct type of cartridge 4 is inserted into the storage space 600, the apparatus-side identification member 81 and the cartridge-side identification member are fitted with each other without collision. Meanwhile, when a wrong type of cartridge 4 is inserted into the storage space 600, the apparatus-side identification member 81 collides with the cartridge-side identification member, and further insertion of the cartridge 4 is hindered. Accordingly, it is possible to reduce the possibility that the wrong type of cartridge 4 is mounted in each of the storage spaces 600 of the mounting section 6.

The apparatus-side identification member 81 (FIG. 3) is disposed on the mounting section right side wall 605. In other words, the apparatus-side identification member 81 is deviated from the center 6CP of the mounting section 6 in the width direction, and is disposed to be shifted to one side (in the present embodiment, the mounting section right side wall 605 side) of the mounting section left side wall 604 of the mounting section right side wall 605.

The pressurizing section 86 (FIG. 2) is a cylindrical member through which pressurized air as a pressurized fluid for supplying the liquid stored in the cartridge 4 to the head 22 flows. The pressurized air is generated by a pressurizing mechanism (not illustrated) provided in the printer 10. The pressurizing section 86 supplies a pressurized fluid into the cartridge 4 in the mounted state of the cartridge 4. The pressurizing section 86 extends in the +Y axis direction from the mounting section back wall 601. The pressurizing section 86 (FIG. 3) is disposed between the center 6CP of the mounting section 6 and the mounting section right side wall 605 in the width direction, and is deviated from the center 6CP of the mounting section 6. In other words, the pressurizing section 86 is disposed to be shifted to one side (in the present embodiment, the mounting section right side wall 605 side) of the mounting section left side wall 604 of the mounting section right side wall 605 in the width direction.

Figure 4:
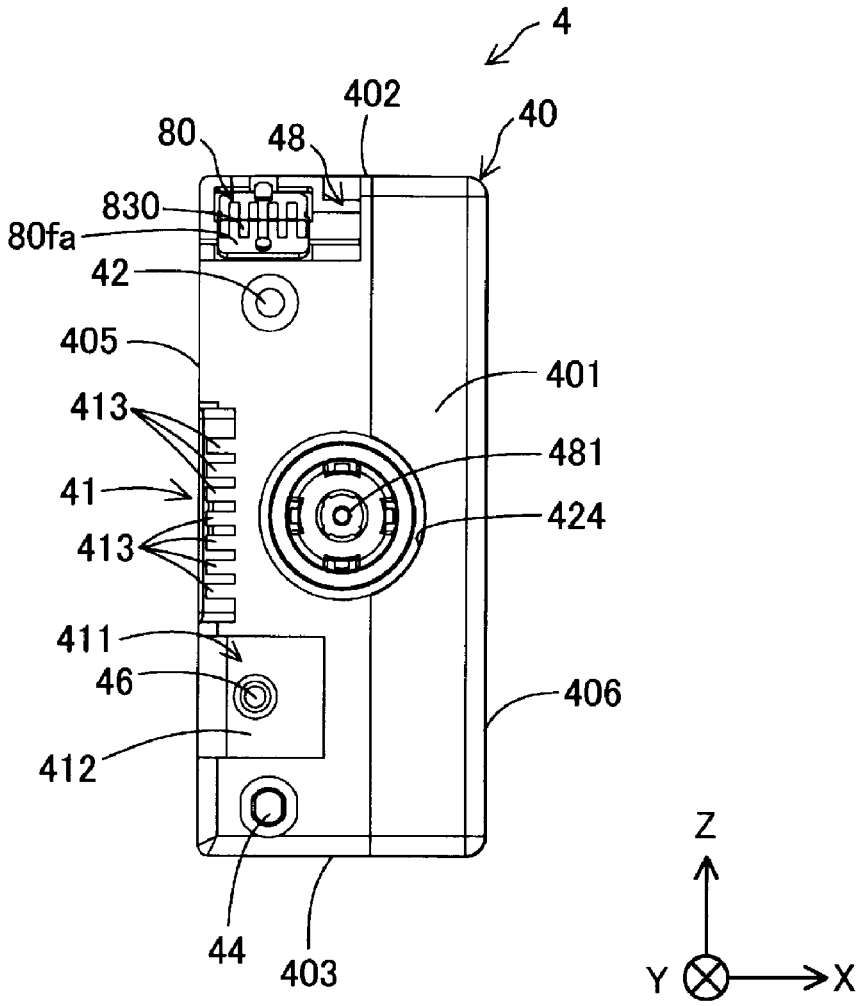
FIG. 4 is a front view of a cartridge.
Figure 5:
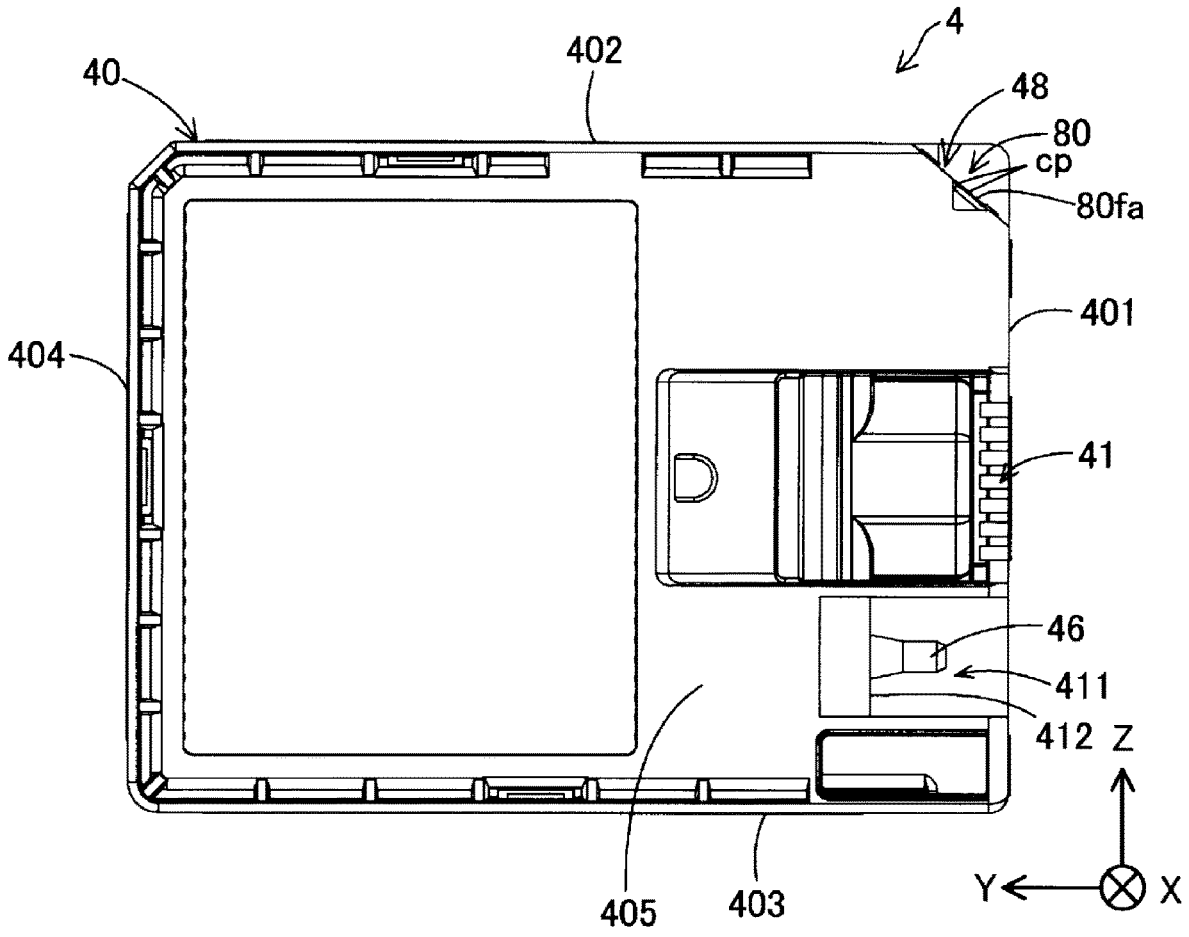
FIG. 5 is a left side view of the cartridge.
Figure 6:
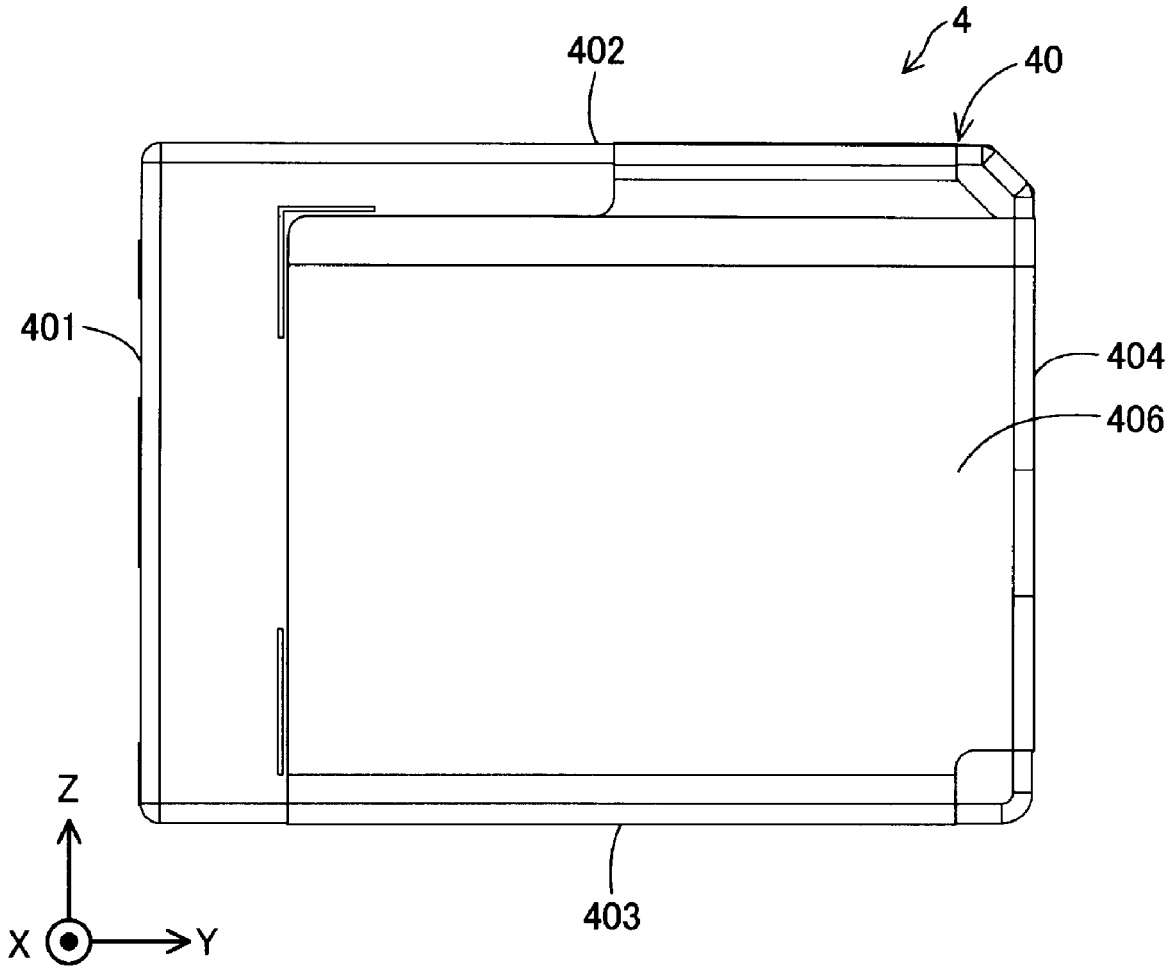
FIG. 6 is a right side view of the cartridge.
Figure 7:
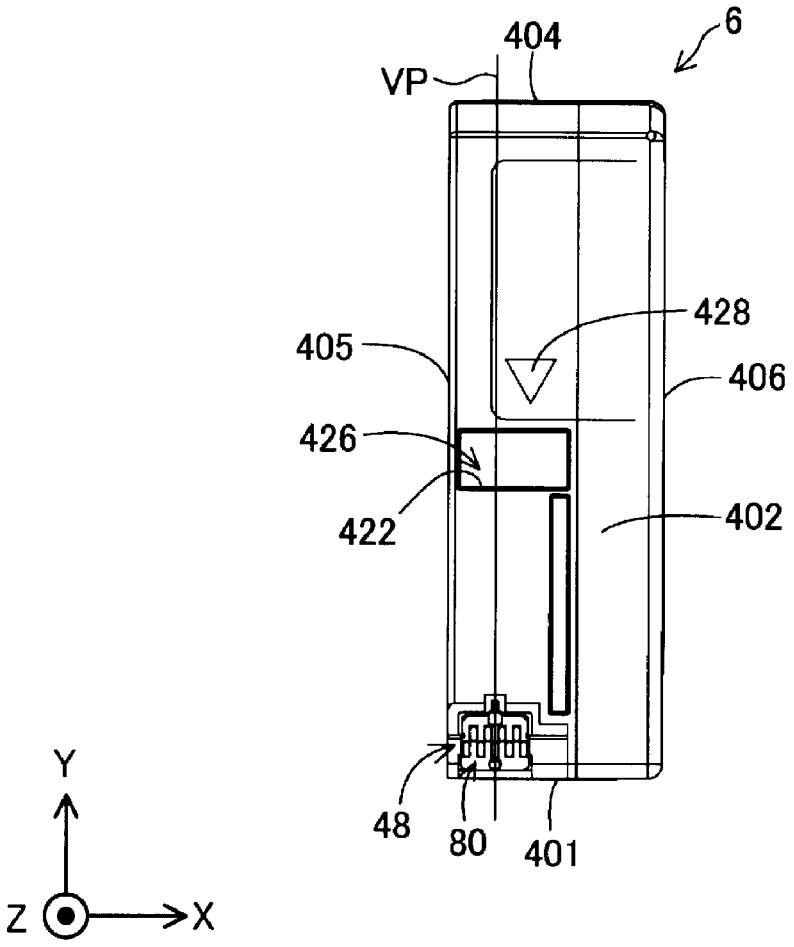
FIG. 7 is a top view of the cartridge.
Figure 8:
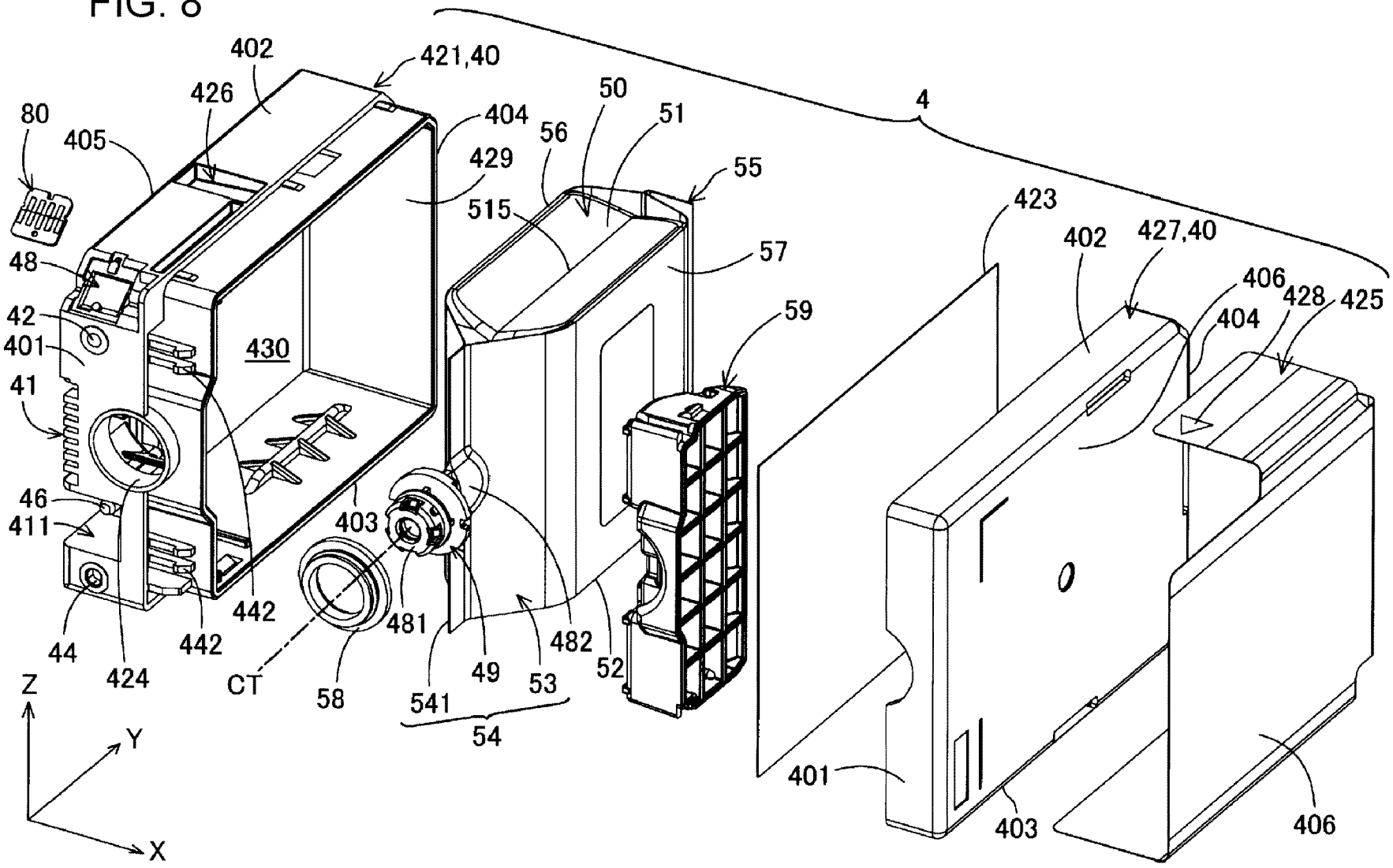
FIG. 8 is an exploded perspective view of the cartridge.
Figure 9:
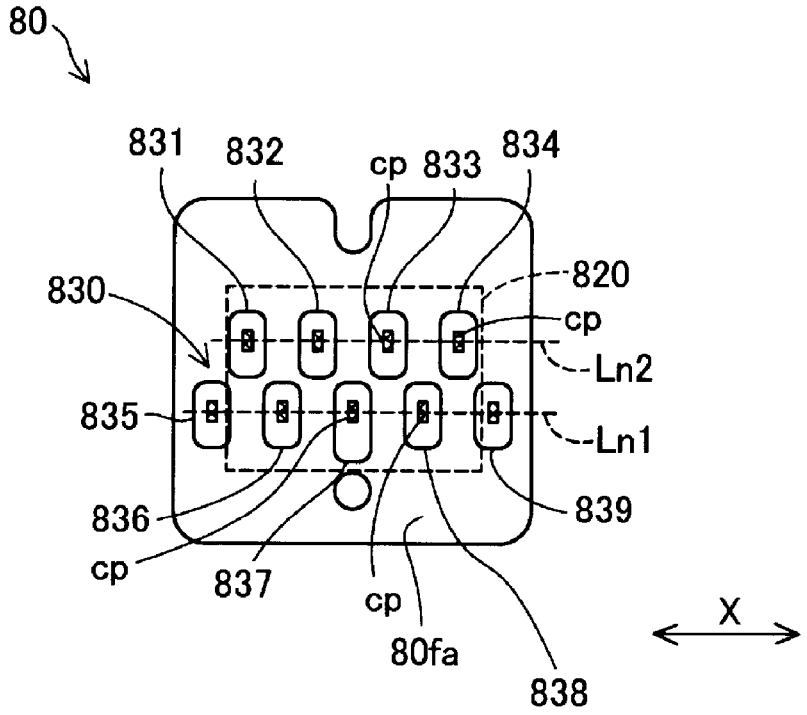
FIG. 9 is a front view of a circuit substrate.

A-3. Configuration of Cartridge:

FIG. 4 is a front view of the cartridge 4. FIG. 5 is a left side view of the cartridge 4. FIG. 6 is a right side view of the cartridge 4. FIG. 7 is a top view of the cartridge 4. FIG. 8 is an exploded perspective view of the cartridge 4. FIG. 9 is a front view of the circuit substrate 80. In FIGS. 4 to 8, the XYZ axes in the mounted state of the cartridge 4 are illustrated.

In the cartridge 4, a liquid storage bag 50 (FIG. 8) is disposed on the inside thereof, and supplies the liquid in the liquid storage bag 50 to the liquid introduction section 85 (FIG. 2). As illustrated in FIGS. 4 to 7, the cartridge 4 has a substantially rectangular parallelepiped outer shape. The cartridge 4 (FIG. 4) includes a case 40 that configures an outer shell. The case 40 is a housing formed by molding a synthetic resin such as polypropylene or polystyrene. In the present embodiment, the case 40 is formed of polystyrene. By forming the case 40 from polystyrene, the shape change after the case 40 is molded can be suppressed, and the creep resistance can be improved. In another embodiment, at least a part of the case 40 may be formed of polystyrene. In this manner, it is also possible to suppress the shape change after the case 40 is molded, and to improve the creep resistance.

The cartridge 4 (FIG. 4) includes a front surface (front wall) 401, a back surface (back wall) 404 (FIG. 5), a first side surface (first side wall) 405, a second side surface (second side wall) 406, a top surface (upper wall) 402, a bottom surface (bottom wall) 403, and a corner 48. Each of the surfaces 401 to 406 has a substantially rectangular planar outer shape. The term "planar" includes a case where the entire surface is completely flat and a case where a part of the surface has irregularities. In other words, a part of the surface may have some irregularities. In the cartridge 4, the X axis direction is the width direction, the Z axis direction is the height direction, and the Y axis direction is the depth direction.

As illustrated in FIG. 5, the front surface 401 and the back surface 404 oppose each other in the Y axis direction. The front surface 401 is a surface positioned on the mounting direction side (−Y axis direction side) of the cartridge 4 to the mounting section 6. In other words, in the direction in which the front surface 401 and the back surface 404 oppose each other, the direction in which the front surface 401 faces from the back surface 404 is the mounting direction. On the front surface 401 (FIG. 4), an arrangement hole 424 in which a liquid supply port 481 is disposed and an arrangement recessed portion 411 in which a fluid receiving section 46 is arranged are formed. The arrangement hole 424 is disposed on the front surface 401 at a position including the center in the width direction (X direction) and the height direction (Z direction). The arrangement recessed portion 411 is open in two directions such as the −Y axis direction and the −X axis direction. The arrangement recessed portion 411 is disposed on the −Z axis direction side and the −X axis direction side of the arrangement hole 424 on the front surface 401. The back surface 404 (FIG. 5) is a surface positioned on the removing direction side (+Y axis direction side) of the cartridge 4 from the mounting section 6.

The top surface 402 and the bottom surface 403 intersect the front surface 401 and the back surface 404, respectively. The top surface 402 and the bottom surface 403 oppose each other in the Z axis direction. The top surface 402 is a surface positioned on the +Z axis direction side, and the bottom surface 403 is a surface positioned on the −Z axis direction side.

As illustrated in FIG. 4, the first side surface 405 and the second side surface 406 intersect the front surface 401, the back surface 404, the top surface 402, and the bottom surface 403, respectively. The first side surface 405 and the second side surface 406 oppose each other in the X axis direction. The first side surface 405 is a surface positioned on the −X axis direction side, and the second side surface 406 is a surface positioned on the +X axis direction side.

The corner 48 (FIGS. 4 and 5) is formed at a corner where the imaginary extension line of the front surface 401 and the imaginary extension line of the top surface 402 intersect each other. The corner 48 has a recessed shape recessed inward of the case 40. The corner 48 is formed in the width direction (X axis direction) of the cartridge 4, over an intermediate part from the first side surface 405 to the second side surface 406.

The cartridge 4 (FIG. 4) further includes the liquid supply port 481, the circuit substrate 80, a first cartridge-side positioning hole 42, a second cartridge-side positioning hole 44, a cartridge-side identification member 41, the fluid receiving section 46, and a cartridge-side engaging section 426 (FIGS. 7 and 8).

The liquid supply port 481 (FIG. 4) is disposed in the arrangement hole 424 of the front surface 401. The liquid supply port 481 is coupled by inserting the liquid introduction section 85 in the mounted state of the cartridge 4, and supplies the liquid in the liquid storage bag 50 to the liquid introduction section 85.

The circuit substrate 80 is disposed at the corner 48. The circuit substrate 80 is positioned on the top surface 402 side (+Z axis direction side) of the liquid supply port 481. As illustrated in FIG. 9, a plurality of (in the present embodiment, nine) cartridge-side terminals 830 are arranged on a surface 80*fa* of the circuit substrate 80, and a storage device 820 is disposed on a rear surface. When the plurality of cartridge-side terminals 830 are used in distinction, reference numerals 831 to 839 are used. In addition, the arrangement of the cartridge-side terminals 830 is not limited to the present embodiment.

Each of the nine cartridge-side terminals 831 to 839 is formed in a substantially rectangular shape, and has a contact portion cp that comes into contact with the corresponding apparatus-side terminal 72 of the mounting section 6. The four contact portions cp of the cartridge-side terminals 831 to 834 form a row Ln2 in which the contact portions are arranged in the X direction. Further, the five contact portions cp of the cartridge-side terminals 835 to 839 form a row Ln1 in which the contact portions are arranged in the X direction and which is different from the row in which the contact portions cp of the cartridge-side terminals 831 to 834 are arranged. In other words, the plurality of contact portions cp form the plurality of rows Ln1 and Ln2. In the present embodiment, each of the contact portions cp of the cartridge-side terminals 831 to 839 is arranged alternately. Specifically, each of the contact portions cp is arranged in a so-called staggered manner.

As illustrated in FIG. 5, the surface 80*fa* on which the contact portions cp are arranged is an inclined surface which is inclined in the direction (−Y direction) from the back surface 404 toward the front surface 401 and the direction (+Z direction) from the bottom surface 403 toward the top surface 402. In other words, a normal vector of the surface 80*fa* as the inclined surface has the +Z direction component and the −Y direction component. The surface 80*fa* is inclined with respect to the mounting direction of the cartridge 4 to the mounting section 6 (−Y axis direction). On the surface 80*fa*, the front surface 401 side is positioned closer to the bottom surface 403 side than the back surface 404 side. The surface 80*fa* is disposed at the corner 48.

Each of the cartridge-side terminals 831 to 839 (FIG. 9) can be called as follows from the function (use).

(1) Mounting detection terminal (first terminal) 835
(2) Power supply terminal 836
(3) Ground terminal 837
(4) Data terminal 838
(5) Mounting detection terminal (second terminal) 839
(6) Mounting detection terminal (third terminal) 831
(7) Reset terminal 832
(8) Clock terminal 833
(9) Mounting detection terminal (fourth terminal) 834

The four mounting detection terminals 831, 834, 835, and 839 are used for detecting whether or not the cartridge 4 is mounted in the mounting section 6 as the control section 31 detects the quality of the electrical contact with the corresponding apparatus-side terminal 72 (FIG. 2) provided in the mounting section 6. In the present embodiment, the four mounting detection terminals 831, 834, 837, and 839 are electrically coupled to each other on the inside of the circuit substrate 80, and when the cartridge 4 is mounted on the mounting section 6, the mounting detection terminals are electrically coupled to a ground line (not illustrated) of the printer 10 through the ground terminal 837.

The other five terminals 832, 833, 836, 837, and 838 are terminals for the storage device 820. The reset terminal 832 receives supply of a reset signal RST to the storage device 820. The clock terminal 833 receives supply of a clock signal SCK to the storage device 820. The power supply terminal 836 receives supply of a power source voltage VDD (for example, rated 3.3 V) to the storage device 820. The ground terminal 837 receives supply of a ground voltage VSS (0 V) to storage device 820. The data terminal 838 receives supply of a data signal SDA exchanged between storage device 820 and printer 10.

The first cartridge-side positioning hole 42 (FIG. 4) is formed on the front surface 401. The first cartridge-side positioning hole 42 is positioned closer to the top surface 402 side (+Z axis direction side) than the cartridge-side identification member 41 and the liquid supply port 481. The first cartridge-side positioning hole 42 has a circular cross-sectional shape perpendicular to the Y axis direction. The opening area of the first cartridge-side positioning hole 42 is substantially the same as the size of the cross-sectional shape of the first apparatus-side positioning section 82 perpendicular to the Y axis direction. In the mounting process, before each of the sections 41, 80, 481, and 46 and each of the corresponding sections 81, 72, 85, and 86 (FIG. 2) in the mounting section 6 start to come into contact or become fitted with each other, the insertion of the first apparatus-side positioning section 82 into the first cartridge-side positioning hole 42 is started. By inserting the first mounting section positioning section 82, the positioning of the cartridge 4 with respect to the mounting section 6 within a plane orthogonal to the mounting direction (−Y axis direction) is performed.

The second cartridge-side positioning hole 44 (FIG. 4) is formed on the front surface 401. The second cartridge-side positioning hole 44 is positioned closer to the bottom surface 403 side (−Z axis direction side) than the cartridge-side identification member 41 and the liquid supply port 481. In other words, in the Z axis direction, the first cartridge-side positioning hole 42 and the second cartridge-side positioning hole 44 are positioned with the liquid supply port 481 sandwiched therebetween. In the mounting process, before each of the sections 41, 80, 481, and 46 and each of the corresponding sections 81, 72, 85, and 86 (FIG. 2) in the mounting section 6 start to come into contact or become fitted with each other, the insertion of the second apparatus-side positioning section 84 into the second cartridge-side positioning hole 44 is started. By inserting the second mounting section positioning section 84, the positioning of the cartridge 4 with respect to the mounting section 6 within a plane orthogonal to the mounting direction (−Y axis direction) is performed. Here, the second cartridge-side positioning hole 44 has an elliptical cross-sectional shape perpendicular to the Y axis direction, which is elongated in the Z axis direction. The length of the second cartridge-side positioning hole 44 in the Z axis direction is larger than the length of the second apparatus-side positioning section 84 in the Z axis direction. When the second apparatus-side positioning section 84 is inserted into the second cartridge-side positioning hole 44, a minute gap is generated in the Z axis direction. In this manner, by increasing the length of the second cartridge-side positioning hole 44 in the Z axis direction, it becomes easy to allow a dimensional tolerance while maintaining the positioning accuracy. In other words, the positioning accuracy of the cartridge 4 in the mounting section 6 is ensured by the first cartridge-side positioning hole 42.

The cartridge-side identification member 41 (FIGS. 4 and 5) is formed over the front surface 401 and the first side surface 405. The cartridge-side identification member 41 is fitted with the apparatus-side identification member 81 at least in the mounting process. Specifically, the cartridge-side identification member 41 becomes fitted with the apparatus-side identification member 81 after the first apparatus-side positioning section 82 starts to be inserted into the first cartridge-side positioning hole 42 and the second apparatus-side positioning section 84 starts to be inserted into the second cartridge-side positioning hole 44. Further, the cartridge-side identification member 41 may be fitted with the apparatus-side identification member 81 even in the mounted state of the cartridge 4. The cartridge-side identification member 41 is formed by at least one or more ribs 413 similar to the apparatus-side identification member 81. The cartridge-side identification member 41 has a different pattern determined by the number and position of the ribs depending on the type (the ink color to be stored in the present embodiment) of the cartridge 4. When the cartridge 4 is mounted on the correct type of the mounting section 6, the cartridge-side identification member 41 is fitted with the apparatus-side identification member 81 in the mounting process. Accordingly, the cartridge 4 can be further pushed in the mounting direction.

The fluid receiving section 46 (FIG. 4) is formed on the front surface 401. Specifically, the fluid receiving section 46 is formed in the arrangement recessed portion 411 of the front surface 401. The fluid receiving section 46 is a cylindrical member that extends in the −Y axis direction from a recessed bottom surface 412 on the +Y axis direction side on the arrangement recessed portion 411. The fluid receiving section 46 makes the outside and the inside of the case 40 communicate with each other. The fluid receiving section 46 is coupled to the pressurizing section 86 by being inserted into the pressurizing section 86 in the mounted state of the cartridge 4. Accordingly, the fluid receiving section 46 receives the pressurized fluid supplied from the pressurizing section 86. The pressurized fluid supplied to the fluid receiving section 46 is introduced into the case 40 and pressurizes the case 40 to pressurize the liquid storage bag 50 from the outside. Accordingly, the liquid in the liquid storage bag 50 is supplied to the liquid introduction section 85 via the liquid supply port 481.

The cartridge-side engaging section 426 (FIGS. 7 and 8) is engaged with the apparatus-side engaging section 881 (FIG. 2) in the mounted state of the cartridge 4. Accordingly, the movement of the cartridge 4 in the removing direction (+Y axis direction) is regulated. The cartridge-side engaging section 426 is a recessed portion provided on the top surface 402. The cartridge-side engaging section 426 is disposed at a position shifted to one side of the first side surface 405 side and the second side surface 406 side in the width direction (X direction). In the present embodiment, the cartridge-side engaging section 426 is disposed at a position shifted to the first side surface 405 side in the width direction. In other words, the cartridge-side engaging section 426 is disposed at a position closer to the first side surface 405 than to the second side surface 406. As illustrated in FIG. 7, the cartridge-side engaging section 426 which is a recessed portion has an engaging surface 422 that configures the side surface on the −Y axis direction side. The engaging surface 422 is a surface parallel to the X axis direction and the Z axis direction. The engaging surface 422 is a part that is engaged with the apparatus-side engaging section 881 illustrated in FIG. 2 in the mounted state of the cartridge 4.

The cartridge 4 (FIG. 7) further includes a direction identification section 428 for showing the user the mounting direction of the cartridge 4 to the mounting section 6. The direction identification section 428 is an arrow disposed on the top surface 402.

The cartridge 4 (FIG. 8) further includes a first case 421, a second case 427, the liquid storage bag 50, a liquid supply section 49, a sheet member (film) 423, a cover member 425, and an auxiliary member 59, and a ring member 58. The case 40 is formed by the first case 421 and the second case 427.

The first case 421 has a recessed shape that opens on the +X axis direction side. The first case 421 mainly forms a part of the front surface 401, a part of the back surface 404, a part of the top surface 402, a part of the bottom surface 403, a first side surface 405, and the corner 48. At the part of the front surface 401 formed by the first case 421, the first cartridge-side positioning hole 42, the second cartridge-side positioning hole 44, the arrangement recessed portion 411, the fluid receiving section 46, and the arrangement hole 424 which are described above are formed. The above-described cartridge-side engaging section 426 is formed at a part of the top surface 402 formed by the first case 421. The first case 421 further has engagement claws 442, and forms the case 40 by being engaged with the second case 427.

The sheet member 423 is a thin film member. The sheet member 423 is airtightly attached to an end surface that defines an opening 429 so as to seal the opening 429 on the +X axis direction side of the first case 421. By sealing the opening 429 with the sheet member 423, an internal chamber 430 that stores the liquid storage bag 50 and the auxiliary member 59 is defined. The pressurized fluid is introduced into the internal chamber 430 via the fluid receiving section 46.

The second case 427 is attached to the first case 421 so as to cover the sheet member 423. Specifically, the second case 427 is attached to the first case 421 by being engaged with the engagement claws 442. The second case 427 mainly forms another part of the front surface 401, another part of the back surface 404, another part of the top surface 402, another part of the bottom surface 403, and the second side surface 406.

The liquid supply section 49 is cylindrical and extends along the Y axis direction. The liquid supply section 49 has a center axis CT parallel to the Y axis direction. The liquid supply section 49 has a liquid supply port 481 that forms a distal end portion, and a base end portion 482 attached to the liquid storage bag 50. The base end portion 482 of the liquid supply section 49 is open in the liquid storage bag 50. The liquid supply section 49 forms a flow path that allows the liquid in the liquid storage bag 50 to flow toward the liquid supply port 481. Further, a valve mechanism is disposed on the inside of the liquid supply section 49, and the valve mechanism is in an open state by inserting the liquid introduction section 85 into the liquid supply section 49.

The liquid storage bag 50 that stores the liquid has a substantially rectangular parallelepiped shape, and is stored in the case 40 (specifically, the internal chamber 430). When the shape of the liquid storage bag 50 is described, it is assumed that the liquid illustrated in FIG. 8 is stored.

The liquid storage bag 50 stores the liquid to be supplied to the printer 10. The liquid storage bag 50 has flexibility, and the volume decreases as the liquid is consumed. Specifically, the liquid storage bag 50 has a godet portion (fold) 515 that extends in the Y axis direction on a bag top surface 51 and a bag bottom surface 52, respectively. Due to the godet portion 515, the dimension of the liquid storage bag 50 in the X direction gradually decreases as the liquid is consumed.

The liquid storage bag 50 has a storage bag end portion 54 as a distal end portion, the bag top surface 51, the bag bottom surface 52, a rear end portion 55, a bag left side surface 56, and a bag right side surface 57.

The storage bag end portion 54 is positioned on the −Y axis direction side. The base end portion 482 is attached to the storage bag end portion 54. The storage bag end portion 54 has a distal end side 541 that forms an end on the −Y axis direction side, and a tapered portion 53. The tapered portion 53 has an end portion on the −Y axis direction side coupled to the distal end side 541, and an end portion on the +Y axis direction side coupled to the bag left side surface 56 and the bag right side surface 57. The dimension of the tapered portion 53 in the width direction (X axis direction) gradually decreases as going toward the liquid supply port 481 side (−Y axis direction side) of the liquid supply section 49. By providing the tapered portion 53, when the liquid storage bag 50 is stored in the case 40, a space (gap) is generated between the inner wall surface of the case 40 and the tapered portion 53.

The rear end portion 55 opposes the storage bag end portion 54 in the Y axis direction. The rear end portion 55 is positioned on the +Y axis direction side. The rear end portion 55 is bent toward the +Y axis direction side as illustrated in FIG. 8 in a state of being stored in the case 40. Accordingly, since the dimension of the internal chamber 430 in the Y axis direction can be reduced, an increase in the size of the case 40 can be suppressed.

The bag top surface 51 is positioned on the +Z axis direction side. The bag bottom surface 52 opposes the bag top surface 51 in the Z axis direction. The bag bottom surface 52 is positioned on the −Z axis direction side. The bag left side surface 56 is positioned on the −X axis direction side. The bag right side surface 57 opposes the bag left side surface 56 in the X direction. The bag right side surface 57 is positioned on the +X axis direction side.

The ring member 58 is disposed on the outer periphery of the liquid supply section 49 so as to surround the distal end side of the liquid supply section 49. The ring member 58 is, for example, a rubber member and is disposed in the arrangement hole 424 together with the liquid supply port 481. As the ring member 58 is in contact with the arrangement hole 424, the position of the liquid supply port 481 in the arrangement hole 424 is fixed.

The auxiliary member 59 is positioned between the tapered portion 53 and the sheet member 423 in the width direction (X direction) of the cartridge 4. The auxiliary member 59 is formed of a synthetic resin such as polypropylene or polystyrene. The auxiliary member 59 is disposed in the space between the tapered portion 53 and the sheet member 423, and accordingly, the movement of the tapered portion 53 in the case 40 is suppressed.

The cover member 425 is a sheet-like member attached to the surface of the case 40. The cover member 425 is formed with the direction identification section 428.

Figure 10:
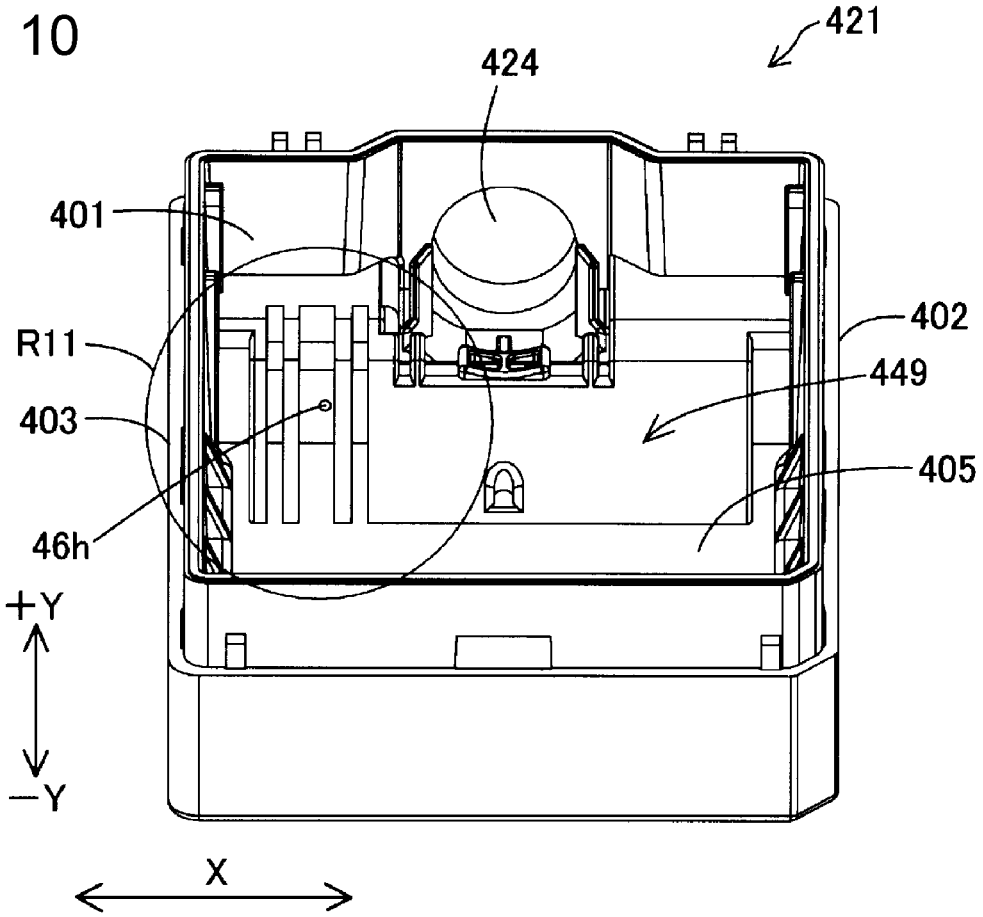
FIG. 10 is a view illustrating an inside of a first case.
Figure 11:
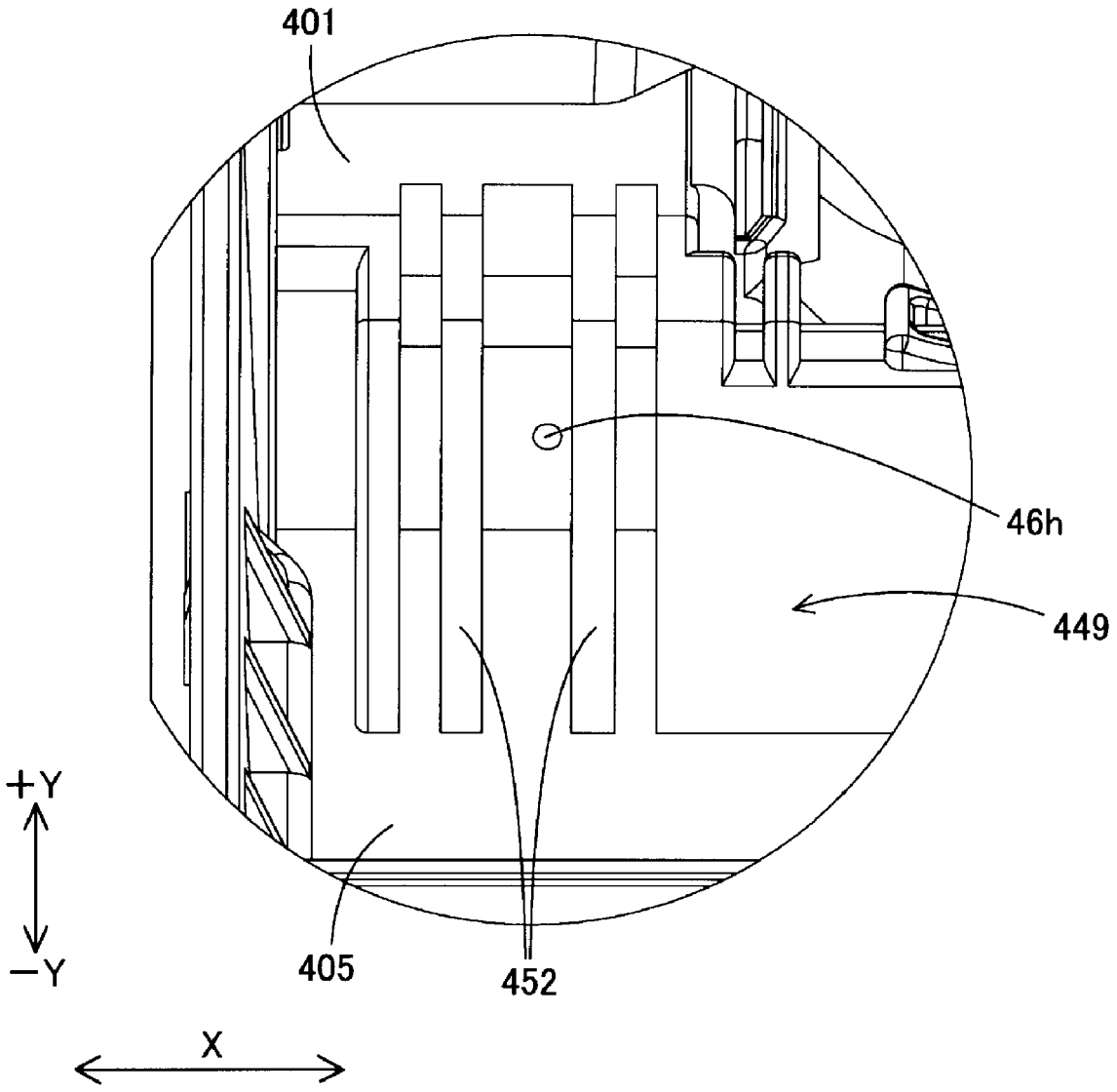
FIG. 11 is an enlarged view of a region in FIG. 10.

FIG. 10 is a view illustrating the inside of the first case 421. FIG. 11 is an enlarged view of a region R11 in FIG. 10. The first case 421 (FIG. 10) has an inclined rib portion 449 coupled to the front surface 401 and the first side surface 405 on the front surface 401 side. The inclined rib portion 449 is positioned between the tapered portion 53 and the first side surface 405, and suppresses the movement of the tapered portion 53 in the case 40. The inclined rib portion 449 has a pair of ribs 452 as illustrated in FIG. 11. The pair of ribs 452 surrounds at least a part of an inner opening 46*h* of the fluid receiving section 46. The inner opening 46*h* is formed on the inner surface of the front surface 401 of the fluid receiving section 46, and forms one end portion of the fluid receiving section 46 on the +Y axis direction side. Each of the pair of ribs 452 is a plate-like member. The pair of ribs 452 is positioned so as to sandwich the inner opening 46*h* in the width direction (X axis direction). By protruding inward of the case 40 from the inner opening 46*h*, the pair of ribs 452 surrounds the inner opening 46*h* in the width direction. By providing the pair of ribs 452, it is possible to reduce the possibility that the inner opening 46*h* is closed by the liquid storage bag 50.

Figure 12:
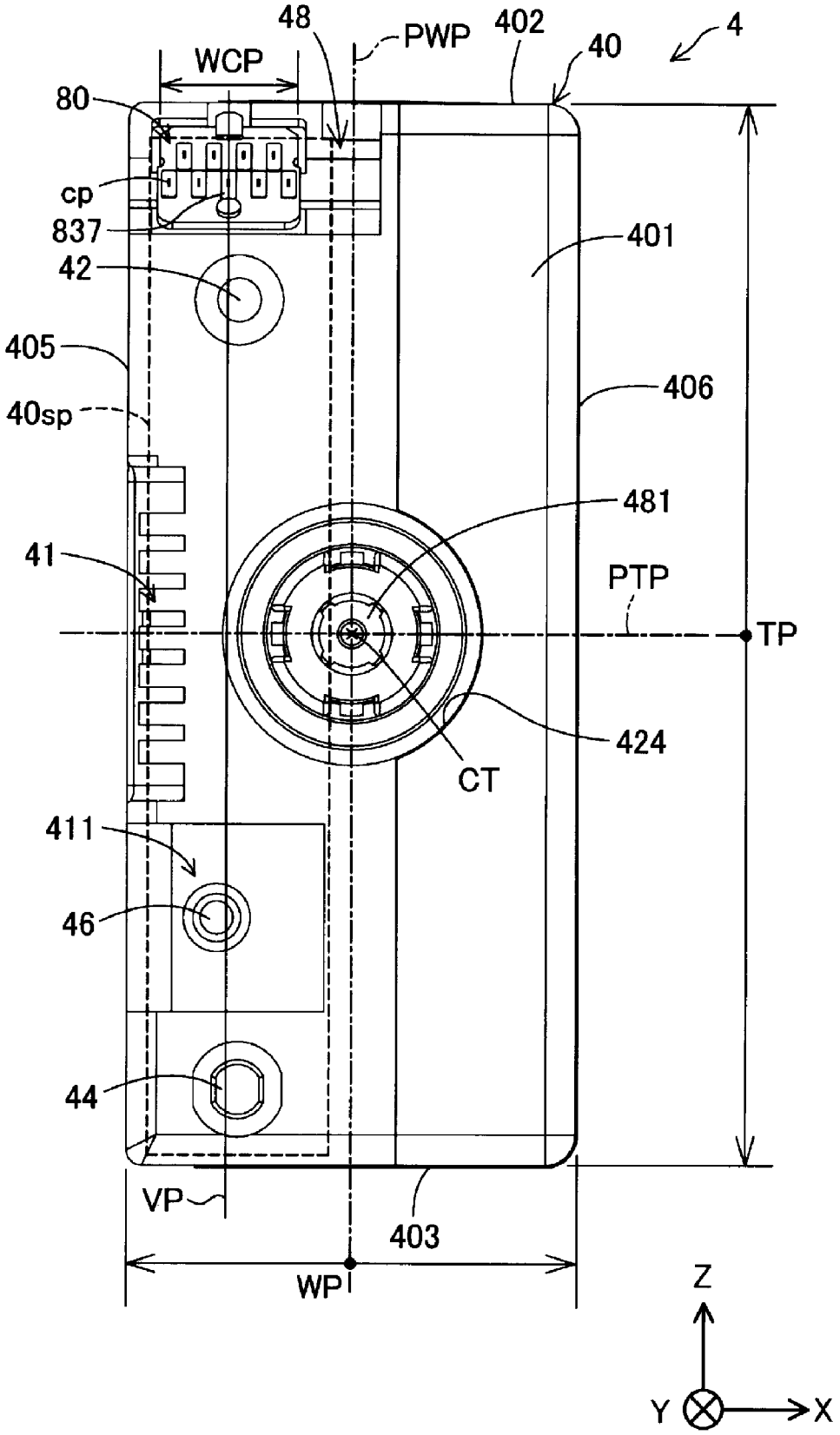
FIG. 12 is a view for describing a positional relationship between elements of the cartridge.

A-4. Positional Relationship of Each Element of Cartridge:

FIG. 12 is a view for describing the positional relationship of each element of the cartridge 4. The liquid supply port 481 is disposed at a center WP of the case 40 in the width direction (X axis direction) in which the first side surface 405 and the second side surface 406 oppose each other. In other words, the liquid supply port 481 passes through the center WP and intersects a first center plane PWP parallel to the Y axis direction and the Z axis direction. The liquid supply port 481 is disposed at a center TP of the case 40 in the height direction (Z axis direction) in which the top surface 402 and the bottom surface 403 oppose each other. In other words, the liquid supply port 481 passes through the center TP and intersects a second center plane PTP parallel to the X axis direction and the Y axis direction. In the present embodiment, the center axis CT of the liquid supply section 49 (liquid supply port 481) is positioned at the center WP in the width direction and the center TP in the height direction of the case 40. A case where the case 40 is disposed at the center WP or the center TP means both a case where the case is positioned completely at the center WP or the center TP and a case where the case is slightly deviated from the center WP or the center TP due to tolerance or the like.

The corner 48 is formed at a position shifted to one side of the first side surface 405 side and the second side surface 406 side in the width direction (X direction) of the cartridge 4. In the present embodiment, the corner 48 is formed at a position shifted to the first side surface 405 side in the width direction of the cartridge 4. In other words, the corner 48 is formed at a position closer to the first side surface 405 than to the second side surface 406.

The circuit substrate 80 having the contact portion cp is disposed at a position shifted to one side of the first side surface 405 side and the second side surface 406 side in the width direction (X direction) of the cartridge 4. In the present embodiment, the circuit substrate 80 having the contact portion cp is disposed at a position shifted to the first side surface 405 side in the width direction of the cartridge 4. In other words, the circuit substrate 80 is disposed at a position closer to the first side surface 405 than to the second side surface 406, and is positioned between the first center plane PWP and the first side surface 405 in the width direction.

The first cartridge-side positioning hole 42 and the second cartridge-side positioning hole 44 are respectively disposed at positions shifted to the first side surface 405 side, which is one side, in the width direction of the cartridge 4. In other words, the first cartridge-side positioning hole 42 and the second cartridge-side positioning hole 44 are respectively disposed at a position closer to the first side surface 405 than to the second side surface 406, and are positioned between the first center plane PWP and the first side surface 405 in the width direction. Further, the first cartridge-side positioning hole 42 and the second cartridge-side positioning hole 44 are respectively positioned within a range WCP where the plurality of contact portions cp are positioned in the width direction of the cartridge 4.

The fluid receiving section 46 and the arrangement recessed portion 411 are respectively disposed at positions shifted to the first side surface 405 side, which is one side, in the width direction of the cartridge 4. In other words, the fluid receiving section 46 and the arrangement recessed portion 411 are respectively disposed at a position closer to the first side surface 405 than to the second side surface 406, and are positioned between the first center plane PWP and the first side surface 405 in the width direction. Further, the fluid receiving section 46 is positioned within the range WCP where the plurality of contact portions cp are positioned in the width direction of the cartridge 4.

The cartridge-side identification member 41 is disposed in a range including the center TP in the height direction (Z axis direction) of the cartridge 4 in which the top surface 402 and the bottom surface 403 oppose each other. In other words, the cartridge-side identification member 41 is disposed at a position passing through the second center plane PTP. Further, the cartridge-side identification member 41 is disposed at a position shifted to the first side surface 405 side which is one side. In the present embodiment, the cartridge-side identification member 41 is disposed being in contact with the first side surface 405. The cartridge-side identification member 41 is disposed on the side portion (in the present embodiment, the side portion on the first side surface 405 of the liquid supply port 481) of the liquid supply port 481 in the width direction. In other words, the cartridge identification member 41 is disposed such that at least a part thereof overlaps the range where the liquid supply port 481 is positioned in the height direction. In the present embodiment, in the height direction, the center of the cartridge-side identification member 41 and the center (center axis CT) of the liquid supply port 481 are disposed at the same position. Here, a case where the center of the cartridge-side identification member 41 and the center of the liquid supply port 481 are disposed at the same position with respect to the height direction means both a case where the center of the cartridge-side identification member 41 and the center of the liquid supply port 481 are positioned completely at the same position with respect to the height direction, and a case where the center of the cartridge-side identification member 41 is slightly deviated from the center of the liquid supply port 481 due to the tolerance or the like. In the height direction, the center of each of the liquid supply port 481 and the cartridge-side identification member 41 is positioned at the center of the mounting section 6.

According to the above-described first embodiment, in the width direction of the cartridge 4, the liquid supply port 481 is disposed at the center of the case 40, and the contact portion cp is disposed at a position shifted to the first side surface 405 side. Accordingly, for example, even when the liquid leaks from the liquid supply port 481 when a posture where the top surface 402 is a lower side is achieved during the transport of the cartridge 4, it is possible to reduce the possibility that the leaked liquid adheres to the contact portion cp. Accordingly, it is possible to suppress the contact failure between the contact portion cp and the apparatus-side terminal 72. In addition, for example, even when the posture where the bottom surface 403 is a lower side is achieved, the contact portion cp is disposed at a position shifted to the first side surface 405 side, and thus, the distance between the liquid supply port 481 and the contact portion cp can be ensured longer. Accordingly, even when the posture where the bottom surface 403 is a lower side is achieved, it is possible to reduce the possibility that the leaked liquid adheres to the contact portion cp. Accordingly, it is possible to suppress the contact failure between the contact portion cp and the apparatus-side terminal 72.

According to the first embodiment, the contact portion cp is disposed on the surface (inclined surface) 80*fa* inclined with respect to the mounting direction (−Y axis direction), and accordingly, it is possible to reduce the possibility that impurities such as dust adhere to the contact portion cp. In other words, when the cartridge 4 is inserted into the mounting section 6, the cartridge 4 advances in the −Y axis direction. At this time, the contact portion cp also advances in the −Y axis direction and gradually approaches the apparatus-side terminal 72, but does not come into contact with each other until immediately before the mounting is completed. Immediately before the mounting is completed, the apparatus-side terminal 72 and the cartridge-side terminal 830 slightly rub against each other. In this manner, while the apparatus-side terminal 72 and the cartridge-side terminal 830 hardly rub against each other when the cartridge 4 is mounted, it is possible to reduce the possibility that shavings (impurities) are generated as the apparatus-side terminal 72 rubs against the cartridge 4 when the cartridge 4 is mounted as the apparatus-side terminal 72 and the cartridge-side terminal 830 slightly rub against each other immediately before the mounting of the cartridge 4 is completed. Further, even when dust is present in the vicinity of the apparatus-side terminal 72 and is caught between the apparatus-side terminal 72 and the cartridge-side terminal 830, the dust can be removed as follows. In other words, the apparatus-side terminal 72 comes into contact with the surface 80*fa* of the cartridge-side terminal 830 while rubbing against the surface 80*fa*, an effect (wiping effect) of removing the dust from the contact portion cp is exhibited, and it is possible to reduce the possibility where the impurities such as dust are caught between the apparatus-side terminal 72 and the cartridge-side terminal 830. Accordingly, it is possible to suppress the contact failure between the contact portion cp and the apparatus-side terminal 72.

When the cartridge 4 is mounted on the mounting section 6, the positioning of the contact portion cp in the X axis direction, the Y axis direction, and the Z axis direction is performed by a positioning section different from the inclined surface 80*fa*. In other words, the positioning in the X axis direction and the Z axis direction is performed by the first cartridge-side positioning hole 42, and the positioning in the Y axis direction is performed by the cartridge-side engaging section 426. It is desirable to provide positioning sections in the X axis direction, the Y axis direction, and the Z axis direction on the inclined surface 80*fa*, for example, to provide the contact portions cp on both sides sandwiching the contact portions in the X axis direction in order to increase the positioning accuracy. However, in this case, there is a case where the dimension in the X axis direction increases. Accordingly, in order to reduce the size of the cartridge 4, according to the present embodiment, the positioning section is provided on a surface different from the inclined surface 80*fa*. In this case, it is particularly necessary to suppress the tolerance in the Y axis direction and the Z axis direction.

As illustrated in FIG. 12, the first cartridge-side positioning hole 42 intersects an imaginary plane VP. Further, as illustrated in FIG. 7, the cartridge-side engaging section 426 intersects the imaginary plane VP. Specifically, the engaging surface 422 of the cartridge-side engaging section 426 intersects the imaginary plane VP. In other words, a part of the first cartridge-side positioning hole 42 and a part of the engaging surface 422 are positioned on the imaginary plane VP. As illustrated in FIGS. 9 and 12, among the nine terminals 831 to 839 that configure the two rows Ln1 and Ln2 arranged on the inclined surface 80*fa*, the imaginary plane VP is a surface that passes through the contact portion cp of the terminal 837 disposed at the center in the X axis direction and is parallel to the Y axis direction and the Z axis direction among the terminals 835 to 839 arranged in the closest row Ln1 in the first cartridge-side positioning hole 42. In addition, as illustrated in FIG. 7, the engaging surface 422 of the cartridge-side engaging section 426 that is closest to the circuit substrate 80 in the Y axis direction perpendicularly intersects the imaginary plane VP. The following effects are achieved by having the positional relationship of the imaginary plane VP, the cartridge-side engaging section 426, and the first cartridge-side positioning hole 42 which are described above. In other words, the distance from the contact portion cp of the terminal 837 to each of the engaging surface 422 of the cartridge-side engaging section 426 and the first cartridge-side positioning hole 42 can be reduced. Accordingly, the positioning accuracy in the Y axis direction performed by the engaging surface 422 of the cartridge-side engaging section 426 and the positioning accuracy in the X axis direction and the Z axis direction performed by the first cartridge-side positioning hole 42 can be respectively increased.

According to the first embodiment, since the liquid storage bag 50 has the tapered portion 53 (FIG. 8), a space 40*sp* (FIG. 12) can be generated between the tapered portion 53 and the inner surface of the case 40 on the inside of the case 40. Meanwhile, the corner 48 has a recessed shape recessed inward of the case 40 and is formed at a position shifted to the first side surface 405 side, which is one side, in the width direction. In other words, the corner 48 can be provided by effectively using the space 40*sp* (FIG. 12) generated between the tapered portion 53 and the inner surface of the case 40 (specifically, the inner surface of the first side surface 405). Accordingly, the size of the cartridge 4 can be reduced.

According to the above-described first embodiment, the first cartridge-side positioning hole 42, the second cartridge-side positioning hole 44, the fluid receiving section 46 are respectively disposed at positions shifted to the first side surface 405 side, which is one side, in the width direction of the cartridge 4. Accordingly, the displacement of the fluid receiving section 46 with respect to the mounting section 6 can be suppressed. Further, the arrangement recessed portion 411 in which the fluid receiving section 46 is disposed is disposed at a position shifted to the first side surface 405 side in the width direction of the cartridge 4. In other words, the arrangement recessed portion 411 can be provided by effectively using the space 40*sp* (FIG. 12) generated between the tapered portion 53 and the inner surface of the case 40 (specifically, the inner surface of the first side surface 405). Accordingly, the size of the cartridge 4 can further be reduced.

According to the above-described first embodiment, in the width direction of the cartridge 4, the first cartridge-side positioning hole 42, the second cartridge-side positioning hole 44, and the fluid receiving section 46 are positioned within the range WCP where the plurality of contact portions cp are positioned. Accordingly, the displacement of the fluid receiving section 46 and the contact portion cp in the mounted state of the cartridge 4 can be suppressed. Further, according to the above-described first embodiment, as the cartridge-side identification member 41 is disposed in the range including the center TP in the height direction of the cartridge 4, the rotation of the cartridge 4 with the center TP in the height direction as a fulcrum can be suppressed. Accordingly, during the mounting process of the cartridge 4, it is possible to reduce the possibility that the first apparatus-side positioning section 82 inserted into the first cartridge-side positioning hole 42 and the second apparatus-side positioning section 84 inserted into the second cartridge-side positioning section 44 collide with the cartridge 4 and an external force is applied. Further, according to the above-described first embodiment, the cartridge-side identification member 41 is disposed on the first side surface 405 side, which is one side, in the width direction, and is disposed on the side portion of the liquid supply port 481. Accordingly, since the distance between the liquid supply port 481 and the cartridge-side identification member 41 can be disposed closer, even when the cartridge 4 rotates around the vicinity of the cartridge-side identification member 41, the displacement of the liquid supply port 481 can be suppressed. Thereby, the displacement of the liquid supply port 481 during the mounting process can be suppressed.

According to the above-described first embodiment, the cartridge 4 can be accurately positioned by using the two first cartridge-side positioning holes 42 and the second cartridge-side positioning holes 44. Further, according to the above-described first embodiment, the cartridge-side engaging section 426 (FIG. 7) is disposed at a position shifted to the same one side as the contact portion cp in the width direction of the cartridge 4. Accordingly, it is possible to suppress the displacement of the contact portion cp with respect to the apparatus-side terminal 72 in the mounted state.

B. Other Embodiments for Periphery of Contact Portion

B-1. Another Embodiment 1

Figure 13:
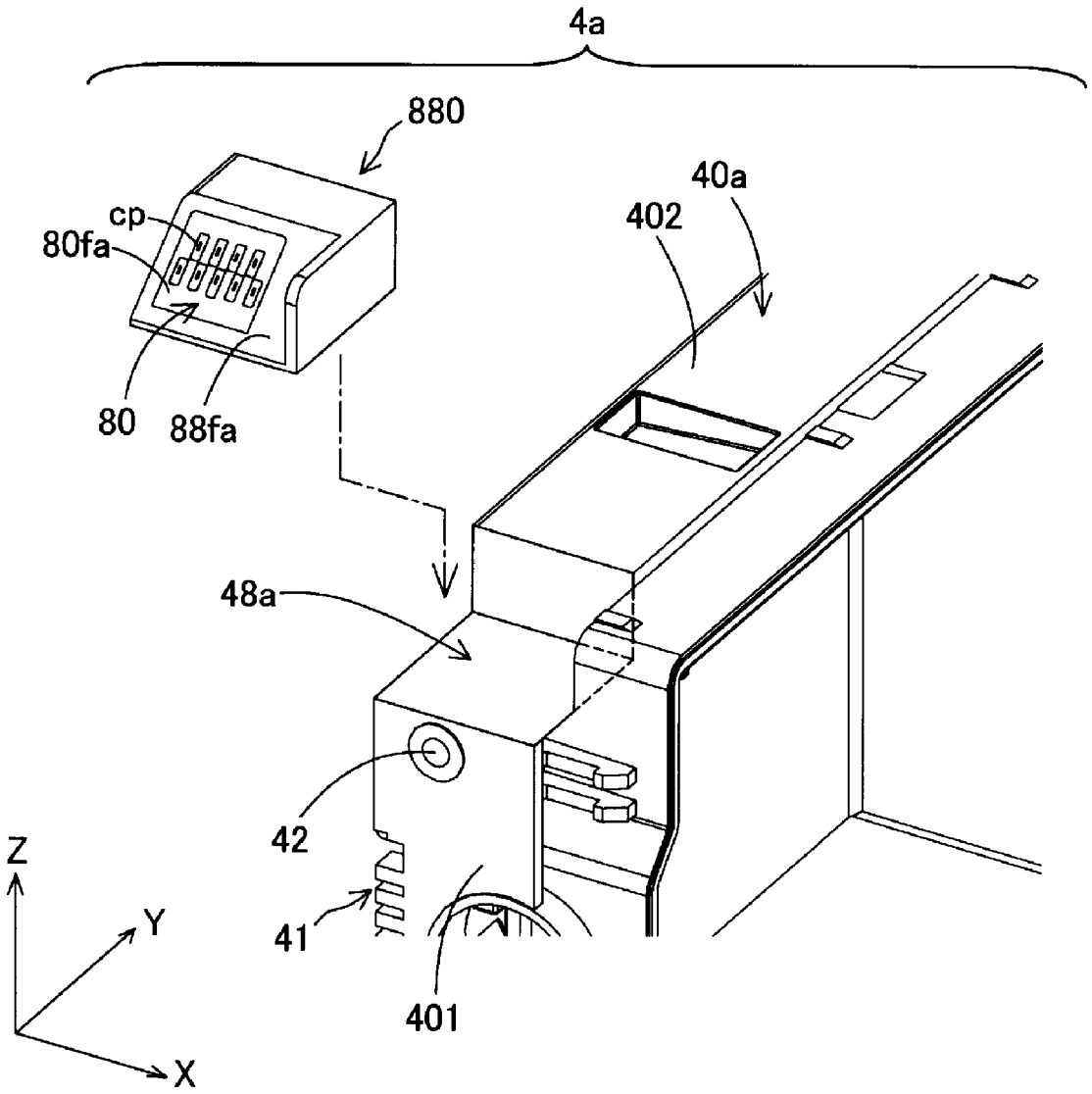
FIG. 13 is a view for describing another Embodiment 1.

FIG. 13 is a view for describing another embodiment 1. The difference between a cartridge 4*a* of another embodiment 1 and the cartridge 4 of the above-described first embodiment is that a substrate holder 880 provided with the circuit substrate 80 can be attached to and detached from the case 40*a*, and the configuration of a corner 48*a*. Since other configurations are the same as those of the first embodiment, the same configurations will be given the same reference numerals and the description thereof will be omitted.

The substrate holder 880 is detachably attached to the corner 48*a*. The substrate holder 880 and the corner 48*a* have engaging sections (not illustrated) configured to be attachable to and detachable from each other. The substrate holder 880 has a holder inclined surface 88*fa* to which the circuit substrate 80 is attached. The holder inclined surface 88*fa* is inclined with respect to the mounting direction (−Y axis direction) of the cartridge 4*a* in a state where the substrate holder 880 is attached to the corner 48*a*. Specifically, the normal vector of the holder inclined surface 88*fa* has the +Z axis direction component and the −Y axis direction component. The corner 48*a* is positioned at a part where the front surface 401 and the top surface 402 intersect each other. The corner 48*a* has a recessed shape recessed inward of the case 40*a*. In a state where the substrate holder 880 is attached to the corner 48*a*, the surface 80*fa* is inclined with respect to the mounting direction, similar to the first embodiment. Even in this case, the same effect as that in the above-described first embodiment can be obtained. For example, even when the liquid leaks from the liquid supply port 481 when a posture where the top surface 402 is a lower side is achieved during the transport of the cartridge 4, it is possible to reduce the possibility that the leaked liquid adheres to the contact portion cp.

B-2. Another Embodiment 2

Figure 14:
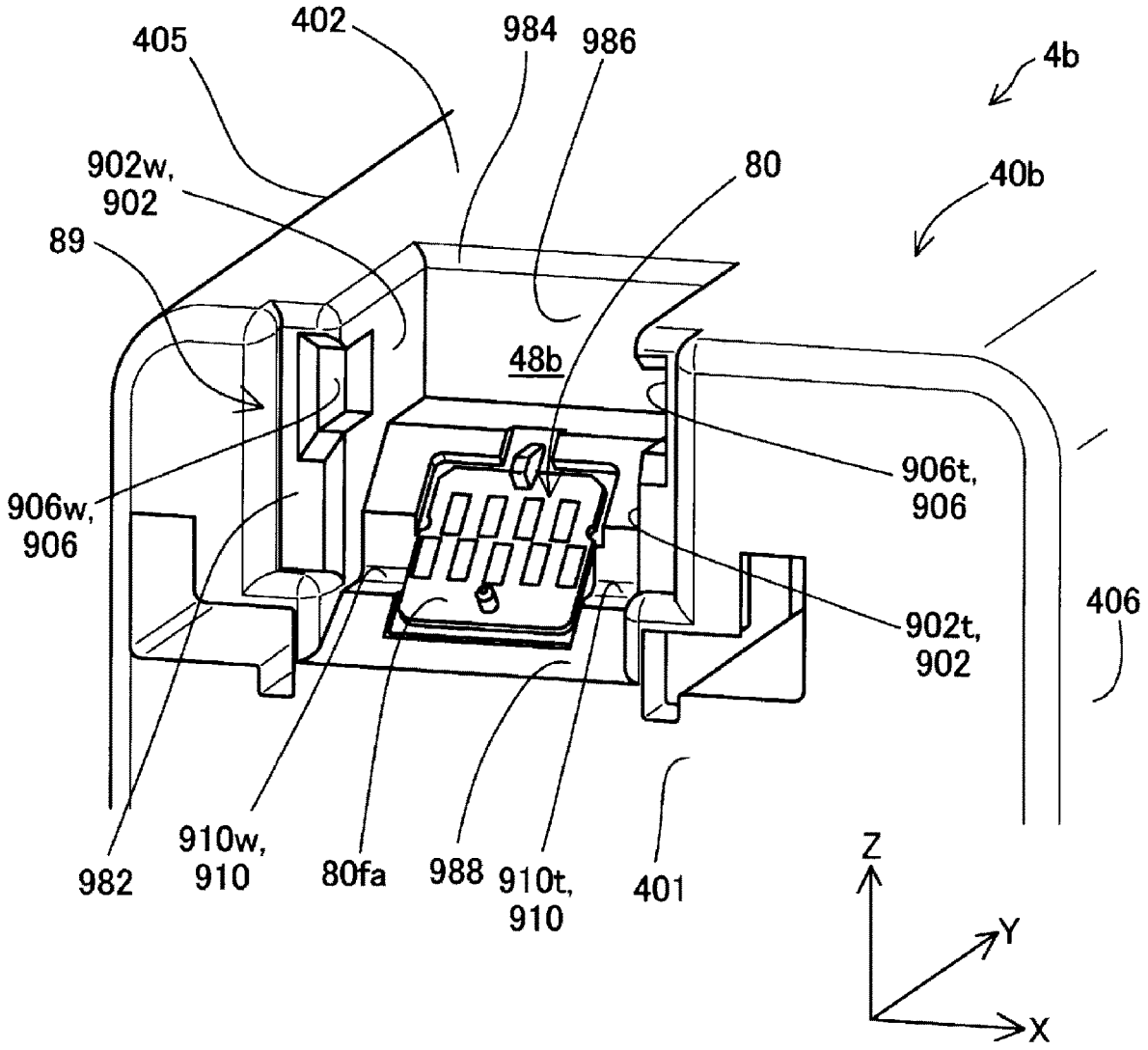
FIG. 14 is a first view for describing another Embodiment 2.
Figure 15:
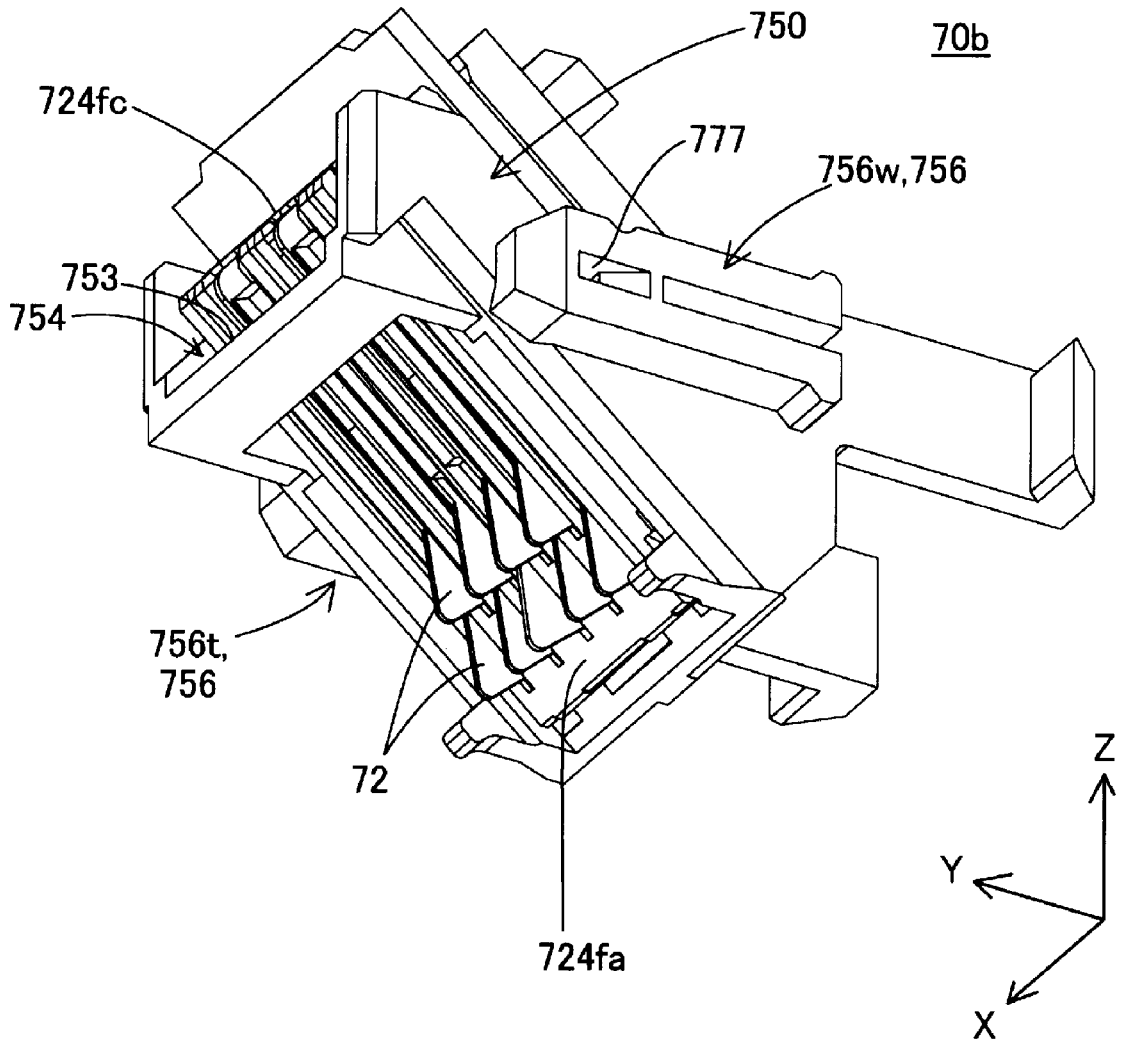
FIG. 15 is a second view for describing another Embodiment 2.

FIG. 14 is a first view for describing another Embodiment 2. FIG. 15 is a second view for describing another Embodiment 2. Since the difference between the cartridge 4*b* of another Embodiment 2 and the cartridge 4 of the above-described first embodiment is mainly the configuration of the corner 48*b*, and the other configuration is the same as that of the first embodiment, the same configurations will be given the same reference numerals and the description thereof will be omitted.

The corner 48*a* (FIG. 14) has a recessed shape recessed inward of the case 40*a*. The corner 48*a* has an opening 982 positioned on the −Y axis direction side and an opening 984 positioned on the +Z axis direction side. The inner wall of the corner 48*b* is generally configured with a pair of side walls 902 (902*t* and 902*w*), a bottom surface 988, and a back wall 986 with respect to the X axis direction. The walls 902, 986, and 988 define a terminal storage chamber into which the apparatus-side terminal portion 70*b* (FIG. 15) is inserted. The opening 982 serves as an entrance when the apparatus-side terminal portion 70*b* is inserted into the corner 48*b* when the cartridge 4*b* is mounted on the mounting section 6. In addition, when the first side wall 902*t* and the second side wall 902*w* are used without distinction, the side wall 902 is used.

The circuit substrate 80 is attached to the bottom surface 988. Specifically, similar to the first embodiment, the surface 80*fa* of the circuit substrate 80 is disposed so as to be inclined in a direction including the −Y axis direction component and the +Z axis direction component.

Each of a pair of contact regulating sections 906*t* and 906*w* is provided on a pair of side walls 902*t* and 902*w* that oppose each other in the X axis direction of the corner 48*b*. The first contact regulating section 906*t* is formed in a shape such that a part of the first side wall 902*t* is dug down in the +X axis direction. In other words, the first contact regulating section 906*t* is sunk in the +X axis direction from the first side wall 902*t*. The first contact regulating section 906*t* extends along the Y axis direction. Specifically, the first contact regulating section 906*t* extends from the position of the opening 982 toward the back wall 986 side along the +Y axis direction. A first apparatus-side regulating section 756*t* (FIG. 16) is inserted into the first contact regulating section 906*t* in the mounted state. The first contact regulating section 906*t* has an open end surface on the −Y axis direction side and an open surface on the −X axis direction side.

The second side wall 902*w* is provided with the second contact regulating section 906*w*. The second contact regulating section 906*w* is formed in a shape such that a part of the second side wall 902*w* is dug down in the −X axis direction. In other words, the second contact regulating section 906*w* is sunk in the −X axis direction from the second side wall 902*w*. The second contact regulating section 906*w* extends along the Y axis direction. Specifically, the second contact regulating section 906*w* extends from the position of the opening 982 toward the rear wall 906 side along the +Y axis direction. A second apparatus-side regulating section 756*w* (FIG. 16) is inserted into the second contact regulating section 906*w* in the mounted state. The second contact regulating section 906*w* has an open end surface on the −Y axis direction side and an open surface on the +X axis direction side.

The apparatus-side terminal portion 70*b* (FIG. 15) includes a plurality of (nine in the present embodiment) apparatus-side terminals 72 and a terminal holder 750. The terminal holder 750 holds the plurality of apparatus-side terminals 72. The terminal holder 750 has apparatus-side regulating sections 756 on both sides in the X axis direction. When the two apparatus-side regulating sections 756 are used in distinction, the apparatus-side regulating sections are also referred to as the first apparatus-side regulating section 756*t* and the second apparatus-side regulating section 756*w*. The first apparatus-side regulating section 756*t* and the second apparatus-side regulating section 756*w* are disposed so as to sandwich the apparatus-side terminal 72 in the X axis direction. The apparatus-side regulating section 756 is a column-like member that extends along the Y axis direction.

Before contact between the apparatus-side terminal 72 and the cartridge-side terminal 830 is started, the first apparatus-side regulating section 756*t* starts to be inserted into the first contact regulating section 906*t*, and the second apparatus-side regulating section 756*w* starts to be inserted into the second contact regulating section 906*w*. Accordingly, the movement of the contact portion cp in the direction orthogonal to the mounting direction with respect to the apparatus-side terminal 72 is regulated, and the positioning of the contact portion cp and the apparatus-side terminal 72 is performed. Therefore, it is possible to excellently achieve the contact between the contact portion cp and the apparatus-side terminal 72.

Figure 16:
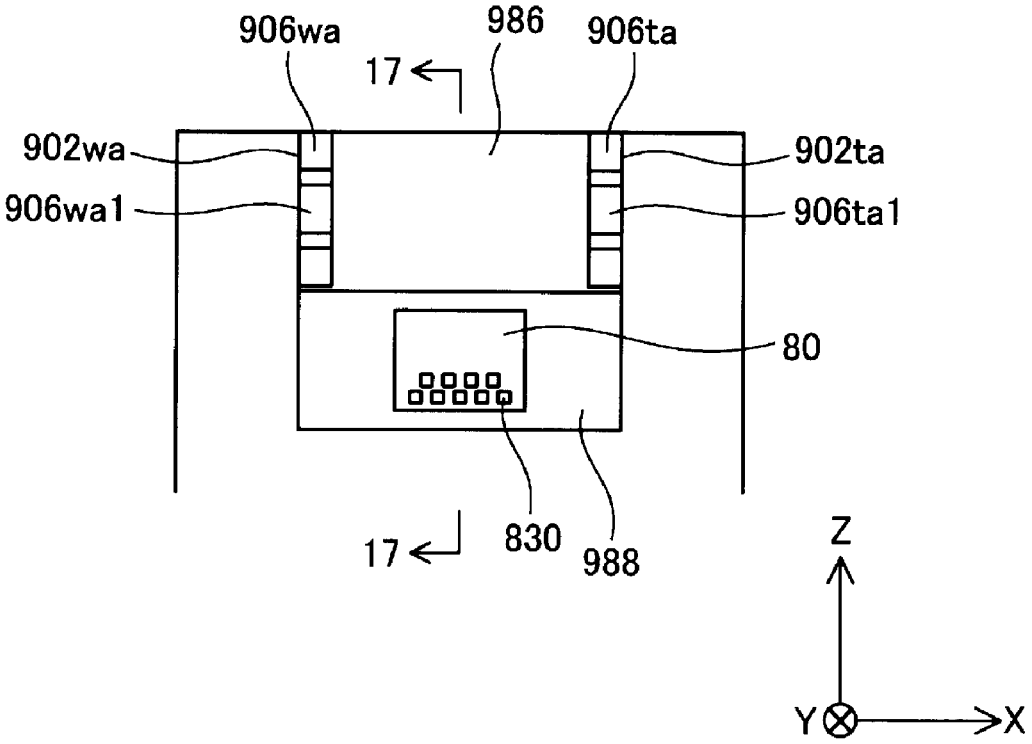
FIG. 16 is a front view of a first modification.
Figure 17:
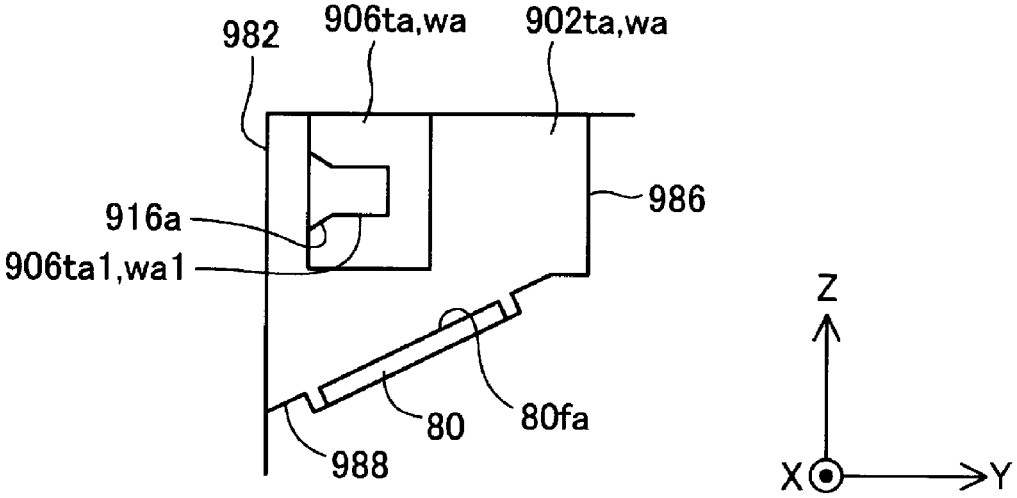
FIG. 17 is a sectional view taken along line 17-17 of FIG. 16.
Figure 18:
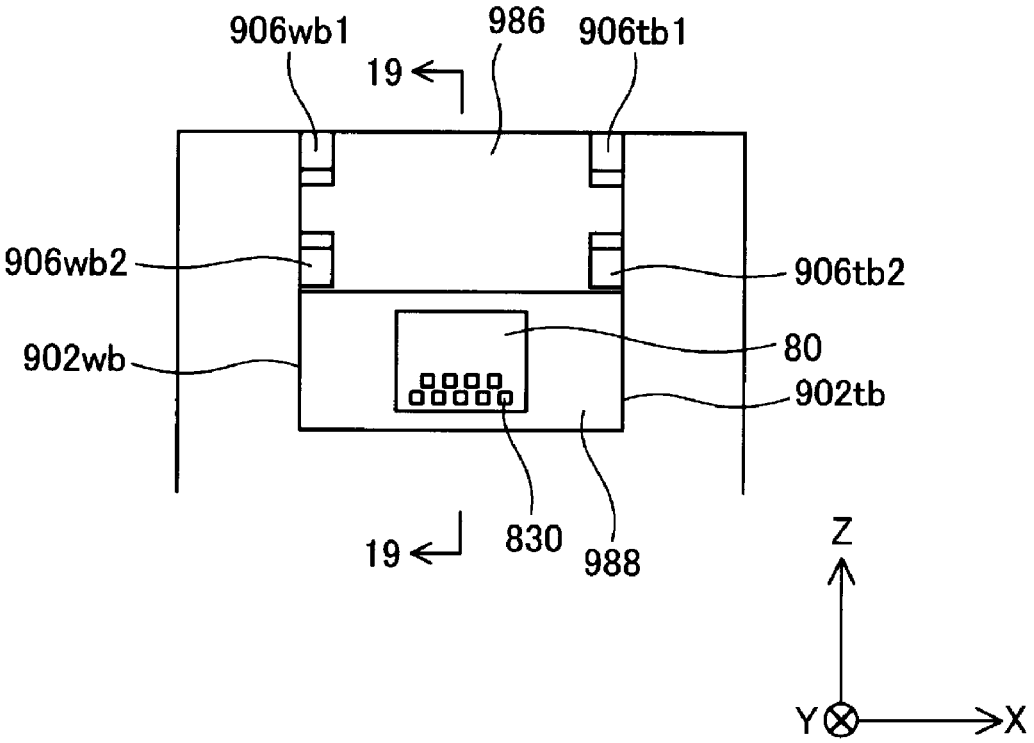
FIG. 18 is a front view of a second modification.
Figure 19:
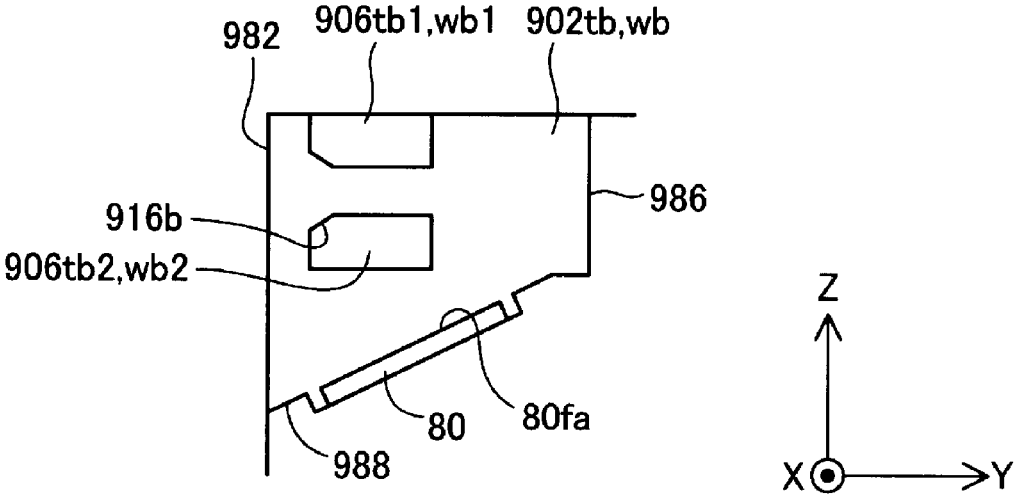
FIG. 19 is a sectional view taken along line 19-19 of FIG. 18.
Figure 20:
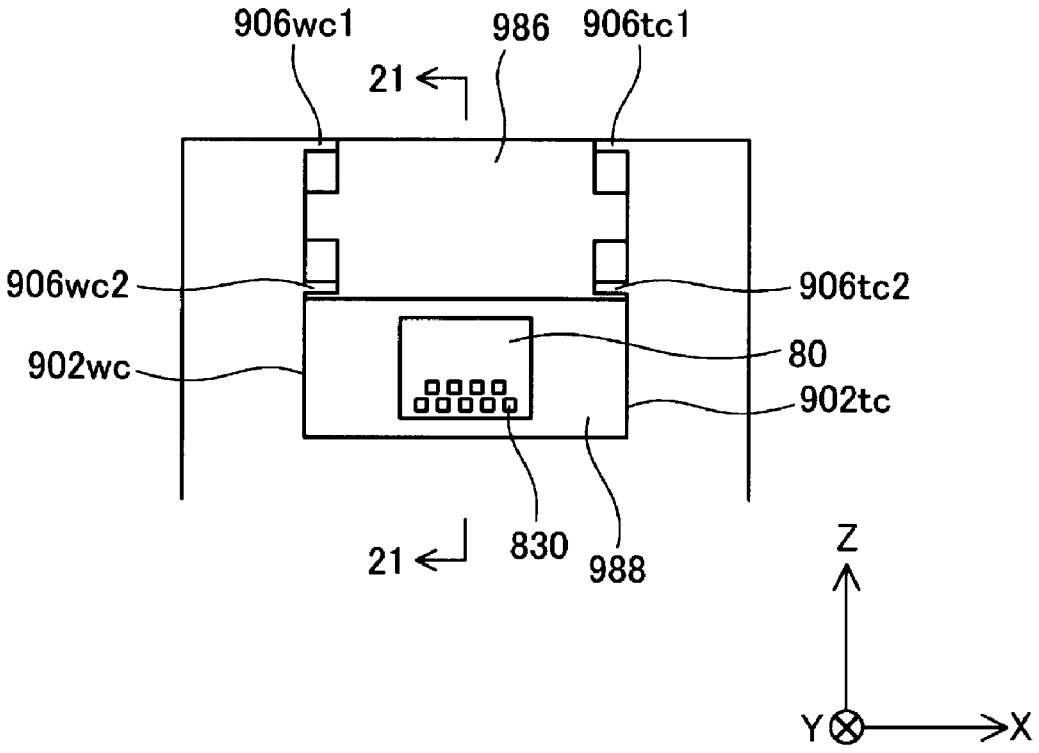
FIG. 20 is a front view of a third modification.
Figure 21:
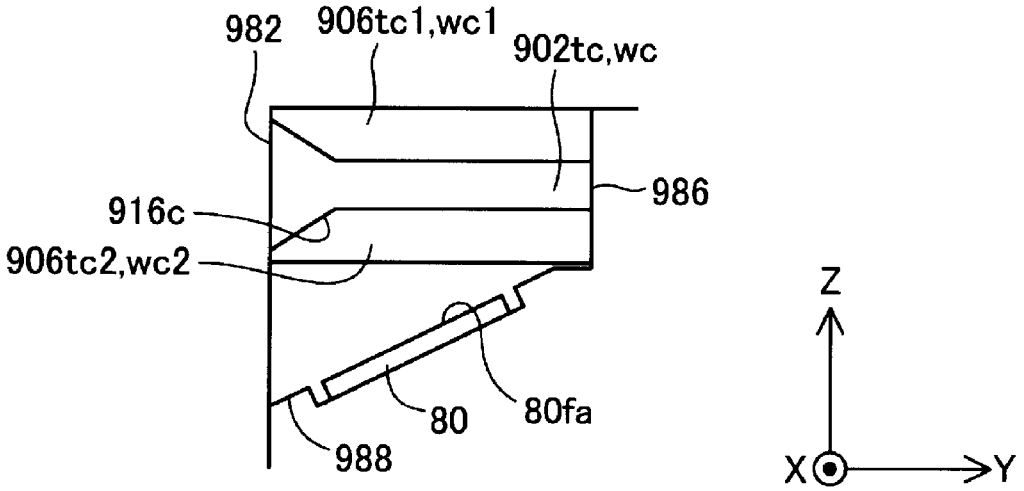
FIG. 21 is a sectional view taken along line 21-21 of FIG. 20.
Figure 22:
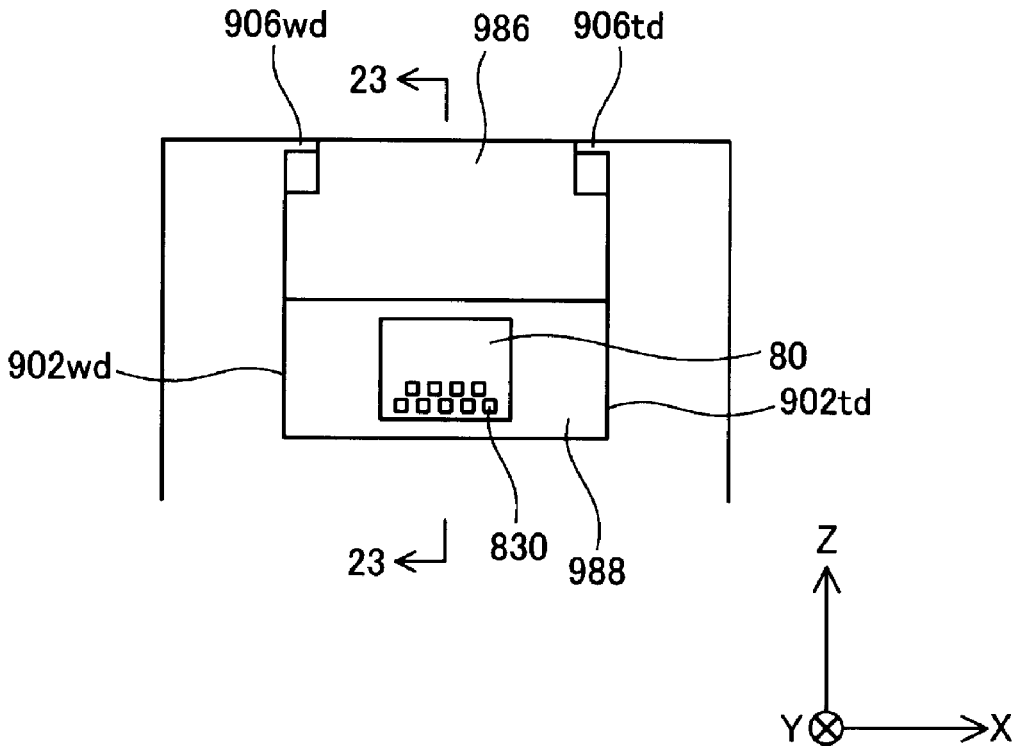
FIG. 22 is a front view of a fourth modification.
Figure 23:
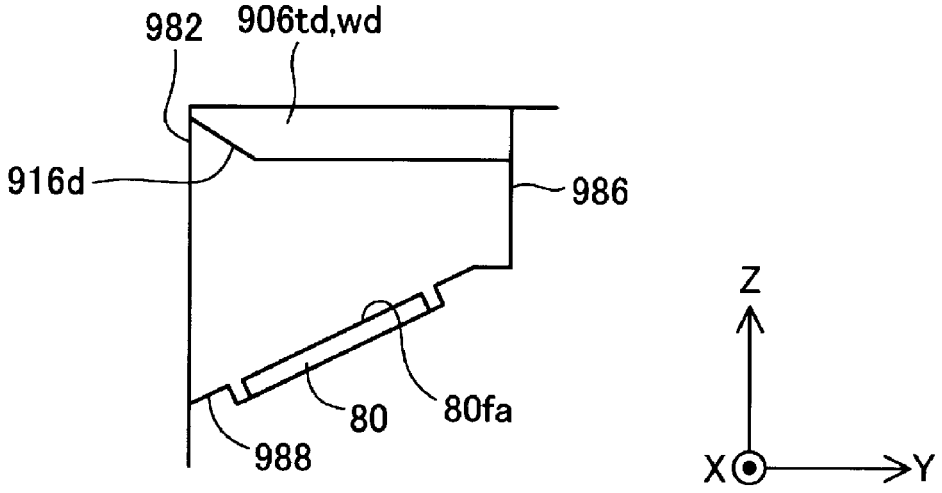
FIG. 23 is a sectional view taken along line 23-23 of FIG. 22.
Figure 24:
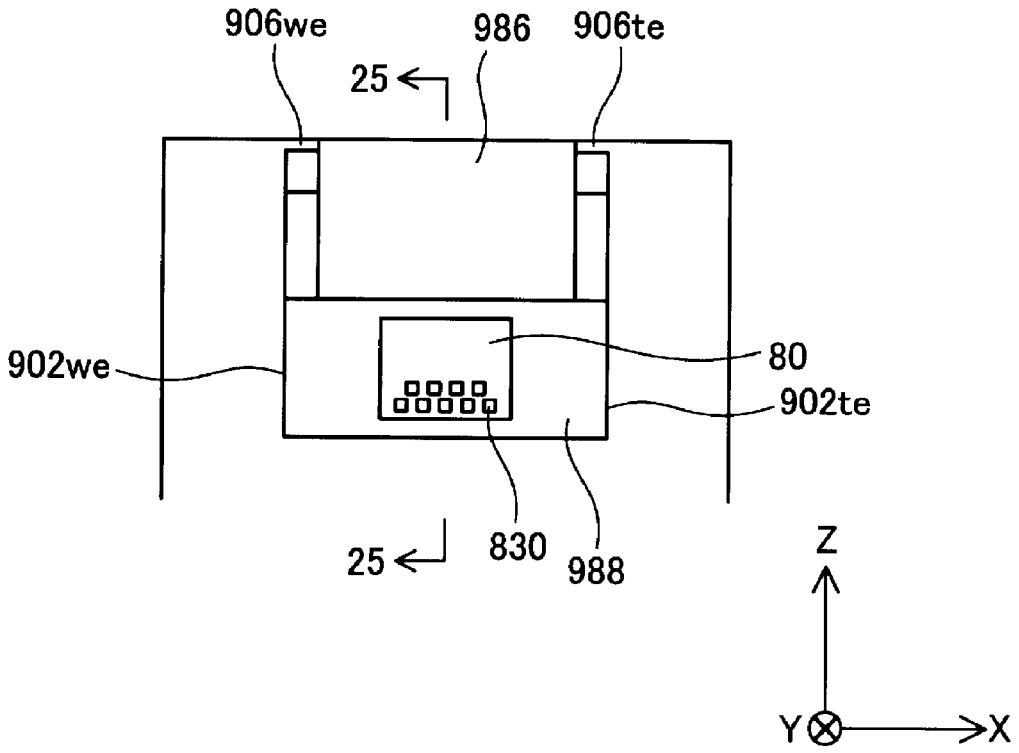
FIG. 24 is a front view of a fifth modification.
Figure 25:
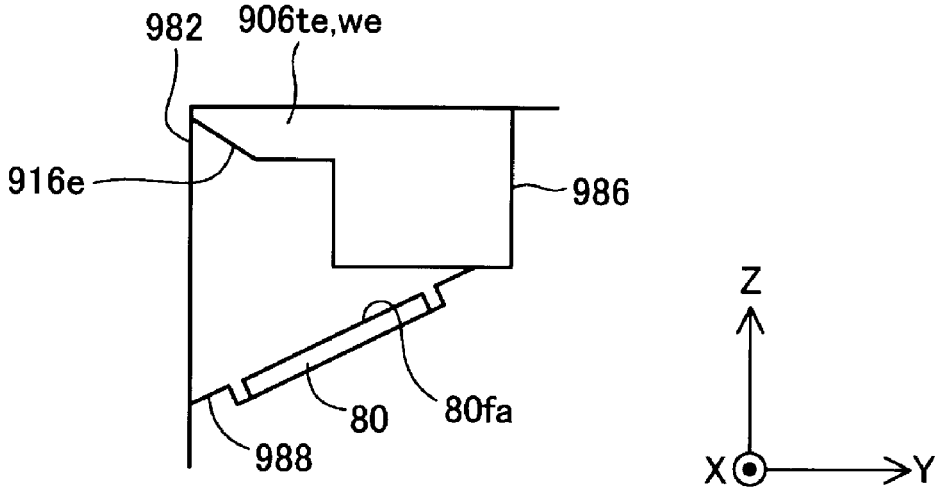
FIG. 25 is a sectional view taken along the line 25-25 in FIG. 24.
Figure 26:
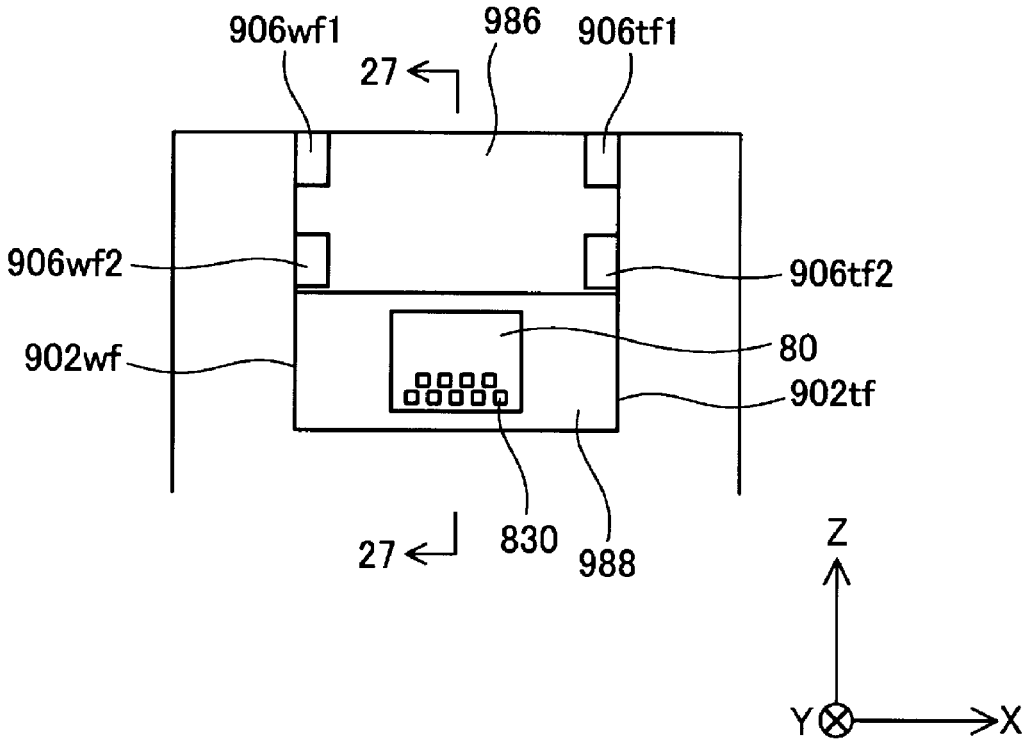
FIG. 26 is a front view of a sixth modification.
Figure 27:
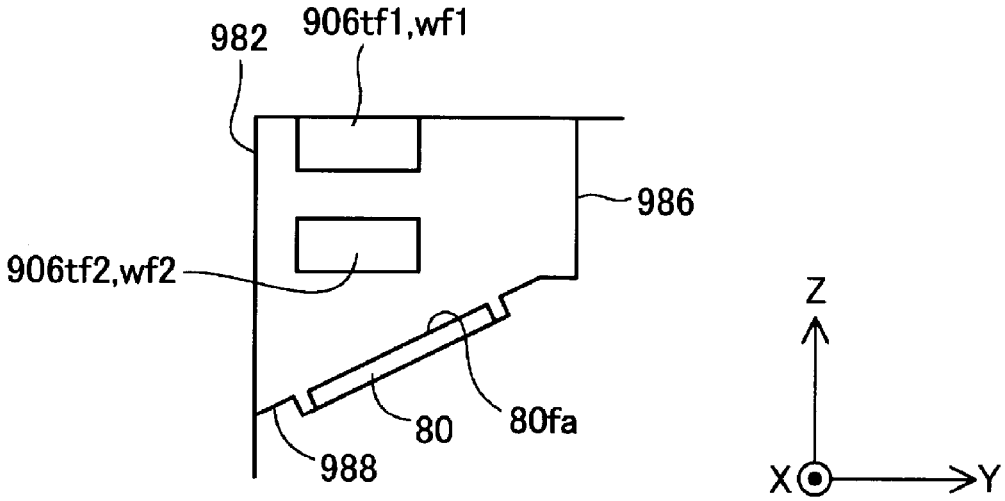
FIG. 27 is a sectional view taken along line 26-26 of FIG. 26.
Figure 28:
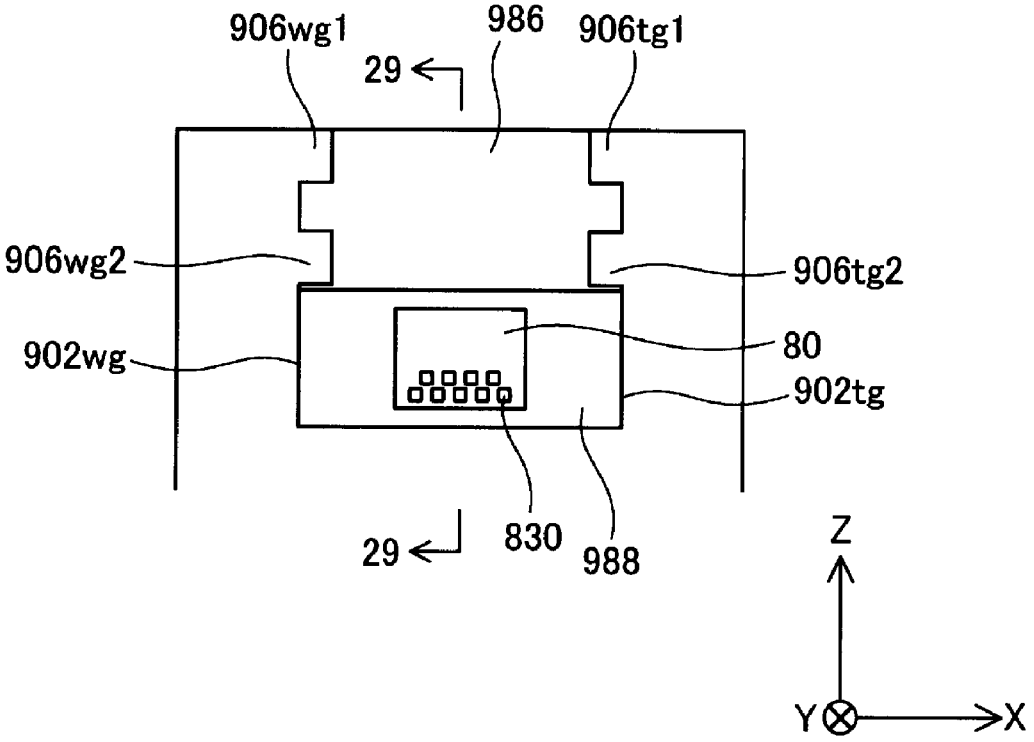
FIG. 28 is a front view of a seventh modification.
Figure 29:
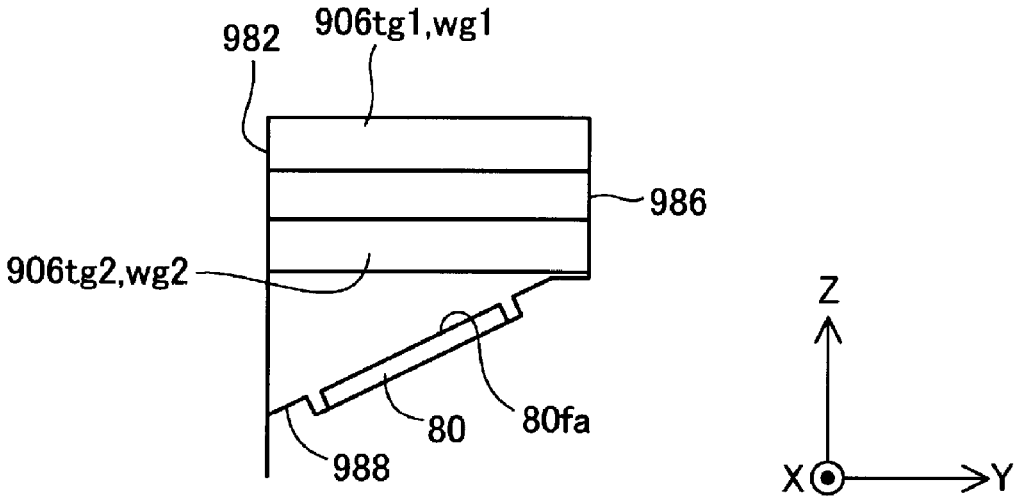
FIG. 29 is a sectional view taken along the line 29-29 in FIG. 28.
Figure 30:
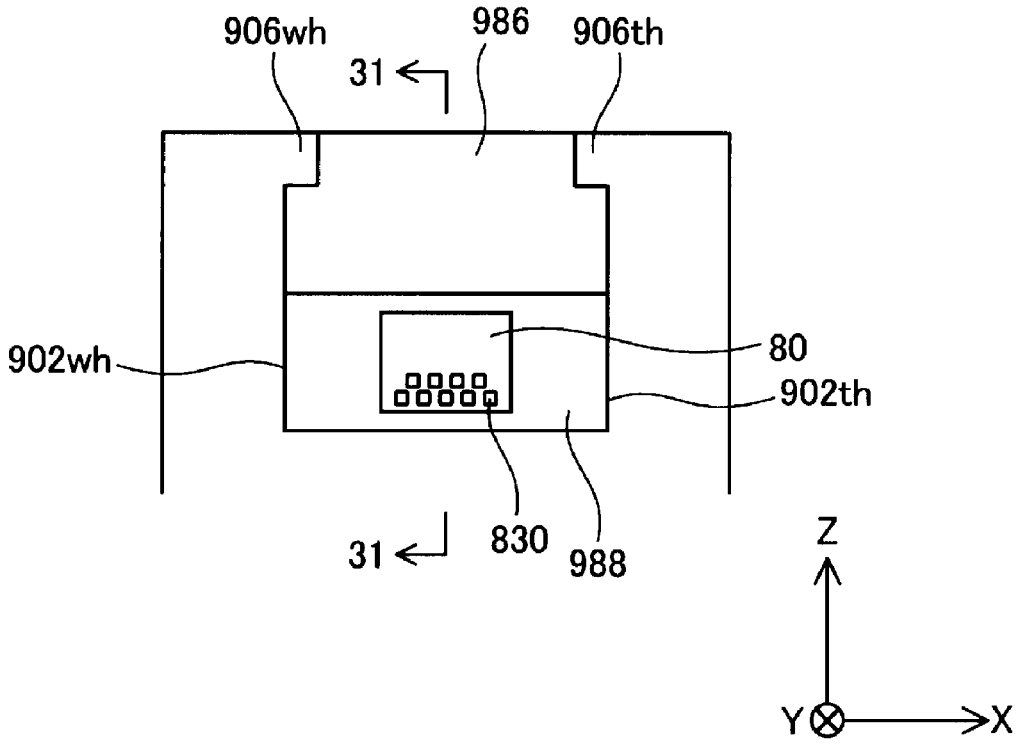
FIG. 30 is a front view of an eighth modification.
Figure 31:
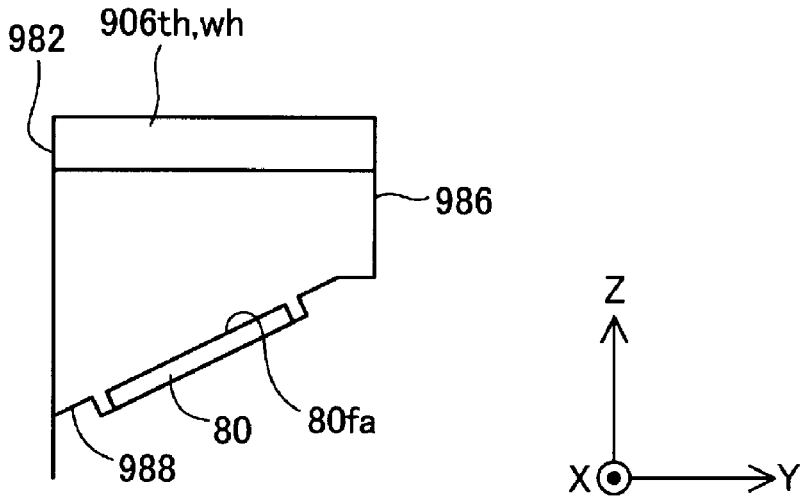
FIG. 31 is a sectional view taken along line 31-31 of FIG. 30.
Figure 32:
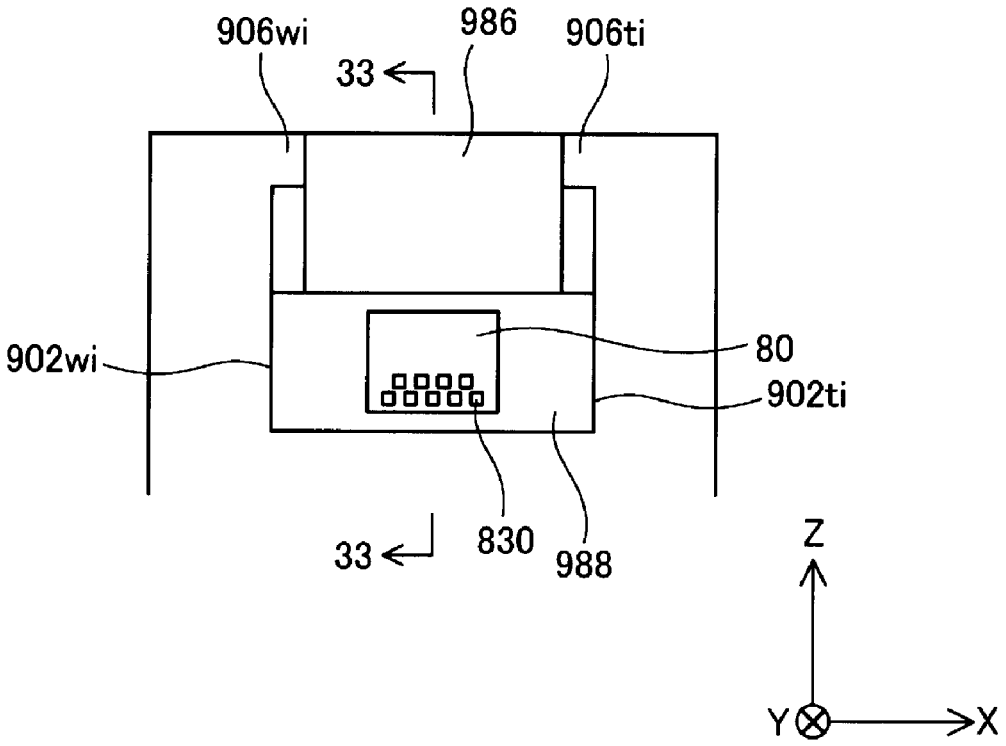
FIG. 32 is a front view of a ninth modification.
Figure 33:
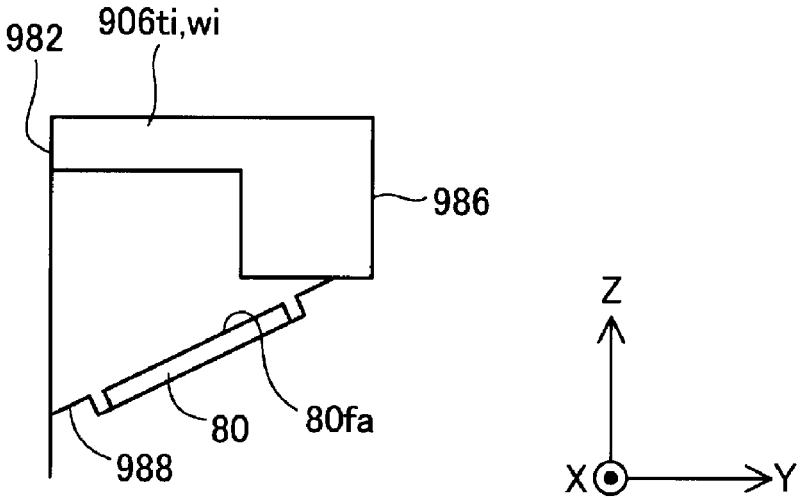
FIG. 33 is a sectional view taken along line 33-33 of FIG. 32.

FIGS. 16 to 33 are schematic diagrams for describing various other embodiments of the contact regulating section 906 provided in the corner 48*b* (FIG. 14). FIG. 16 is a front view of a first modification. FIG. 17 is a sectional view taken along line 17-17 of FIG. 16. FIG. 18 is a front view of a second modification. FIG. 19 is a sectional view taken along line 19-19 of FIG. 18. FIG. 20 is a front view of a third modification. FIG. 21 is a sectional view taken along line 21-21 of FIG. 20. FIG. 22 is a front view of a fourth modification. FIG. 23 is a sectional view taken along line 23-23 of FIG. 22. FIG. 24 is a front view of a fifth modification. FIG. 25 is a sectional view taken along line 25-25 of FIG. 24. FIG. 26 is a front view of a sixth modification. FIG. 27 is a sectional view taken along line 26-26 of FIG. 26. FIG. 28 is a front view of a seventh modification. FIG. 29 is a sectional view taken along line 29-29 of FIG. 28. FIG. 30 is a front view of an eighth modification. FIG. 31 is a sectional view taken along line 31-31 of FIG. 30. FIG. 32 is a front view of a ninth modification. FIG. 33 is a sectional view taken along line 33-33 of FIG. 32. In FIGS. 16 to 33, front views schematically illustrate the corner 48*b* and the vicinity thereof, and sectional views schematically illustrate sections of the corner 48*b* and the vicinity thereof. In all of the other embodiments of FIGS. 16 to 33, the configuration other than the configuration of the regulating section into which the apparatus-side regulating section 756 (FIG. 15) is inserted is the same as that of another Embodiment 2. In addition, in FIGS. 16 to 33, the same configurations as those of another Embodiment 2 will be given the same reference numerals and the description thereof will be omitted. The configuration of the printer 10 is the same as that of the first embodiment. Since the first and second contact regulating sections have the same shape, in the sectional views of FIGS. 16 to 33, a reference numeral that indicates the second contact regulating section is also written in addition to the reference numeral indicating the first contact regulating section for making it easy to understand.

In any other modifications in FIGS. 16 to 33, a projected portion that protrudes from the first side wall of the corner 48*b* in the −X axis direction and a projected portion that protrudes from the second side wall in the +X axis direction are provided, and the first and second contact regulating sections are configured with the projected portions. The projected portions may be provided separately from the first and second side walls of the corner 48*b*, or may be provided integrally.

In the modifications illustrated in FIGS. 16 and 17, first and second contact regulating sections 906*ta*1 and 906*wa*1 having shapes similar to those of another Embodiment 2 are formed by the projected portions 906*ta* and 906*wa* and side walls 902*ta* and 902*wa*, and the first and second apparatus-side regulating sections 756*t* and 756*w* of the apparatus-side terminal portion 70*b* are inserted into first and second contact regulating sections 906*ta*1 and 906*wa*1. Entrance parts 916*a* of the first and second contact regulating sections 906*ta*1 and 906*wa*1 are tapered only in the Z axis direction. The regulation of the movement in the ±Z axis direction of the first and second apparatus-side regulating sections 756*t* and 756*w* of the apparatus-side terminal portion 70*b* is performed on the surface on the +Z axis direction side and the surface on the −X axis direction side of the first and second contact regulating sections 906*ta*1 and wa1, and the regulation of the movement in the +Y axis direction is performed on the surface on the +Y axis direction side of the first and second contact regulating sections 906*ta*1 and 906*wa*1. The regulation of the movement in the ±X axis direction is performed on the surface formed by the side walls 902*ta* and 902*wa*.

The modifications illustrated in FIGS. 18 and 19 include: a pair of projected portions 906*tb*1 and 906*tb*2 that protrudes from a first side wall 902*tb* of the corner 48*b* in the −X axis direction as the contact regulating sections; and a pair of projected portions 906*wb*1 and 906*wb*2 that protrudes from a second side wall 902*wb* in the +X axis direction as the contact regulating sections. The projected portions 906*tb*1, 906*tb*2, 906*wb*1, and 906*wb*2 correspond to those in which the surface on the +Y axis direction side is omitted from the contact regulating sections 906*ta*1 and 906*wa*1 of the other embodiments illustrated in FIGS. 16 and 17. The regulation of the movement in the +Z direction of the apparatus-side regulating sections 756*t* and 756*w* of the apparatus-side terminal portion 70*b* is performed by the projected portions 906*tb*1 and 906*wb*1. The regulation of the movement in the −Z direction of the apparatus-side regulating sections 756*t* and 756*w* of the apparatus-side terminal portion 70*b* is performed by the projected portions 906*tb*2 and 906*wb*2. The regulation of the movement in the ±X axis direction is performed by the side walls 902*tb* and 902*wb*.

The modifications illustrated in FIGS. 20 and 21 include: a pair of projected portions 906*tc*1 and 906*tc*2 that protrudes from a first side wall 902*tc* of the corner 48*b* in the −X axis direction as the contact regulating sections; and a pair of projected portions 906*wc*1 and 906*wc*2 that protrudes from a second side wall 902*wc* in the +X axis direction as the contact regulating sections. The other embodiment is different from the modifications illustrated in FIGS. 18 and 19 in that the opening ends in the −Y axis direction of the projected portions 906*tc*1, 906*tc*2, 906*wc*1, and 906*wc*2 are aligned with the position of the opening 982 of the corner 48*b*, and that the end portion in the +Y axis direction extends to the position of the back wall 986 of the corner 48*b*, but other points are common to the modifications illustrated in FIGS. 18 and 19.

The modifications illustrated in FIGS. 22 and 23 include: a projected portion 906*td* that protrudes from a first side wall 902*td* of the corner 48*b* in the −X axis direction as the contact regulating section; and a projected portions 906*wd* that protrudes from a second side wall 902*wd* in the +X axis direction as the contact regulating section. The modification is obtained by eliminating the projected portions 906*tc*2 and 906*wc*2 that regulate the movement in the −Z axis direction in the apparatus-side regulating sections 756*t* and 756*w* of the apparatus-side terminal portion 70*b*, from the modifications illustrated in FIGS. 20 and 21. The regulation of the movement in the +Z direction of the apparatus-side regulating sections 756*t* and 756*w* of the apparatus-side terminal portion 70*b* can be performed by the projected portions 906*td* and 906*wd*. Since the movement in the −Z axis direction is regulated by the contact between the apparatus-side terminal 72 and the cartridge-side terminal 830, the function of regulating the movement in the −Z axis direction can be omitted. In addition, the regulation in the ±X axis direction is performed by the side walls 902*td* and 902*wd*.

The modifications illustrated in FIGS. 24 and 25 include: a projected portion 906*te* that protrudes from a first side wall 902*te* of the corner 48*b* in the −X axis direction as the contact regulating section; and a projected portion 906*we* that protrudes from a second side wall 902*we* in the +X axis direction as the contact regulating section. The modifications are obtained by adding a surface for regulating the movement of the apparatus-side regulating sections 756*t* and 756*w* of the apparatus-side terminal portion 70*b* in the +Y axis direction to the projected portions 906*td* and 906*wd* of the modifications illustrated in FIGS. 22 and 23. The other points are common to the modifications illustrated in FIGS. 22 and 23.

The modifications of FIGS. 26 to 33 are obtained by omitting the tapered entrance parts 916*b* to 916*e* from the modifications illustrated in FIGS. 16 to 25, respectively.

According to the modifications in FIGS. 16 to 33, similar to another Embodiment 2 (FIGS. 14 and 15), by performing the positioning between the contact portion cp and the apparatus-side terminal 72, it is possible to excellently achieve the contact between contact portion cp and the apparatus-side terminal 72. However, it is needless to say that, the effect by regulating the movement in the −Z direction cannot be obtained in the modification having no function of regulating the movement of the positioning sections 756*t* and 756*w* of the apparatus-side terminal portion 70*b* in the −Z axis direction, and the effect by regulating the movement in the +Y direction cannot obtained in the modification having no function of regulating the movement in the +Y direction. Further, according to the modifications described in the above-described FIGS. 16 to 33, the first contact regulating section and the second contact regulating section can be easily formed by providing the projected portions that protrude in the X axis direction to the first side wall and the second side wall, respectively.

B-3. Another Embodiment 3

Figure 34:
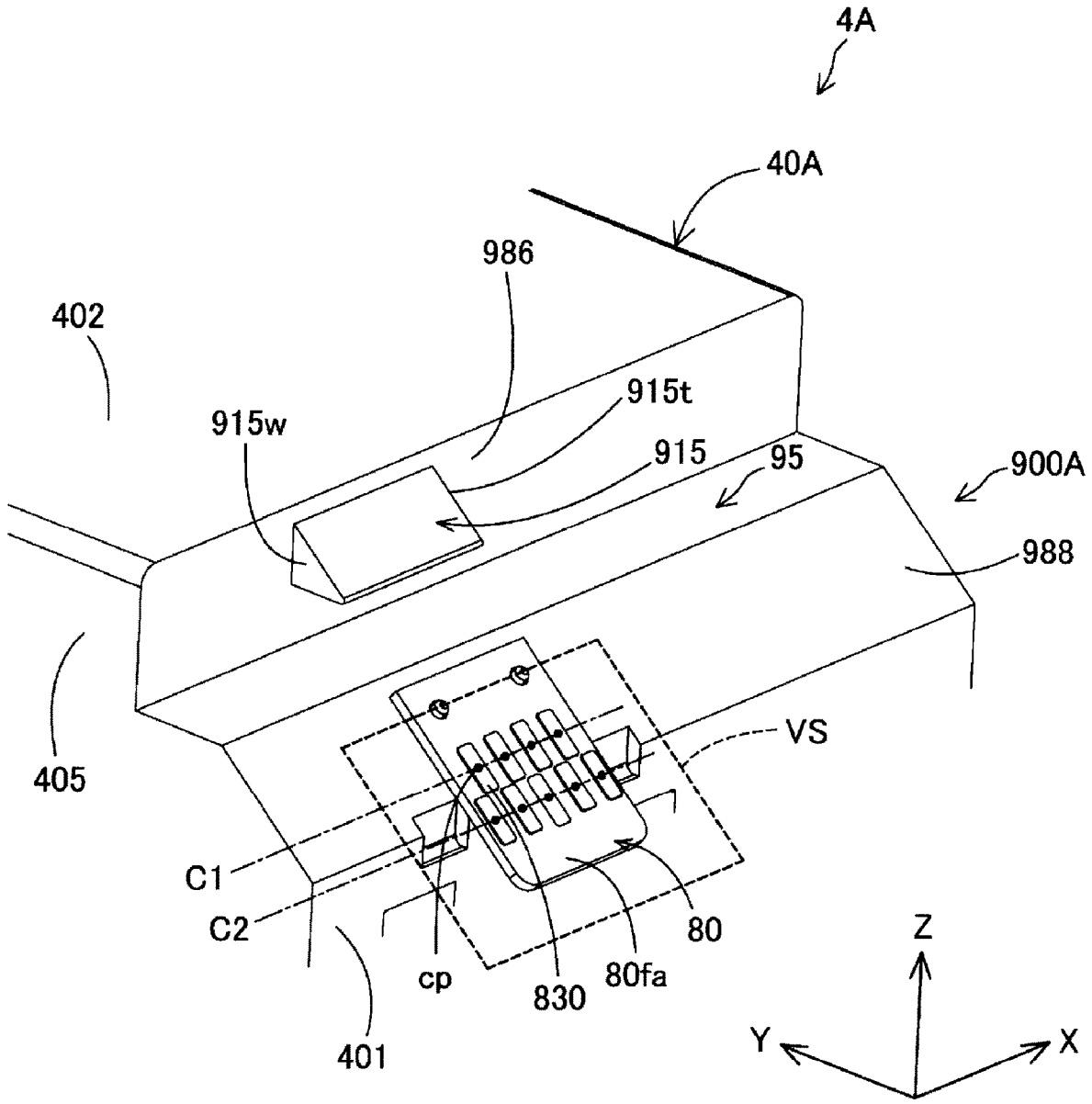
FIG. 34 is an external perspective view in the vicinity of a corner.

A cartridge 4A of another Embodiment 3 illustrated in FIG. 34 differs from the cartridge 4 of the first embodiment in the configuration of a corner 900A of the cartridge 4A, but is otherwise the same. In another Embodiment 3, the same configurations as those in the first embodiment will be given the same reference numerals and the description thereof will be omitted. The configuration of the printer 10 is the same as that of the first embodiment.

Figure 35:
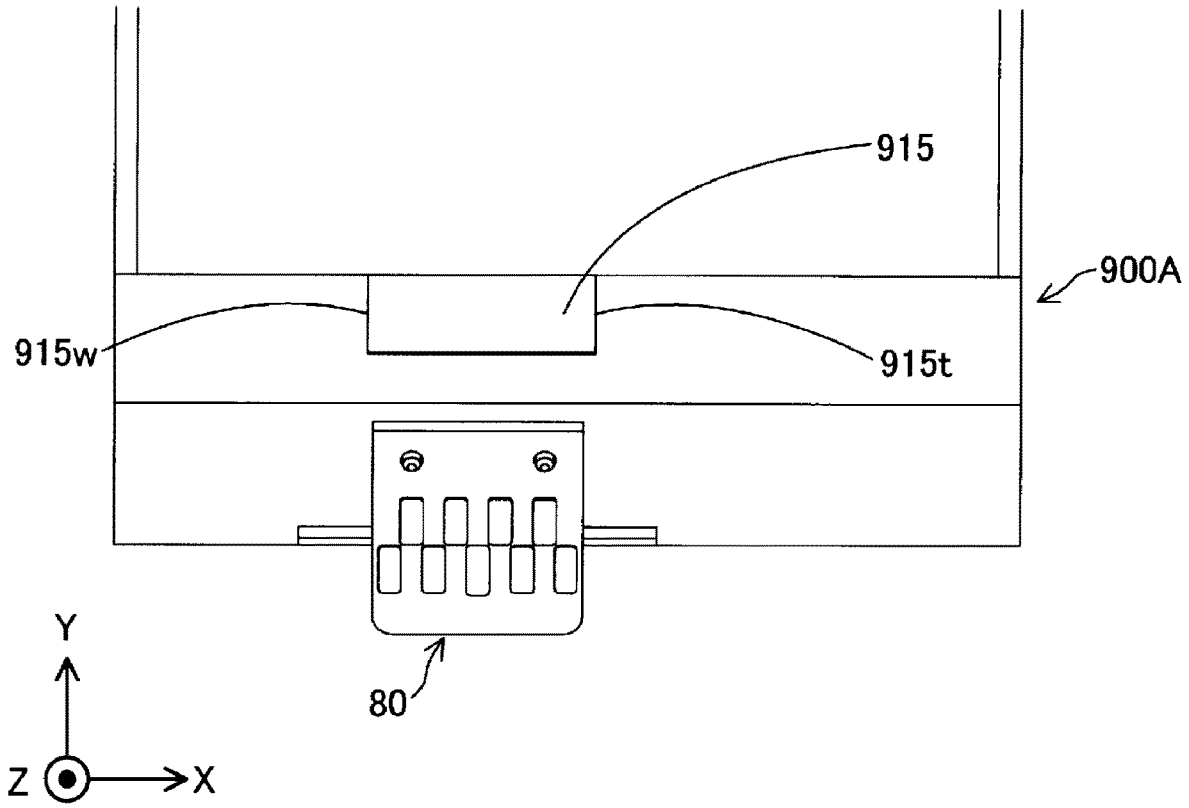
FIG. 35 is a view of the vicinity of the corner when viewed from a +Z axis direction side.
Figure 36:
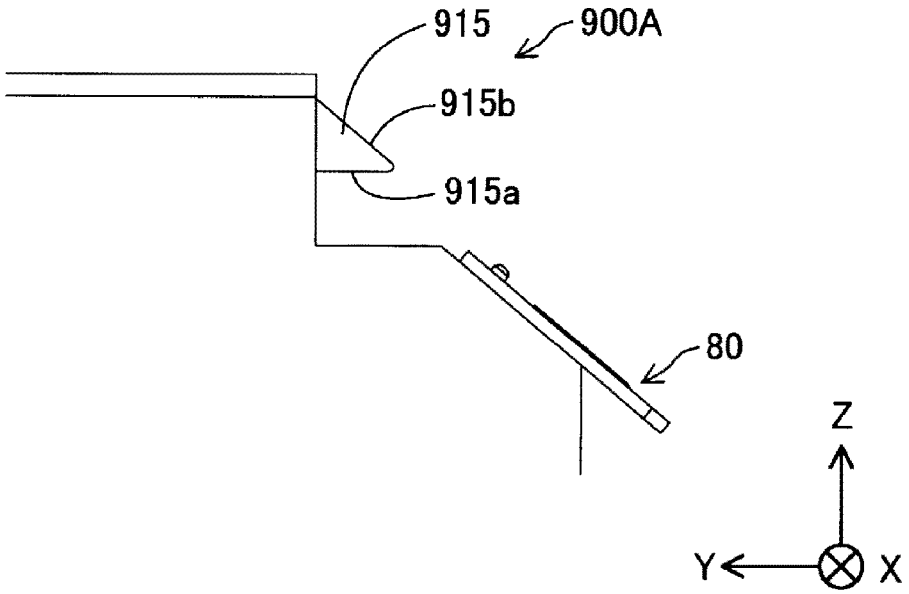
FIG. 36 is a view of the vicinity of the corner when viewed from a −X axis direction side.
Figure 37:
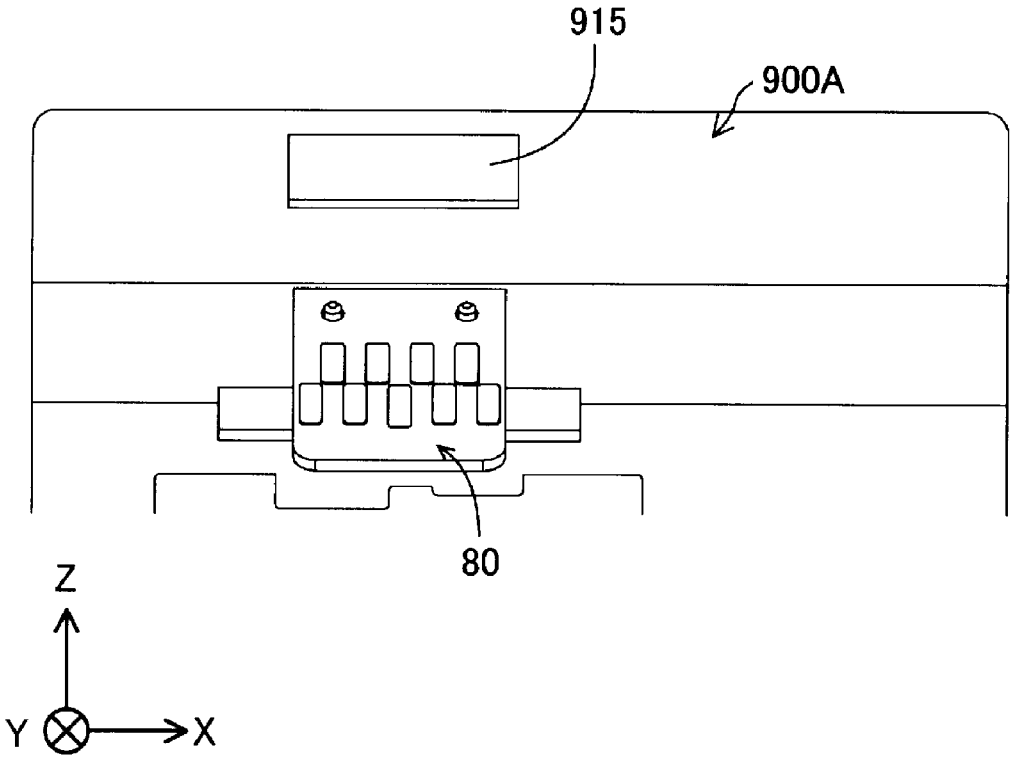
FIG. 37 is a front view in the vicinity of the corner.

FIG. 34 is an external perspective view in the vicinity of the corner 900A. FIG. 35 is a view of the vicinity of the corner 900A viewed from the +Z axis direction side. FIG. 36 is a view of the vicinity of the corner 900A viewed from the −X axis direction side. FIG. 37 is a front view in the vicinity of the corner 900A.

As illustrated in FIG. 34, similar to the corner 48 (FIG. 4) of the first embodiment, the corner 900A is formed at the corner where the front surface 401 and the top surface 402 intersect each other, and has a recessed shape recessed inward of the case 40A. The corner 900A is configured with the bottom surface 988 and the back surface 986 as main surfaces. The bottom surface 988 is a surface coupled to the front surface 401. The back surface 986 is a surface coupled to the top surface 402. The circuit substrate 80 is provided at the corner 900A. The back surface 986 and the bottom surface 988 which are the surfaces that configure the corner 900A are also called a support section since the surfaces support the circuit substrate 80.

In the present embodiment, the corner 900A has a projected portion 915. The projected portion 915 is provided on the back surface 986 that configures the support section, and protrudes in a direction away from the back surface 986 (−Y axis direction). In other words, the projected portion 915 protrudes forward (−Y axis direction) in the mounting direction from the back surface 986 that configures the support section. The projected portion 915 has such a shape in which the dimension in the Z axis direction decreases from the +Y axis direction to the −Y axis direction. As illustrated in FIG. 36, a lower portion 915*a*, which is a part on the −Z axis direction side of the projected portion 915, is parallel to the X axis direction and the Y axis direction. Meanwhile, an upper portion 915*b* which is a part on the +Z axis direction side of the projected portion 915 is inclined with respect to a plane parallel to the X axis direction and the Y axis direction. In other words, the upper portion 915*b* of the projected portion 915 is inclined with respect to the mounting direction (−Y axis direction). A part including the circuit substrate 80 and the projected portion 915 is also called a terminal coupling portion 95. The terminal coupling portion 95 is a part that can be mounted on the printer 10. In other words, the terminal coupling portion 95 is a part or unit provided for coupling the printer 10 to the apparatus-side terminal portion 70.

In the mounted state of the cartridge 4A, the projected portion 915 is engaged with a positioning recessed portion 754 of the apparatus-side terminal portion 70*b* illustrated in FIG. 15. The positioning recessed portion 754 is positioned in a space portion between the terminal holder 750 and the part where the apparatus-side terminals 72 are disposed. The positioning recessed portion 754 is open on the +Y axis direction side, and both side surfaces in the X axis direction and the surface on the −Z axis direction side are formed by the terminal holder 750.

Figure 38:
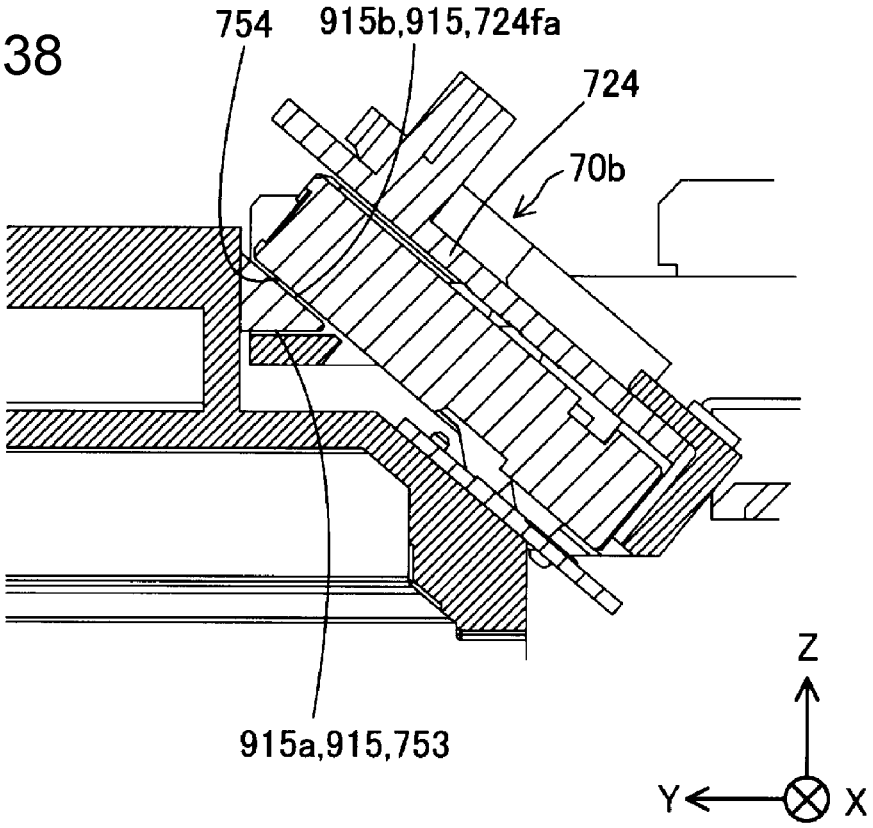
FIG. 38 is a sectional view illustrating a state where a projected portion and a positioning recessed portion are engaged with each other.

FIG. 38 is a sectional view illustrating a state where the projected portion 915 of the cartridge 4A and the positioning recessed portion 754 of the printer 10 are engaged with each other. As illustrated in FIG. 38, in this state, the lower portion 915*a* of the projected portion 915 is in contact with a surface 753 on the −Z axis direction side among the surfaces that define the positioning recessed portion 754.

Figure 39:
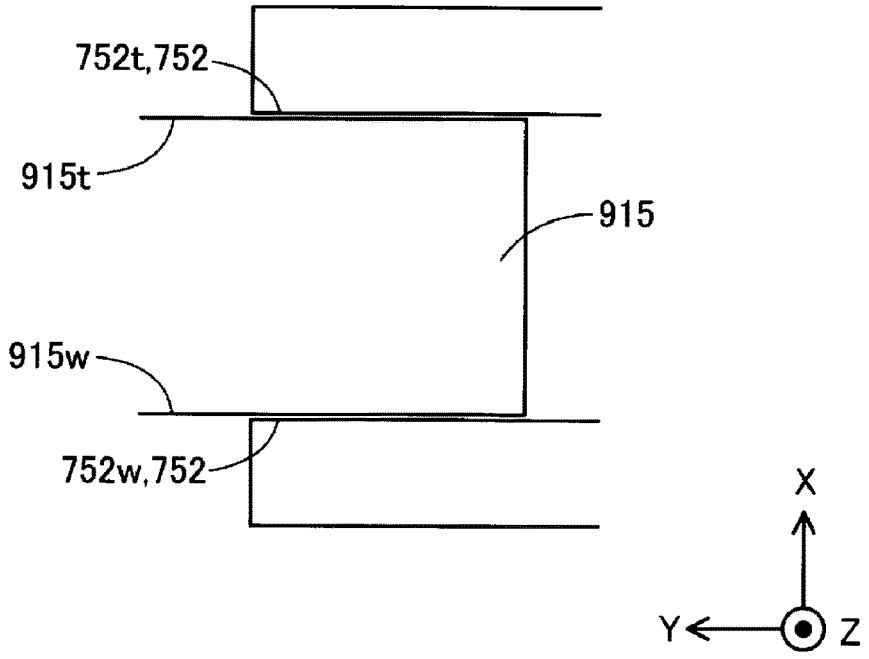
FIG. 39 is a view illustrating a state where the projected portion and the positioning recessed portion are engaged with each other.

FIG. 39 is a view illustrating a state where the projected portion 915 of the cartridge 4A and the positioning recessed portion 754 of the printer 10 are engaged with each other. As illustrated in FIG. 39, in this state, a first side portion 915*t*, which is a part on the +X axis direction side of the projected portion 915, is in contact with the first wall portion 752*t* positioned on the +X axis direction side on the surface (wall portion) that defines the positioning recessed portion 754. In addition, a second side portion 915*w*, which is a part on the −X axis direction side of the projected portion 915, is in contact with the second wall portion 752*w* positioned on the −X axis direction side on the surface (wall portion) that defines the positioning recessed portion 754. In other words, the side portions 915*t* and 915*w* on both sides in the X axis direction of the projected portion 915 are in contact with the wall portion 752 of the positioning recessed portion 754.

In the other embodiment, in the mounted state of the cartridge 4A, the projected portion 915 is engaged with a positioning recessed portion 754 illustrated in FIG. 15. Therefore, the positioning of the apparatus-side terminal 72 with respect to the cartridge-side terminal 830 can be performed with high accuracy.

In the present embodiment, as illustrated in FIG. 38, the lower portion 915*a* of the projected portion 915 is in contact with the surface 753 of the positioning recessed portion 754. In addition, the upper portion 915*b* of the projected portion 915 is in contact with a surface 724*fa* of a terminal block 724 that forms the positioning recessed portion 754. Therefore, the movement of the apparatus-side terminal 72 in the Z axis direction can be suppressed by the lower portion 915*a* and the upper portion 915*b*. As a result, the apparatus-side terminal 72 and the cartridge-side terminal 830 can be excellently brought into contact with each other.

In the present embodiment, as illustrated in FIG. 39, the side portions 915*t* and 915*w* of the projected portion 915 is in contact with the wall portion 752 of the positioning recessed portion 754. Therefore, the movement of the apparatus-side terminal 72 in the X axis direction can be regulated by the side portions 915*t* and 915*w* of the projected portion 915. As a result, the apparatus-side terminal 72 and the cartridge-side terminal 830 can be excellently brought into contact with each other.

B-4. Another Embodiment 4

Figure 40:
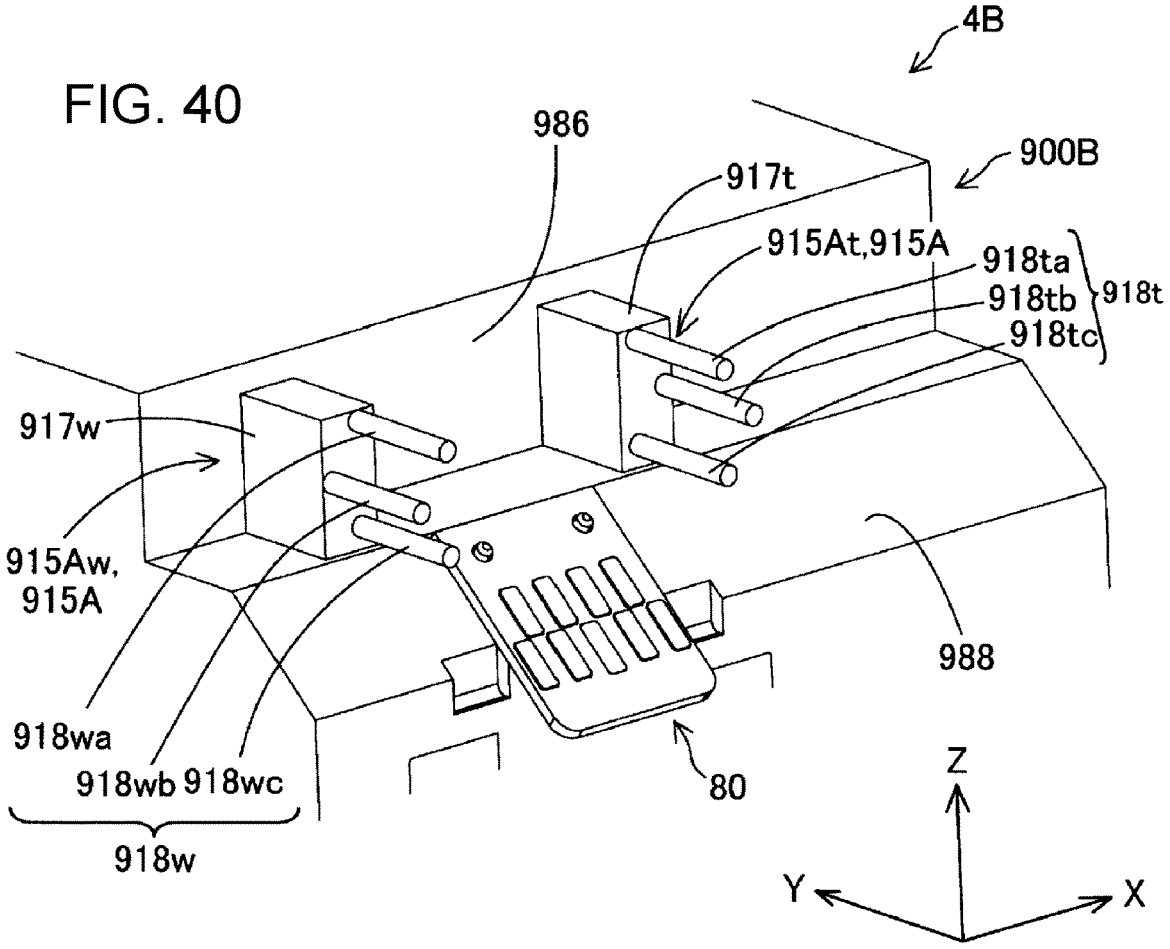
FIG. 40 is an external perspective view in the vicinity of the corner.

A cartridge 4B of another Embodiment 4 illustrated in FIG. 40 differs from the cartridge 4A of another Embodiment 3 in the configuration of a corner 900B, but is otherwise the same.

A detailed configuration of the corner 900B according to another Embodiment 4 will be described with reference to FIG. 40. FIG. 40 is an external perspective view in the vicinity of the corner 900B.

As illustrated in FIG. 40, in another Embodiment 4, a projected portion 915A protrudes from the back surface 986 in the −Y axis direction. The projected portion 915A includes a first projected portion 915At on the +X axis direction side with respect to the circuit substrate 80, and a second projected portion 915Aw on the −X axis direction side with respect to the circuit substrate 80, in the X axis direction.

The first projected portion 915At includes (i) a member 917*t* which is in contact with the back surface 986 and has a substantially quadrangular prism shape, and (ii) a substantially columnar member 918*t* that extends from the member 917*t* in the −Y axis direction. Similarly, the second projected portion 915Aw includes (i) a member 917*w* which is in contact with the back surface 986 and has a substantially quadrangular prism shape, and (ii) a substantially columnar member 918*w* that extends from the member 917*w* in the −Y axis direction. The members 917*t* and 917*w* are collectively referred to as a member 917, and the members 918*t* and 918*w* are also collectively referred to as a member 918.

The first projected portion 915At and the second projected portion 915Aw each include three members 918. The first projected portion 915At includes, as the member 918*t*, members 918*ta*, 918*tb*, and 918*tc* in order from the +Z axis direction side. Similarly, the second projected portion 915Aw includes, as the member 918*w*, members 918*wa*, 918*wb*, and 918*wc* in order from the +Z axis direction side. The members 918*ta*, 918*tb*, and 918*tc* are provided at equal intervals in the Z axis direction. Similarly, the members 918*wa*, 918*wb*, and 918*wc* are provided at equal intervals in the Z axis direction. In the X axis direction, the members 918*ta* and 918*tc* are provided at the same position, and the member 918*tb* is provided on the +X axis direction side of the members 918*ta* and 918*tc*. Meanwhile, in the X axis direction, the members 918*wa* and 918*wc* are provided at the same position, and the member 918*wb* is provided on the −X axis direction side of the members 918*wa* and 918*wc*.

Figure 41:
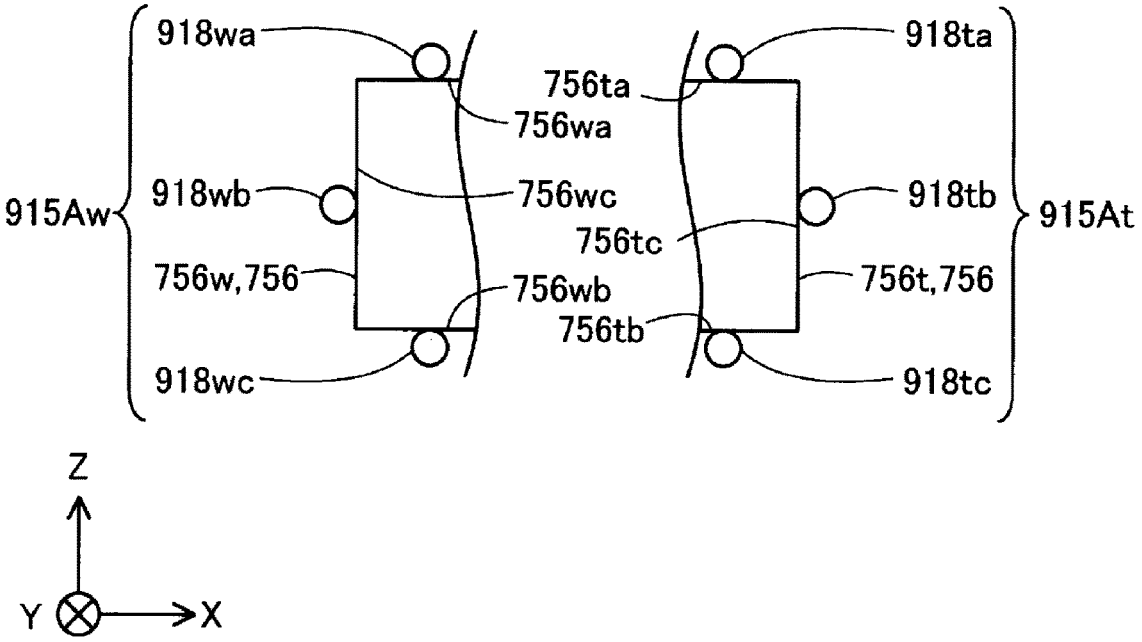
FIG. 41 is an XZ sectional view illustrating a relationship between a member of the cartridge and an apparatus-side regulating section.

FIG. 41 is an XZ sectional view illustrating a relationship between the member 918 of the cartridge 4B and the apparatus-side regulating section 756 of the apparatus-side terminal portion 70*b* (FIG. 15) in the mounted state of the cartridge 4B. In the mounted state of the cartridge 4B, the projected portion 915A regulates the movement of the apparatus-side regulating section 756 of the apparatus-side terminal portion 70*b* in the cross direction (the X axis direction and the Z axis direction). Specifically, the regulation is as follows. In other words, a contact surface 756*ta* of the first apparatus-side regulating section 756*t*, which is a surface positioned on the +Z axis direction side, is in contact with the member 918*ta* of the first projected portion 915At. A contact surface 756*tc* of the first apparatus-side regulating section 756*t*, which is a surface that intersects the X axis direction, is in contact with the member 918*tb* of the first projected portion 915At.

Similarly, a contact surface 756*wa* of the second apparatus-side regulating section 756*w*, which is a surface positioned on the +Z axis direction side, is in contact with the member 918*wa* of the second projected portion 915Aw. A contact surface 756*wc* of the second apparatus-side regulating section 756*w*, which is a surface that intersects the X axis direction, is in contact with the member 918*wb* of the second projected portion 915Aw. Although not illustrated in the drawing, a contact surface 756*td* of the first apparatus-side regulating section 756*t*, which is a surface positioned on the +Y axis direction side, is in contact with the member 917*t* of the first projected portion 915At. Similarly, a contact surface 756*wd* of the second apparatus-side regulating section 756*w*, which is a surface positioned on the +Y axis direction side, is in contact with the member 917*w* of the second projected portion 915Aw.

In the present embodiment, as illustrated in FIG. 41, the projected portion 915A is engaged with the apparatus-side regulating section 756 of the apparatus-side terminal portion 70*b*. Therefore, the positioning of the apparatus-side terminal 72 with respect to the cartridge-side terminal 830 can be performed with high accuracy. In the present embodiment, the first projected portion 915At and the second projected portion 915Aw each include three members 918, but may include four or more members. In addition, the first projected portion 915At and the second projected portion 915Aw each may include two members 918. In this case, the projected portions 915At and 915Aw do not include the members 918*tb* and 918*wb*, and the wall portion on the +X axis direction side of the apparatus-side terminal portion 70*b* may be in contact with the members 918*ta* and 918*tc*, and the wall portion on the −X axis direction side of the apparatus-side terminal portion 70*b* may be in contact with the members 918*wa* and 918*wc*.

B-5. Another Embodiment 5

Figure 42:
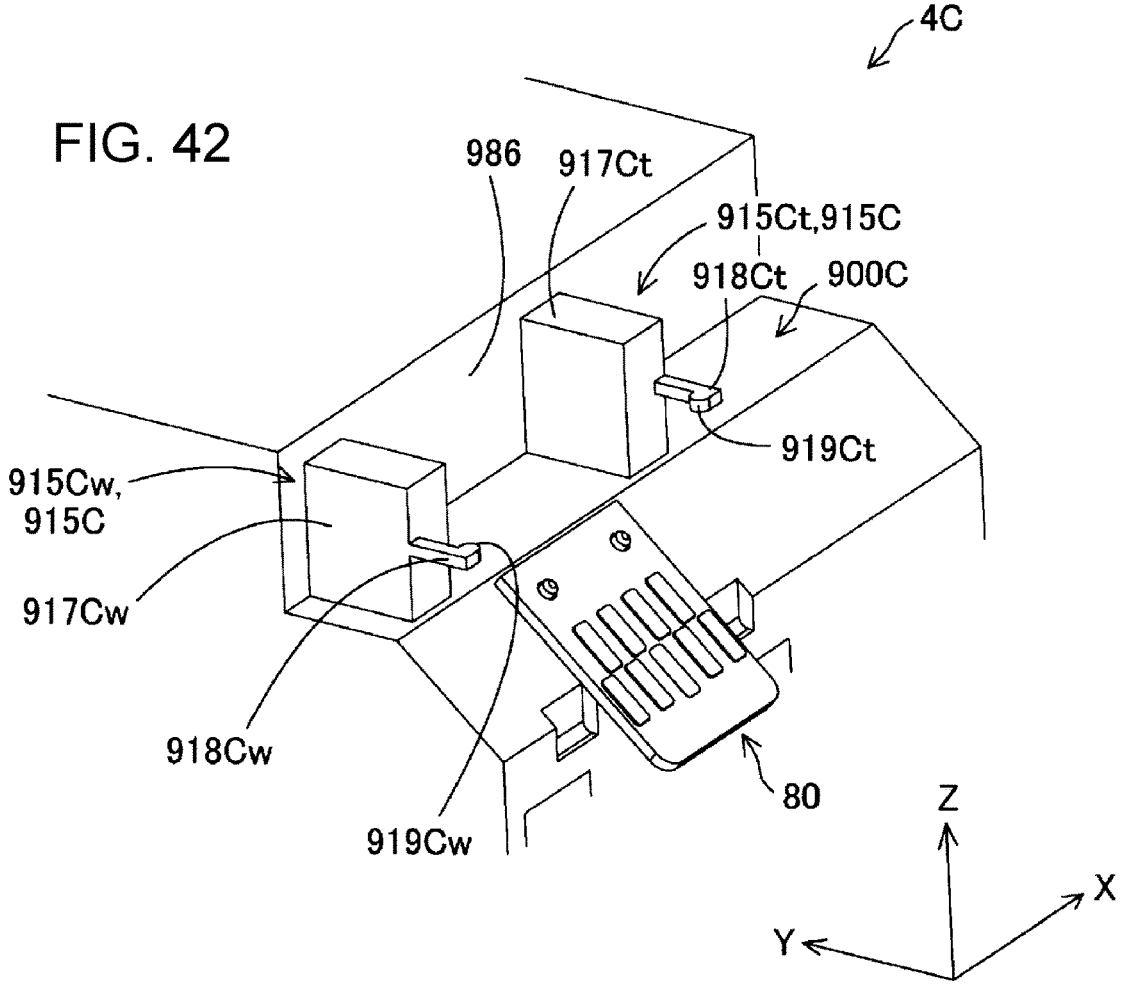
FIG. 42 is an external perspective view in the vicinity of the corner.

A cartridge 4C of another Embodiment 5 illustrated in FIG. 42 differs from the cartridge 4B of another Embodiment 4 in the configuration of a corner 900C, but is otherwise the same.

A detailed configuration of the corner 900C according to another Embodiment 5 will be described with reference to FIG. 42. FIG. 42 is an external perspective view in the vicinity of the corner 900C.

As illustrated in FIG. 42, in another Embodiment 4, a projected portion 915C protrudes from the back surface 986 in the −Y axis direction. A plurality (two in the present embodiment) of projected portions 915C includes a first projected portion 915Ct on the +X axis direction side with respect to the circuit substrate 80, and a second projected portion 915Cw on the −X axis direction side with respect to the circuit substrate 80, in the X axis direction.

The first projected portion 915Ct includes (i) a member 917Ct which is in contact with the back surface 986 and has a substantially quadrangular prism shape, and (ii) a substantially quadrangular prism member 918Ct that extends from the member 917Ct in the −Y axis direction. Similarly, the second projected portion 915Cw includes (i) a member 917Cw which is in contact with the back surface 986 and has a substantially quadrangular prism shape, and (ii) a substantially quadrangular prism member 918Ct that extends from the member 917Cw in the −Y axis direction. The member 917Ct and the member 917Cw are collectively referred to as a member 917C, and the member 918Ct and the member 918Cw are also collectively referred to as a member 918C.

On the −Y axis direction side of the member 918Ct, a protrusion portion 919Ct that protrudes in the −X axis direction is provided. Similarly, on the −Y axis direction side of the member 918Cw, a protrusion portion 919Cw that protrudes in the +X axis direction is provided. The protrusion portion 919Ct and the protrusion portion 919Cw protrude in the X axis direction so as to oppose each other. In other words, some of 915Ct and Cw protrude in the X axis direction so as to oppose each other. The protrusion portion 919Ct and the protrusion portion 919Cw are also collectively referred to as a protrusion portion 919C.

In the mounted state of the cartridge 4C, the protrusion portion 919C of the projected portion 915C is engaged with a recessed portion 777 illustrated in FIG. 15. The recessed portion 777 is provided in the apparatus-side regulating section 756, and is also referred to as a positioning recessed portion 777. The recessed portion 777 is a hollow provided on the +Y axis direction side of the apparatus-side regulating section 756. A hollow provided in the first apparatus-side regulating section 756*t* is also called a recessed portion 777*t*, and a hollow provided in the first apparatus-side regulating section 756*w* is also called a recessed portion 777*w*.

Figure 43:
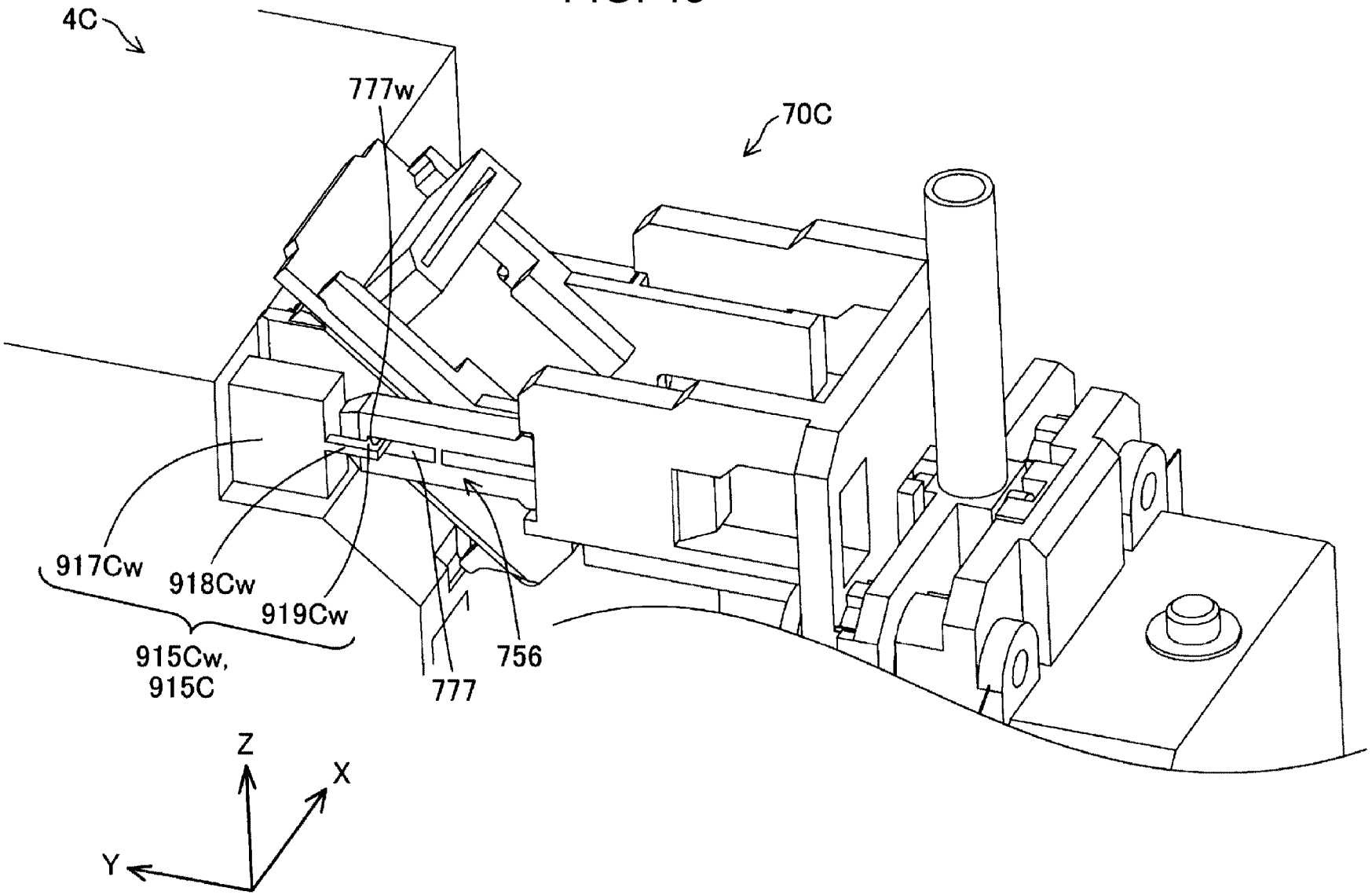
FIG. 43 is an external perspective view illustrating a state where the projected portion and the recessed portion are engaged with each other.

FIG. 43 is an external perspective view illustrating a state where the projected portion 915C of the cartridge 4C and the recessed portion 777 of the printer 10 are engaged with each other. As illustrated in FIG. 43, the projected portion 915C of the cartridge 4 is inserted into the recessed portion 777 of the printer 10. In other words, the protrusion portion 919Ct of the first projected portion 915Ct is inserted into the recessed portion 777*t*, and the protrusion portion 919Cw of the second projected portion 915Cw is inserted into the recessed portion 777*w*.

In the present embodiment, the projected portion 915C functions as a regulating section that regulates the movement of the apparatus-side regulating section 756 in the cross direction (the X axis direction and the Z axis direction). Therefore, the positioning accuracy of the apparatus-side terminal 72 with respect to the cartridge-side terminal 830 can be performed with high accuracy.

The projected portion 915C of the cartridge 4C is locked to the recessed portion 777 of the printer 10. Therefore, it is possible to suppress the relative movement of the cartridge-side terminal 830 in the direction away from the apparatus-side terminal 72. In other words, the protrusion portion 919C of the projected portion 915C can prevent the cartridge 4C from easily falling out of the printer 10.

B-6. Another Embodiment 6

Figure 44:
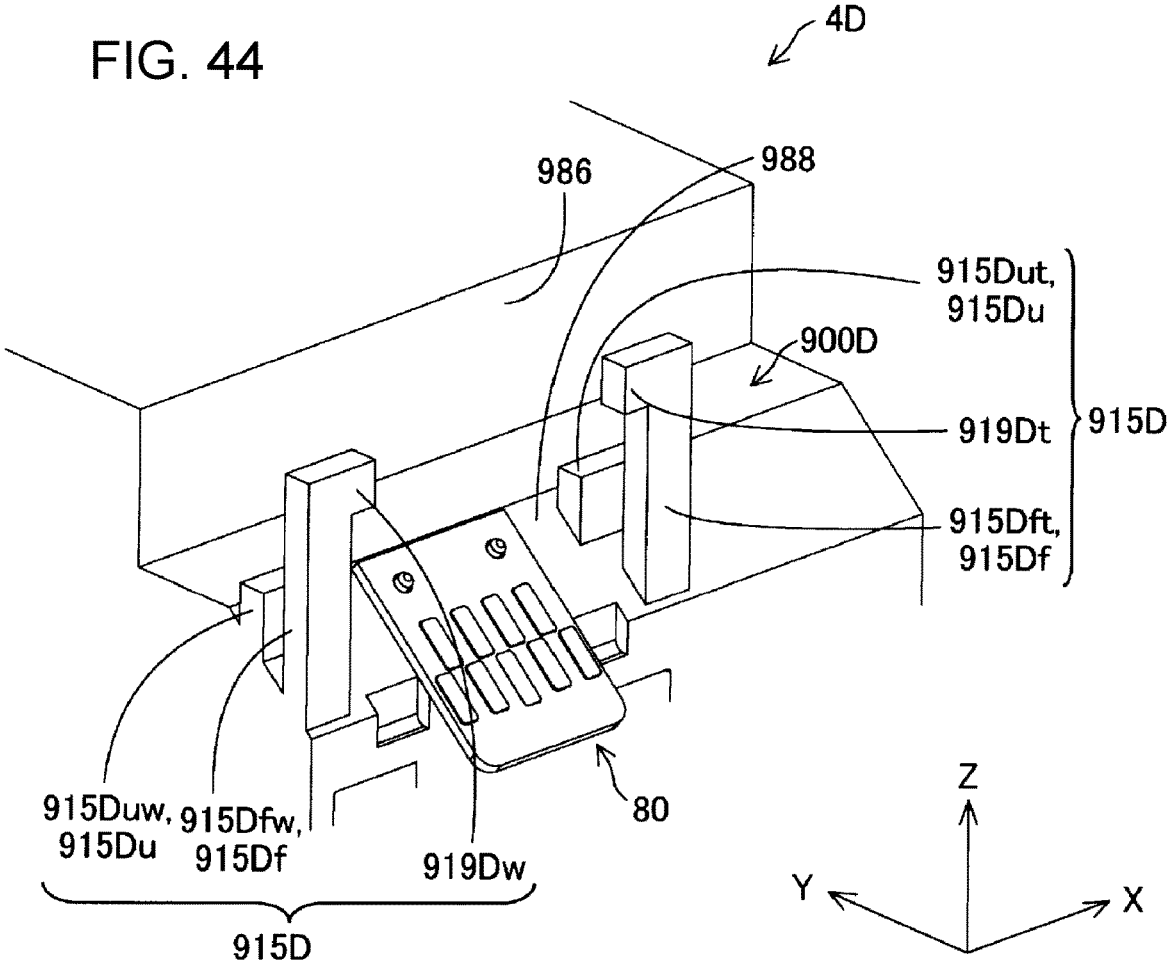
FIG. 44 is an external perspective view in the vicinity of the corner.

A cartridge 4D of another Embodiment 6 illustrated in FIG. 44 differs from the cartridge 4C of another Embodiment 5 in the configuration of a corner 900D, but is otherwise the same.

Figure 45:
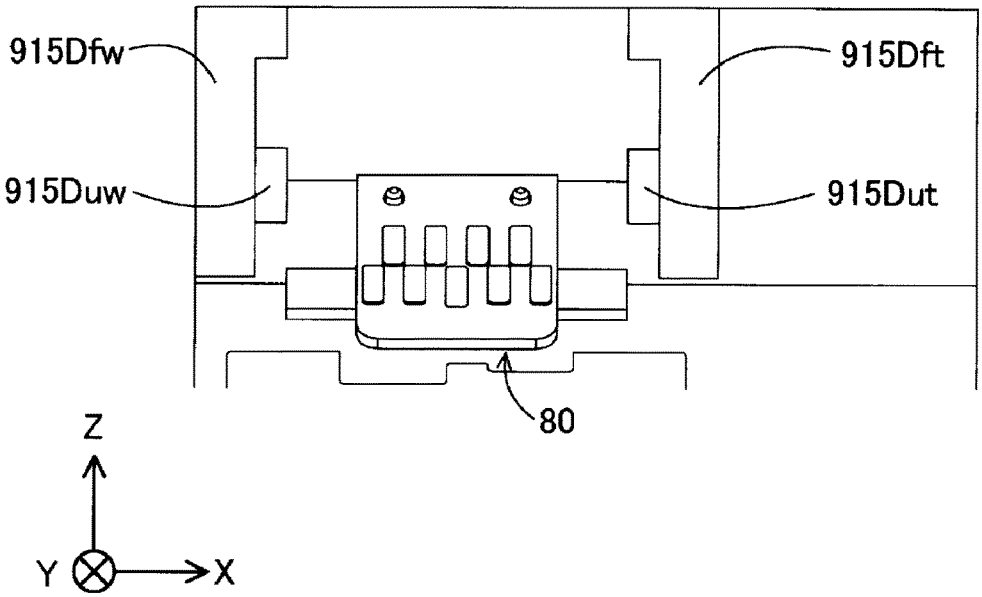
FIG. 45 is a front view in the vicinity of the corner.

A detailed configuration of the corner 900D according to the present embodiment will be described with reference to FIG. 44. FIG. 44 is an external perspective view in the vicinity of the corner 900D. FIG. 45 is a front view in the vicinity of the corner 900D.

As illustrated in FIG. 44, in the present embodiment, a pair of projected portions 915D is provided on the −Y axis direction side and a pair of projected portions 915D is provided on the +Y axis direction side. Each of the projected portions 915D protrudes in the +Z axis direction from the bottom surface 988 which is a support section of the circuit substrate 80. In other words, the projected portion 915D protrudes upward from the bottom surface 988. The pair of projected portions 915D positioned on the −Y axis direction side is called a projected portion 915Df. One of the projected portions 915Df positioned on the +X axis direction side with respect to the circuit substrate 80 is called a first projected portion 915Dft, and the other one positioned on the −X axis direction side is referred to as a second projected portion 915Dfw. The pair of projected portions 915D positioned on the +Y axis direction side is called a projected portion 915Du. One of the projected portions 915Du positioned on the +X axis direction side with respect to the circuit substrate 80 is called a third projected portion 915Dut, and the other one positioned on the −X axis direction side is referred to as a fourth projected portion 915Duw. Each of the projected portions 915D has a substantially quadrangular prism shape.

The first projected portion 915Dft includes a protrusion portion 919Dt on the +Z axis direction side. The protrusion portion 919Dt protrudes on the −X axis direction side. The second projected portion 915Dfw has a protrusion portion 919Dw on the +Z axis direction side. The protrusion portion 919Dw protrudes on the +X axis direction side.

In the present embodiment, in the mounted state of the cartridge 4D, the projected portion 915D is engaged with the apparatus-side regulating section 756 (refer to FIG. 15) of the apparatus-side terminal portion 70. Specifically, the engagement is as follows. In other words, (i) a contact surface of the first apparatus-side regulating section 756*t* which is a surface positioned on the +Z axis direction side, and (ii) a contact surface of the first apparatus-side regulating section 756*t* which is a surface intersecting the X axis direction, are in contact with the first projected portion 915Dft. Similarly, (i) a contact surface of the second apparatus-side regulating section 756*w* which is a surface positioned on the +Z axis direction side, and (ii) a contact surface of the second apparatus-side regulating section 756*w* which is a surface positioned on the −X axis direction side, are in contact with the second projected portion 915Dfw. Therefore, the positioning of the apparatus-side terminal 72 with respect to the cartridge-side terminal 830 can be performed with high accuracy.

B-7. Another Embodiment 7

Figure 46:
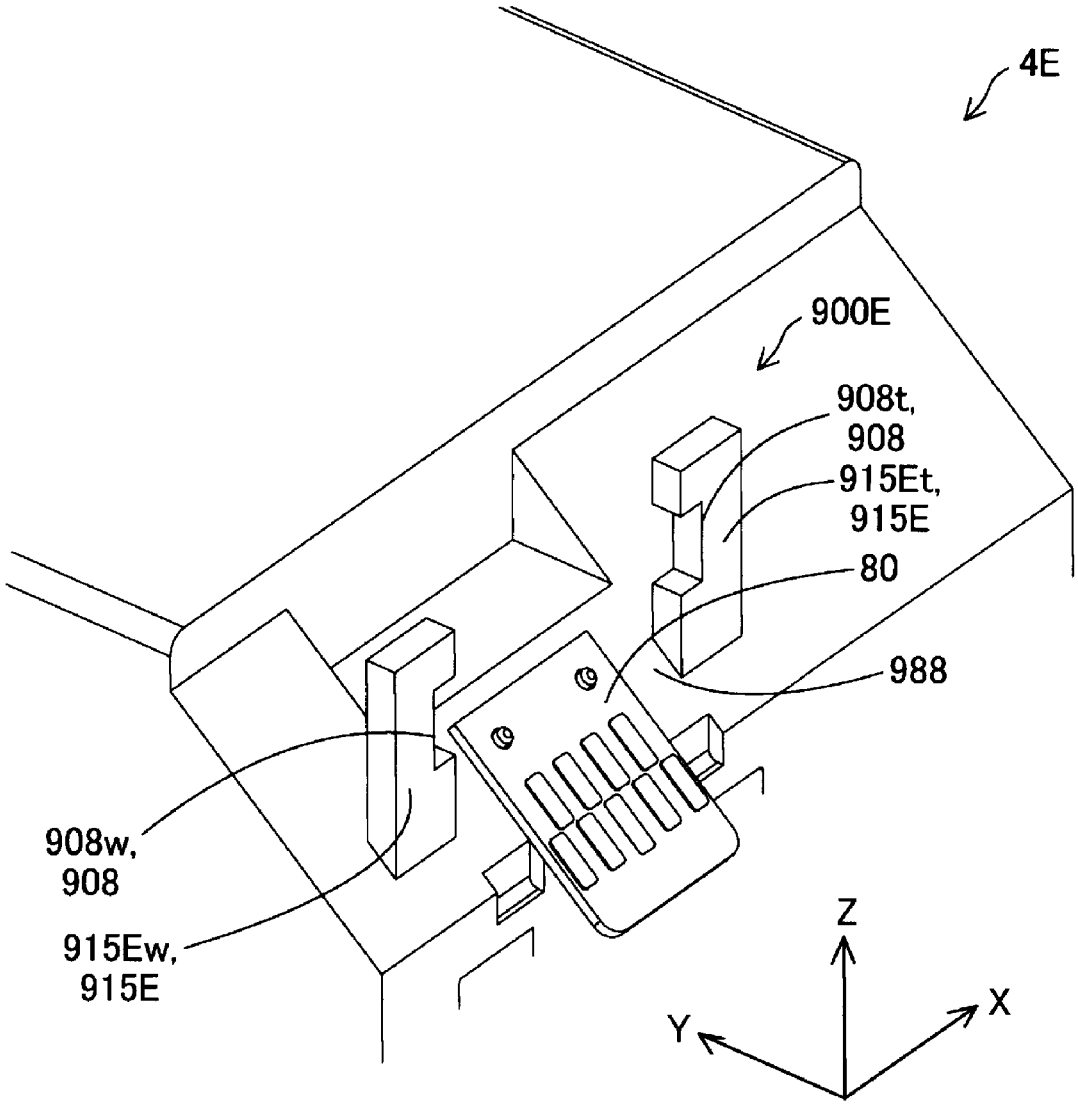
FIG. 46 is an external perspective view in the vicinity of the corner.

A cartridge 4E of another Embodiment 7 illustrated in FIG. 46 differs from the cartridge 4D of another Embodiment 6 in the configuration of a corner 900E, but is otherwise the same.

A detailed configuration of the corner 900E according to the present embodiment will be described with reference to FIG. 46. FIG. 46 is an external perspective view in the vicinity of the corner 900E.

As illustrated in FIG. 46, a pair of protrusion portions 915E that protrudes in the +Z axis direction is provided on a bottom surface 988 that serves as a support section. The shape of the protrusion portion 915E is a substantially quadrangular prism. One of the protrusion portions 915E positioned on the +X axis direction side with respect to the circuit substrate 80 is called a first protrusion portion 915Et, and the other one positioned on the −X axis direction side is called a second protrusion portion 915Ew. The pair of protrusion portions 915E are provided with a pair of grooves 908, respectively. A first groove 908*t* of the first protrusion portion 915Et is sunk in the +X axis direction, and a second groove 908*w* of the second protrusion portion 915Ew is sunk in the −X axis direction.

In the present embodiment, in the mounted state of the cartridge 4E, the groove 908 of the projected portion 915E is engaged with the apparatus-side regulating section 756 (refer to FIG. 15) of the apparatus-side terminal portion 70. Therefore, the movement of the apparatus-side regulating section 756 of the apparatus-side terminal portion 70 in the cross direction (the X axis direction and the Z axis direction) can be regulated.

B-8. Another Embodiment 8

Figure 47:
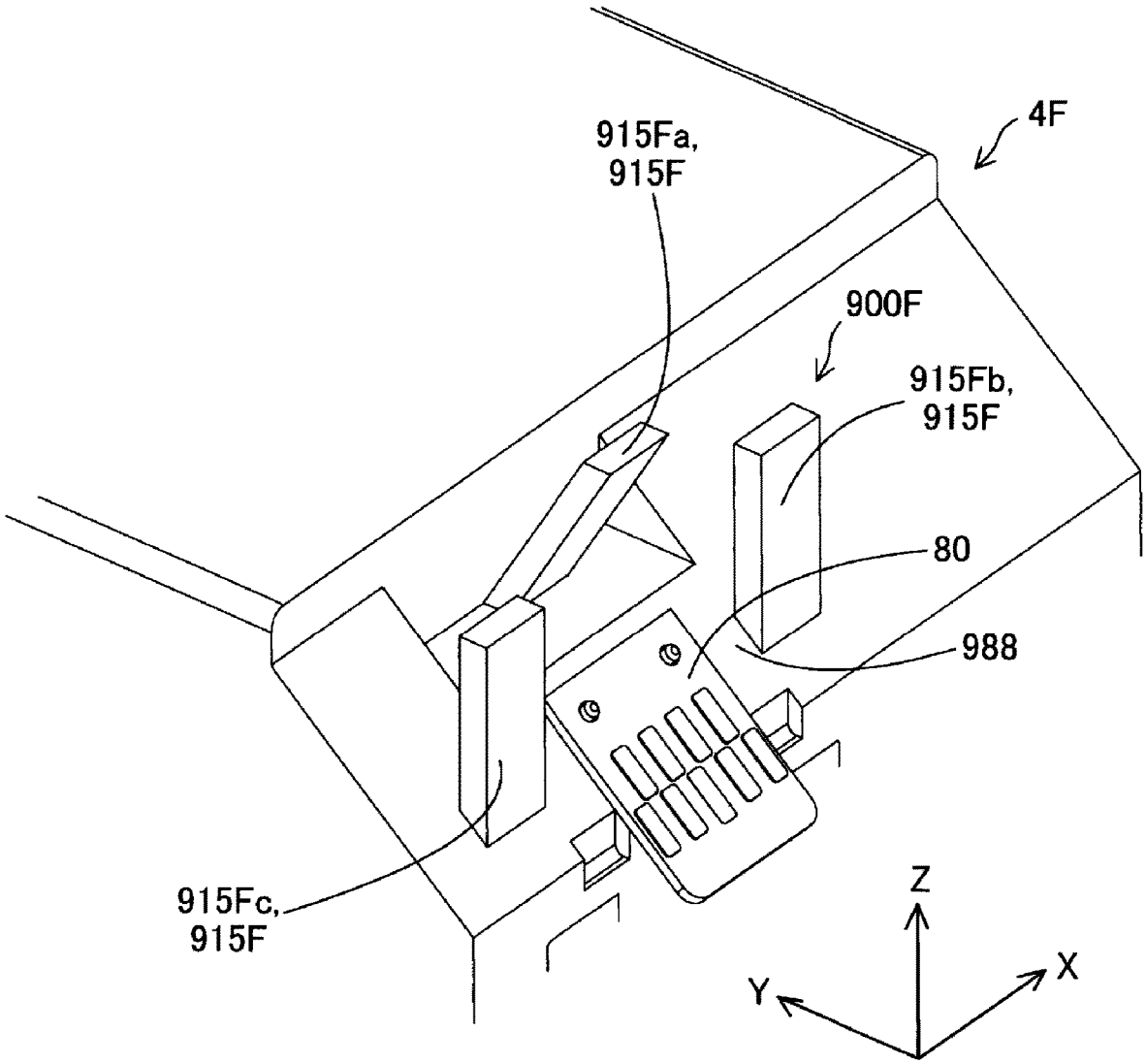
FIG. 47 is an external perspective view in the vicinity of the corner.

A cartridge 4F of the other embodiment illustrated in FIG. 47 differs from the cartridge 4E of another Embodiment 6 in the configuration of a corner 900F, but is otherwise the same.

A detailed configuration of the corner 900F according to another Embodiment 8 will be described with reference to FIG. 47. FIG. 47 is an external perspective view in the vicinity of the corner 900F.

As illustrated in FIG. 47, in the present embodiment, a pair of projected portions 915F is provided on the +Y axis direction side and a pair of projected portions 915F is provided on the −Y axis direction side. Each of the projected portions 915F has a substantially quadrangular prism shape. The projected portion 915F positioned on the +Y axis direction side is called a projected portion 915Fa. In the pair of projected portions 915F provided on the −Y axis direction side, one positioned on the +X axis direction side with respect to the circuit substrate 80 is called a projected portion 915Fb, and the other one positioned on the −X axis direction side is called a projected portion 915Fc. The projected portion 915Fa is inclined and protrudes in a direction including the −Y axis direction component and the +Z axis direction component. Meanwhile, the projected portions 915Fb and the projected portion 915Fc protrude in the +Z axis direction.

In the present embodiment, in the mounted state of the cartridge 4F, a surface 724*fc* (refer to FIG. 15) of the terminal holder is in contact with the projected portion 915Fa. The surface 724*fc* of the terminal holder 750 is a surface in a direction including the +Y axis direction component and the +Z axis direction component. In addition, the wall portion (side wall portion) on the +X axis direction side of the terminal holder 750 is in contact with the projected portion 915Fb, and the wall portion (side wall portion) on the −X axis direction side of the terminal holder 750 is in contact with the projected portion 915Fc. Therefore, the projected portion 915F can regulate the movement of the apparatus-side regulating section 756 of the apparatus-side terminal portion 70*b* in the cross direction (the X axis direction and the Z axis direction).

C. Other Embodiments for Circuit Substrate

In the above-described first embodiment, as illustrated in FIG. 9, the contact portion cp and the storage device 820 are provided on the circuit substrate 80, but the present disclosure is not limited thereto. Hereinafter, other embodiments for the circuit substrate will be described.

C-1. Another Embodiment A

Figure 48:
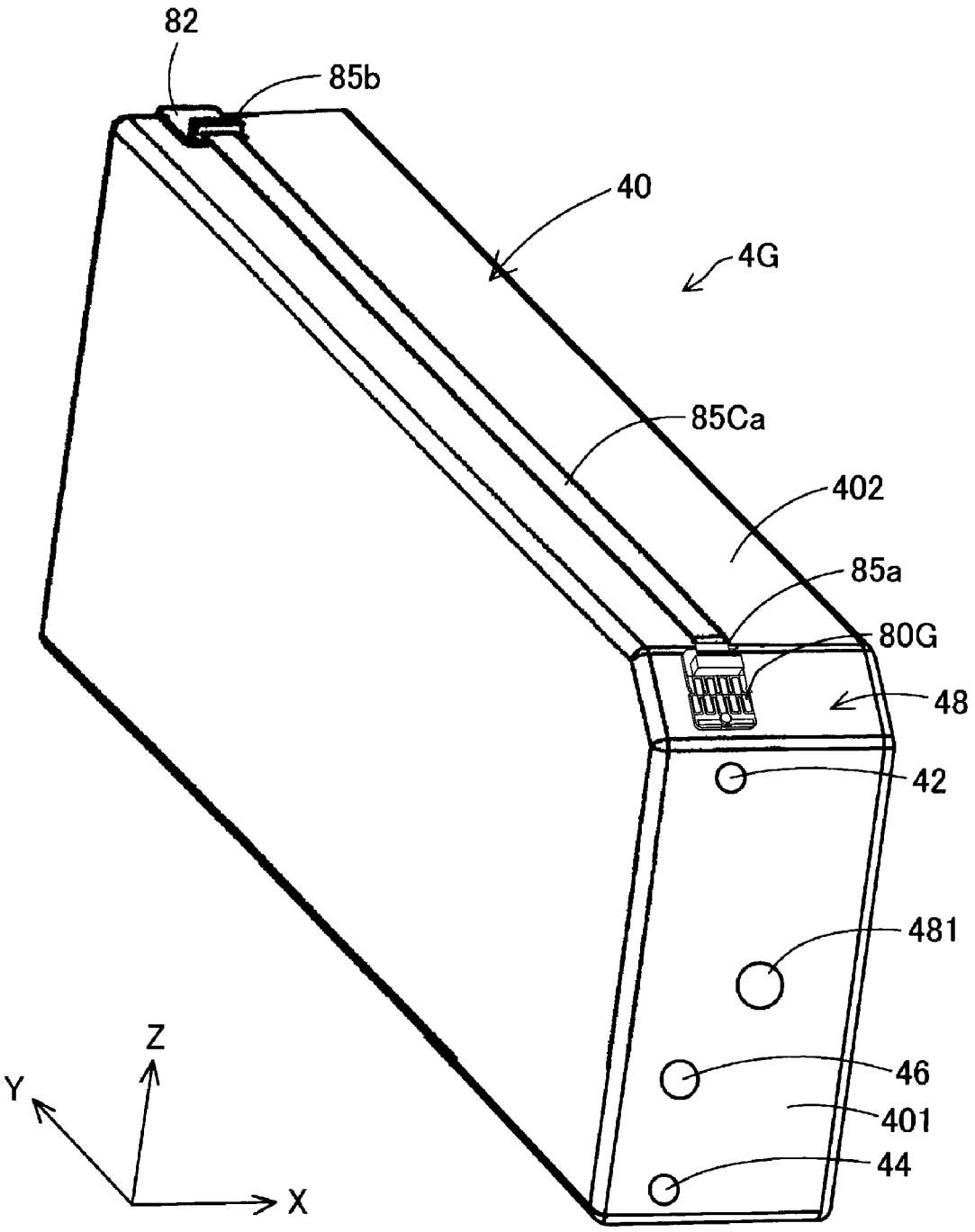
FIG. 48 is an external perspective view of the cartridge.
Figure 49:
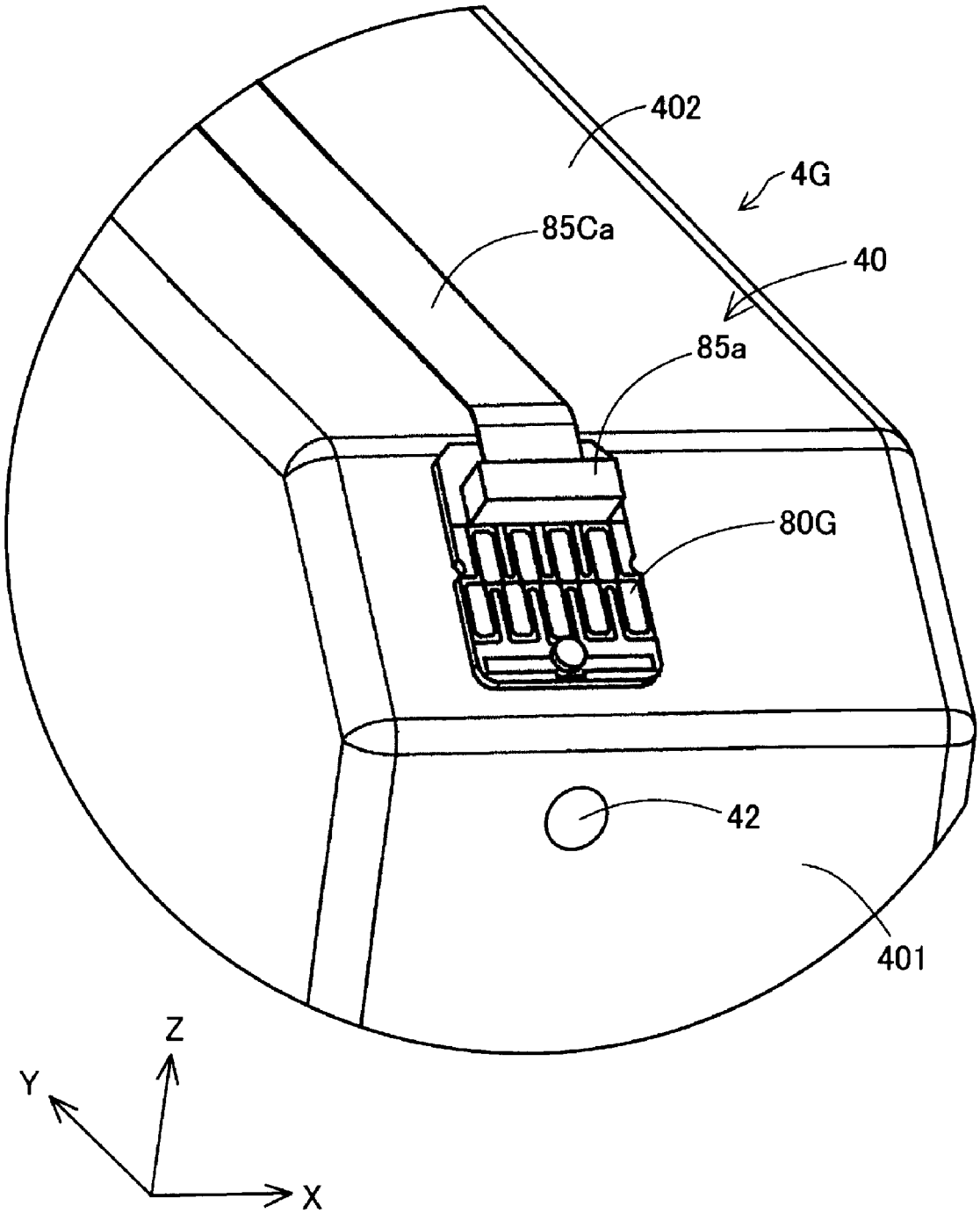
FIG. 49 is an enlarged view in the vicinity of the circuit substrate provided on a −Y axis direction side of the cartridge.
Figure 50:
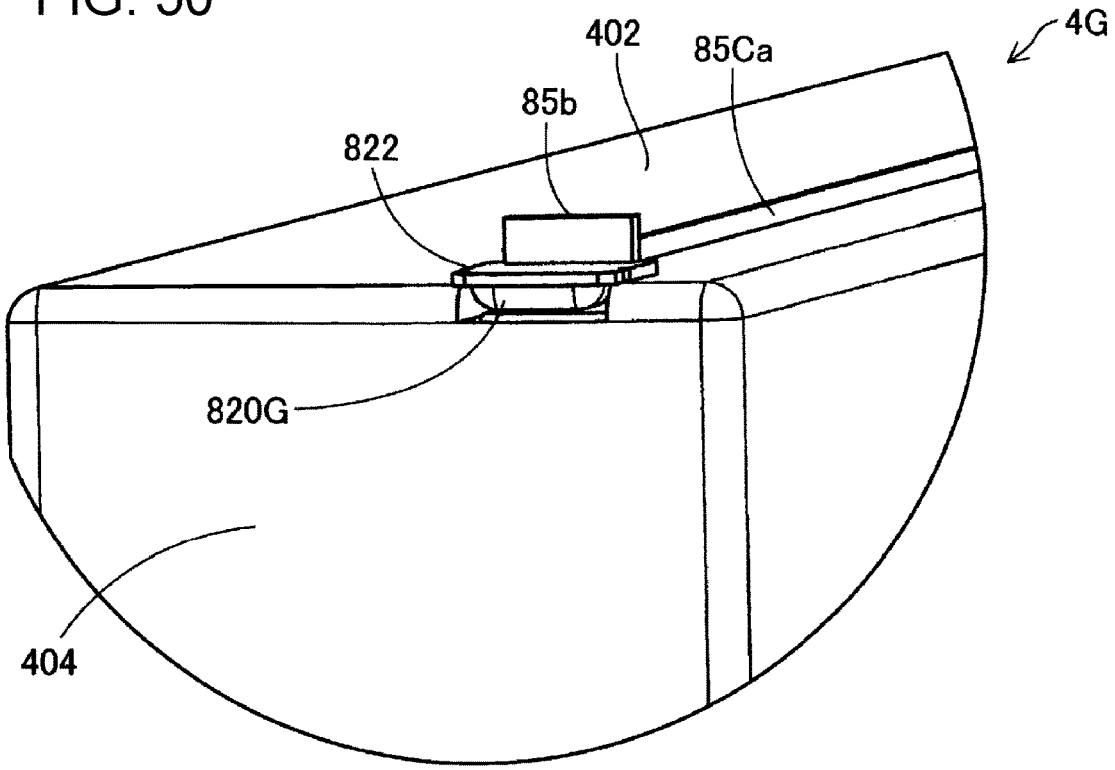
FIG. 50 is a view illustrating an example of the cartridge in which the circuit substrate and a storage device are separated from each other.

FIGS. 48 to 50 are views illustrating an example of a cartridge 4G in which the circuit substrate and the storage device are separated from each other. FIGS. 48 to 50 are simplified except for the circuit substrate and the storage device. FIG. 48 is an external perspective view of the cartridge 4G. FIG. 49 is an enlarged view in the vicinity of a circuit substrate 80G provided on the −Y axis direction side of the cartridge 4G. FIG. 50 is an enlarged view in the vicinity of a storage device 820G provided on the +Y axis direction side of the cartridge 4G. In the present embodiment, the circuit substrate 80G and the storage device 820G are electrically coupled to each other via a cable 85Ca. In the present modification, a flexible flat cable (FFC) is used as the cable 85Ca. As illustrated in FIG. 49, the circuit substrate 80G and the cable 85Ca are electrically coupled to each other by a connector 85*a*, and as illustrated in FIG. 50, the storage device 820G and the cable 85Ca are electrically coupled to each other by a connector 85*b*. As illustrated in FIG. 50, the storage device 820G is provided on a substrate 822. By providing the storage device 820G at a position separated from the circuit substrate 80G, a place where the storage device 820G is disposed can be flexibly determined. In addition, the circuit substrate 80G and the cable 85Ca may be configured with an FPC substrate, the cable 85Ca and the substrate 82 may be configured with an FPC substrate, and the circuit substrate 80G, the substrate 822, and the cable 85Ca may be configured with an FPC substrate.

C-2. Another Embodiment B

In the above-described first embodiment, as illustrated in FIG. 4, the cartridge-side terminal 830 having the contact portion cp is disposed on the circuit substrate 80, and the circuit substrate 80 is disposed at the corner 48. In other words, the part where the cartridge-side terminal 830 is disposed is not directly disposed at the corner 48. However, the cartridge-side terminal 830 may be directly disposed at the corner 48.

Figure 51:
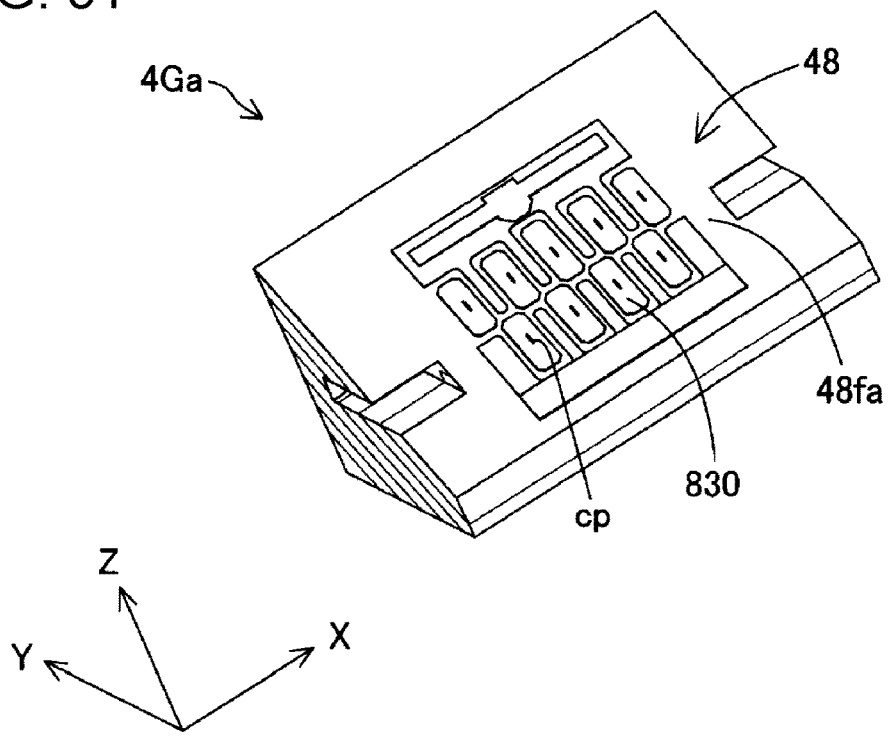
FIG. 51 is a view illustrating a corner of a cartridge according to another embodiment.

FIG. 51 is a view illustrating a corner 48 of a cartridge 4Ga according to another Embodiment B. The cartridge-side terminals 830 are directly patterned and disposed on an inclined surface 48*fa* of the corner 48. In addition, the cartridge-side terminals 830 may be directly patterned on the holder inclined surface 88*fa* (FIG. 13) of the substrate holder 880, and the substrate holder 880 may be detachably attached to the corner 48*a*.

C-3. Another Embodiment C

In the above-described first embodiment, as illustrated in FIG. 5, the surface 80*fa* on which the contact portion cp is disposed is inclined with respect to the mounting direction (−Y axis direction) similar to a state where the cartridge 4 is mounted on the printer 10 even in a state where the cartridge 4 is not mounted on the printer 10. However, the present disclosure is not limited thereto. In other words, the surface 80*fa* may not be inclined with respect to the mounting direction (−Y axis direction) in a state where the cartridge is not mounted on the printer 10.

Figure 52:
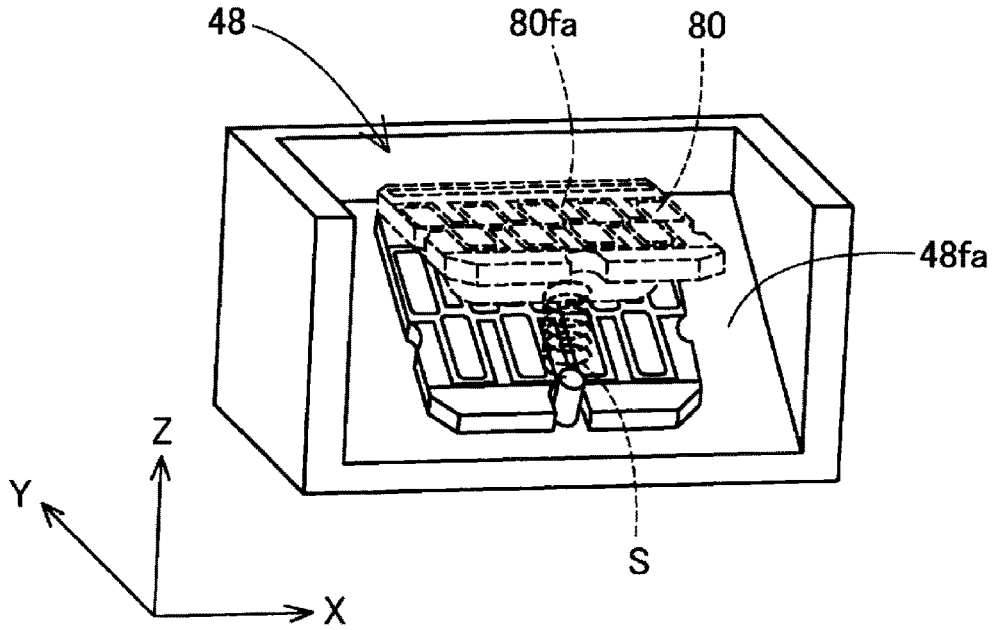
FIG. 52 is a view illustrating an example of the circuit substrate that is not inclined with respect to a mounting direction.

FIG. 52 is a view illustrating an example of the circuit substrate 80 that is not inclined with respect to the mounting direction (−Y axis direction) in a state where the cartridge is not mounted on the printer 10. In the present embodiment, a spring S is provided between the rear surface of the circuit substrate 80 and the inclined wall 48*fa* of the corner 48. Therefore, the surface 80*fa* of the circuit substrate 80 is parallel to the mounting direction (−Y axis direction) in a state where the circuit substrate is not mounted on the printer 10, and is inclined with respect to the mounting direction (−Y axis direction) in a state where the circuit substrate is mounted on the printer 10.

Figure 53:
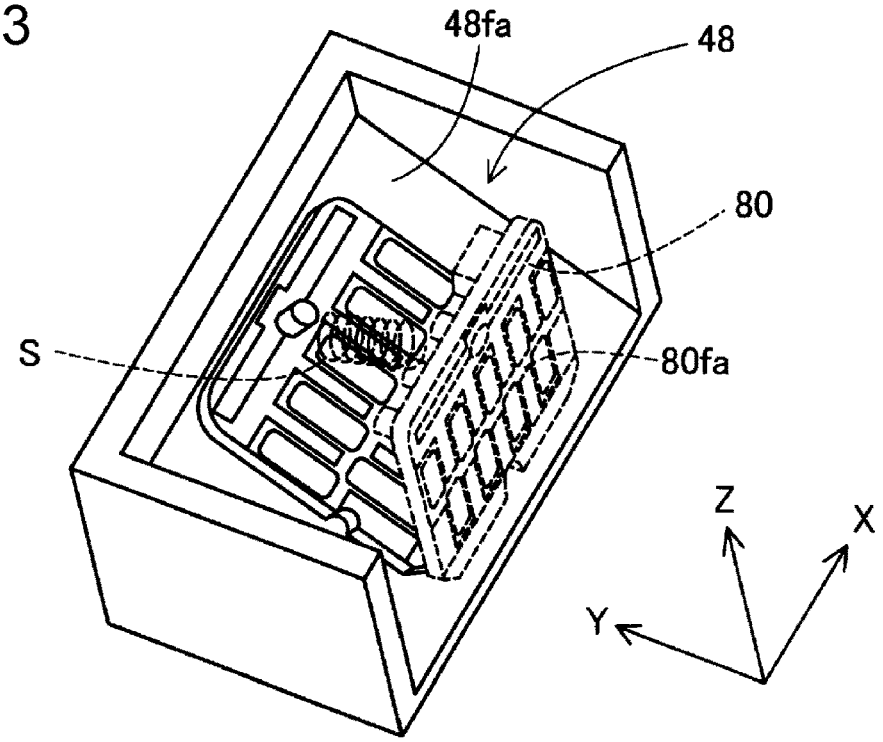
FIG. 53 is a view illustrating an example of the circuit substrate that is not inclined with respect to the mounting direction.

FIG. 53 is a view illustrating an example of the circuit substrate 80 that is not inclined with respect to the mounting direction (−Y axis direction) in a state where the cartridge is not mounted on the printer 10. In the present embodiment, a spring S is provided between the rear surface of the circuit substrate 80 and the inclined wall 48*fa* of the corner 48. Therefore, the surface 80*fa* of the circuit substrate 80 is perpendicular to the mounting direction (−Y axis direction) in a state where the circuit substrate is not mounted on the printer 10, and is inclined with respect to the mounting direction (−Y axis direction) in a state where the circuit substrate is mounted on the printer 10.

D. Other Embodiments for Liquid Supply Source

In the above-described first embodiment, the liquid storage bag 50 as the liquid supply source is disposed in the case 40 (FIG. 8), but the present disclosure is not limited thereto, and the liquid supply source may be disposed on the outside of the case 40. The specific example will be described below.

Figure 54:
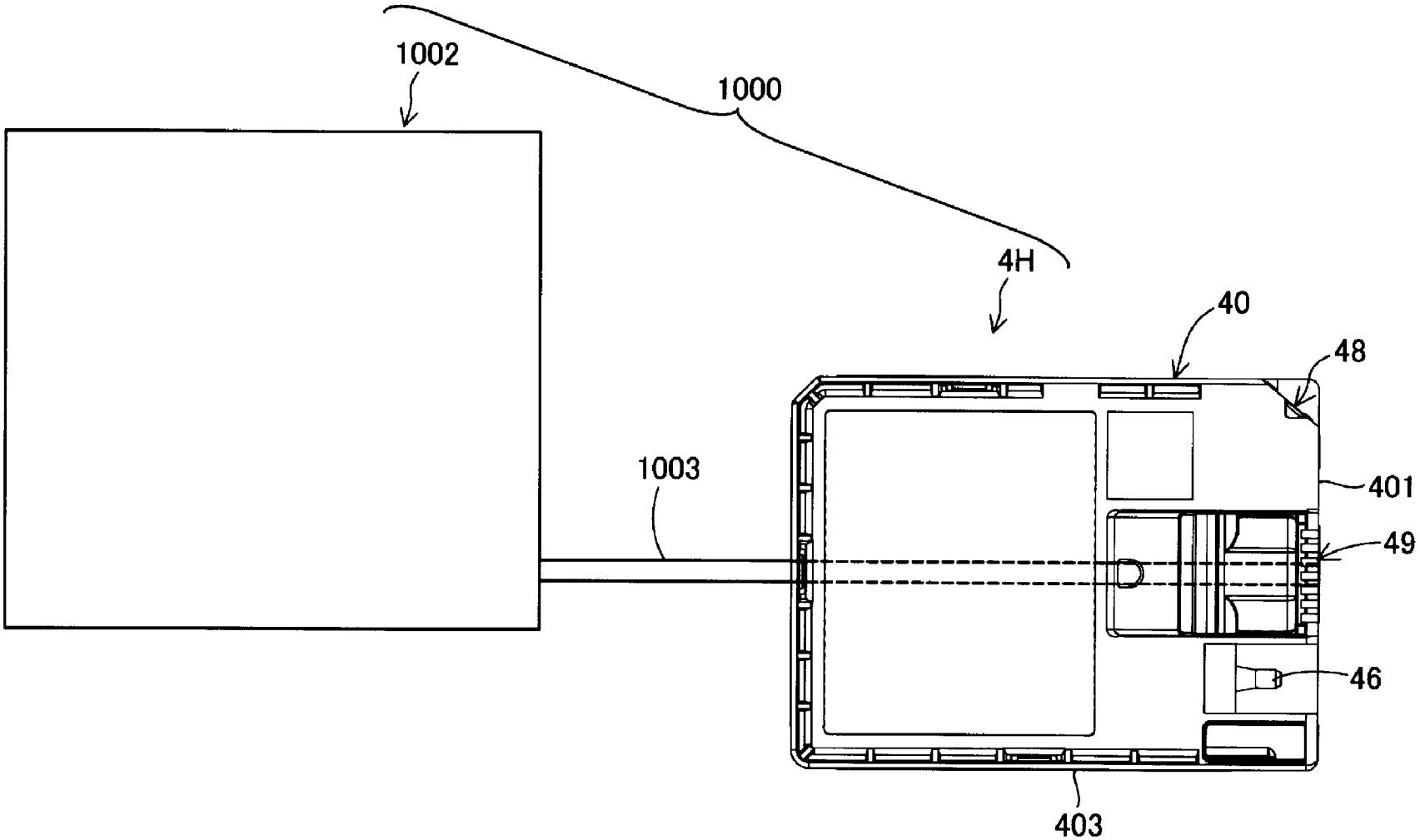
FIG. 54 is a view for describing another embodiment for a liquid supply source.

FIG. 54 is a view for describing another embodiment for a liquid supply source. The difference from the above-described first embodiment is that the liquid storage bag 50 is not disposed in the case 40 and a liquid supply source 1002 is disposed on the outside of the case 40. The difference between a cartridge 4H and the cartridge 4 of the first embodiment is that the cartridge 4H does not have the liquid storage bag 50 in the case 40.

A liquid supply device 1000 includes the cartridge 4H, a circulation pipe 1003, and a liquid supply source 1002. On the back surface 404 of the cartridge 4H, a hole or an opening into which the circulation pipe 1003 is inserted is formed. The liquid supply source 1002 is a tank that stores a liquid (ink in the present embodiment). The circulation pipe 1003 has one end coupled to the liquid supply source 1002 and the other end coupled to the liquid supply section 49. Accordingly, the liquid from the liquid supply source 1002 is supplied to the liquid supply section 49 via the circulation pipe 1003. In order to supply the liquid from the liquid supply source 1002 to the liquid supply section 49, the circulation pipe 1003 may be disposed with a pump in the middle, or may be provided with a pressurizing mechanism for pressurizing the inside of the liquid supply source 1002.

E. Other Embodiments of Fluid Receiving Section

Figure 55:
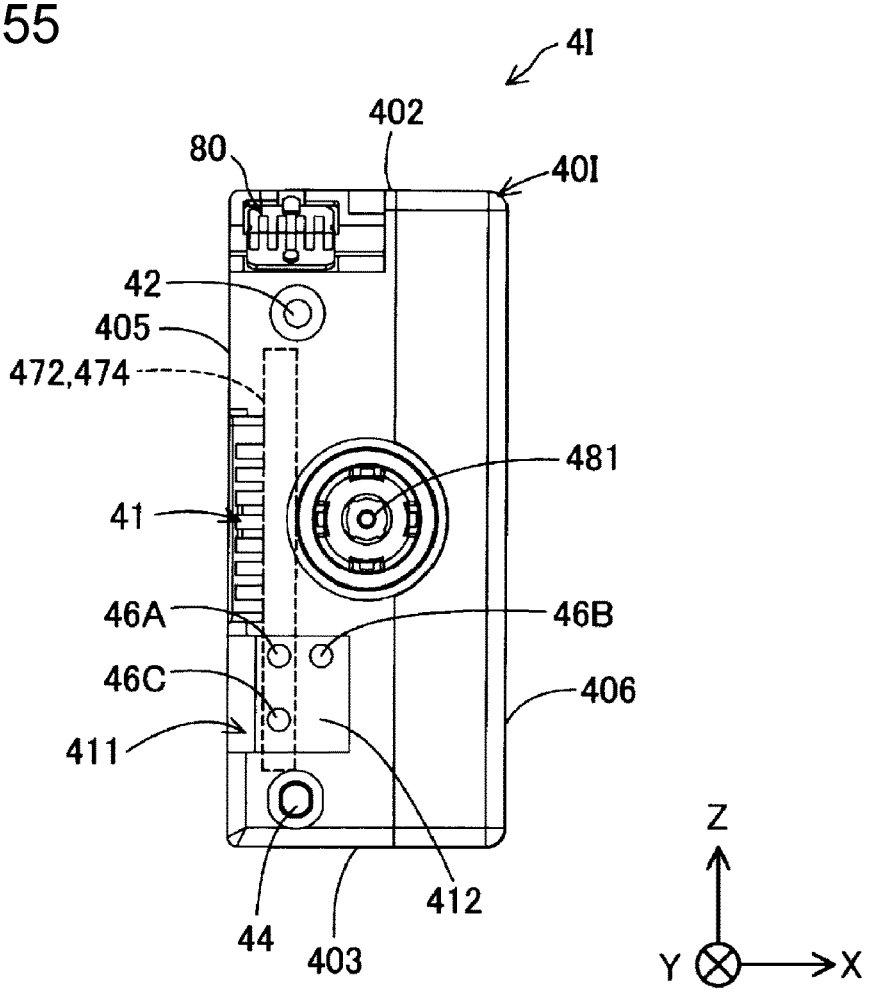
FIG. 55 is a view for describing another embodiment of a fluid receiving section.
Figure 56:
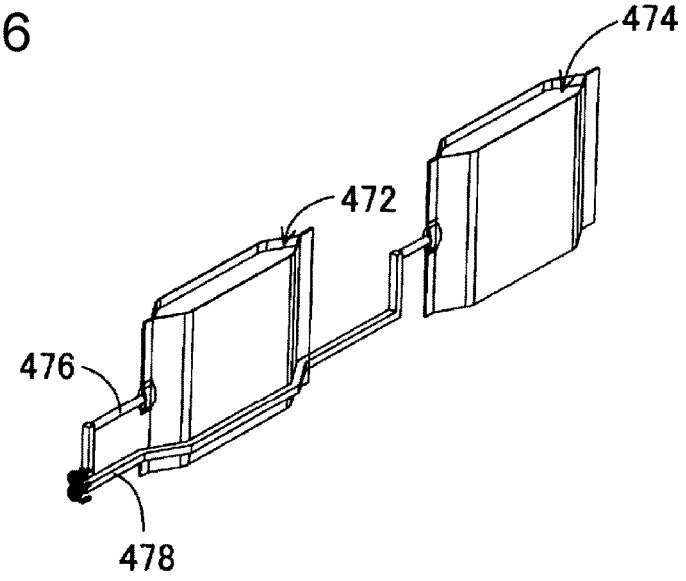
FIG. 56 is a view for describing a stirring member used in another embodiment of the fluid receiving section.

In the above-described first embodiment, the number of the fluid receiving sections 46 is only one (FIG. 12), but the present disclosure is not limited thereto. FIG. 55 is a view for describing another embodiment of the fluid receiving section. FIG. 56 is a view for describing a stirring member used in another embodiment of the fluid receiving section.

A cartridge 41 of the present embodiment is different from the cartridge 4 of the above-described first embodiment in the number of fluid receiving sections 46A, 46B, and 46C and that stirring bags 472 and 474 are provided. Since other configurations are the same as those of the cartridge 4 of the first embodiment, the same configurations will be given the same reference numerals and the description thereof will be omitted. The mounting section 6 to which the cartridge 41 is detachably mounted is provided with two new pressurizing sections for stirring in addition to the pressurizing section 86. The two pressurizing sections for stirring are cylindrical, and supply the pressurized fluid to the cartridge 41.

In the arrangement recessed portion 411 (FIG. 55), three fluid receiving sections 46A, 46B, and 46C are arranged. The fluid receiving section 46B has the same function as the fluid receiving section 46 of the first embodiment liquid. In other words, the fluid receiving section 46B is coupled to the pressurizing section 86 and receives the pressurized fluid supplied from the pressurizing section 86. The fluid receiving sections 46A and 46C are coupled to two pressurizing sections for stirring which are provided in the mounting section 6, and receive the pressurized fluid (pressurized air in the present embodiment) for stirring the liquid storage bag 50. The fluid receiving section 46A communicates with the stirring bag 472 via a tube 476 as the base end portion is coupled to the tube 476 (FIG. 56). The base end portion of the fluid receiving section 46C communicates with the stirring bag 474 via a tube 478. The tubes 476 and 478 and the stirring bags 472 and 474 are arranged in the case 401. In particular, the stirring bags 472 and 474 are arranged adjacent to the liquid storage bag 50. The stirring bags 472 and 474 expand as the pressurized fluid is fed through the fluid receiving sections 46A and 46C. As the stirring bags 472 and 474 expand, the liquid storage bag 50 is pressed. Further, the stirring bags 472 and 474 contract when the pressurized fluid is not fed. As the stirring bags 472 and 474 repeat expansion and contraction, the adjacent liquid storage bags 50 are stirred by the stirring bags 472 and 474. Accordingly, as the pigment particles in the liquid storage bag 50 flows, it is possible to reduce the variation in the concentration distribution of the pigment particles in the liquid storage bag 50. The fluid receiving sections 46A and 46C and the stirring bags 472 and 474 may not be provided two by two, and may be provided one by one or three or more.

F. Other Embodiments of Identification Member

In the above-described first embodiment, the apparatus-side identification member 81 is disposed at a position overlapping the liquid introduction section 85 in the height direction (Z axis direction) of the mounting section 6 (FIG. 2). In the above-described first embodiment, the cartridge-side identification member 41 is disposed at a position overlapping the liquid supply port 481 in the height direction (Z axis direction) of the cartridge 4 (FIG. 4). However, the arrangement positions of the mounting side identification member 81 and the cartridge-side identification member 41 are not limited to the above-described first embodiment. Further, the structure of the apparatus-side identification member 81 and the cartridge-side identification member 41 are not limited to the above-described first embodiment.

Figure 57:
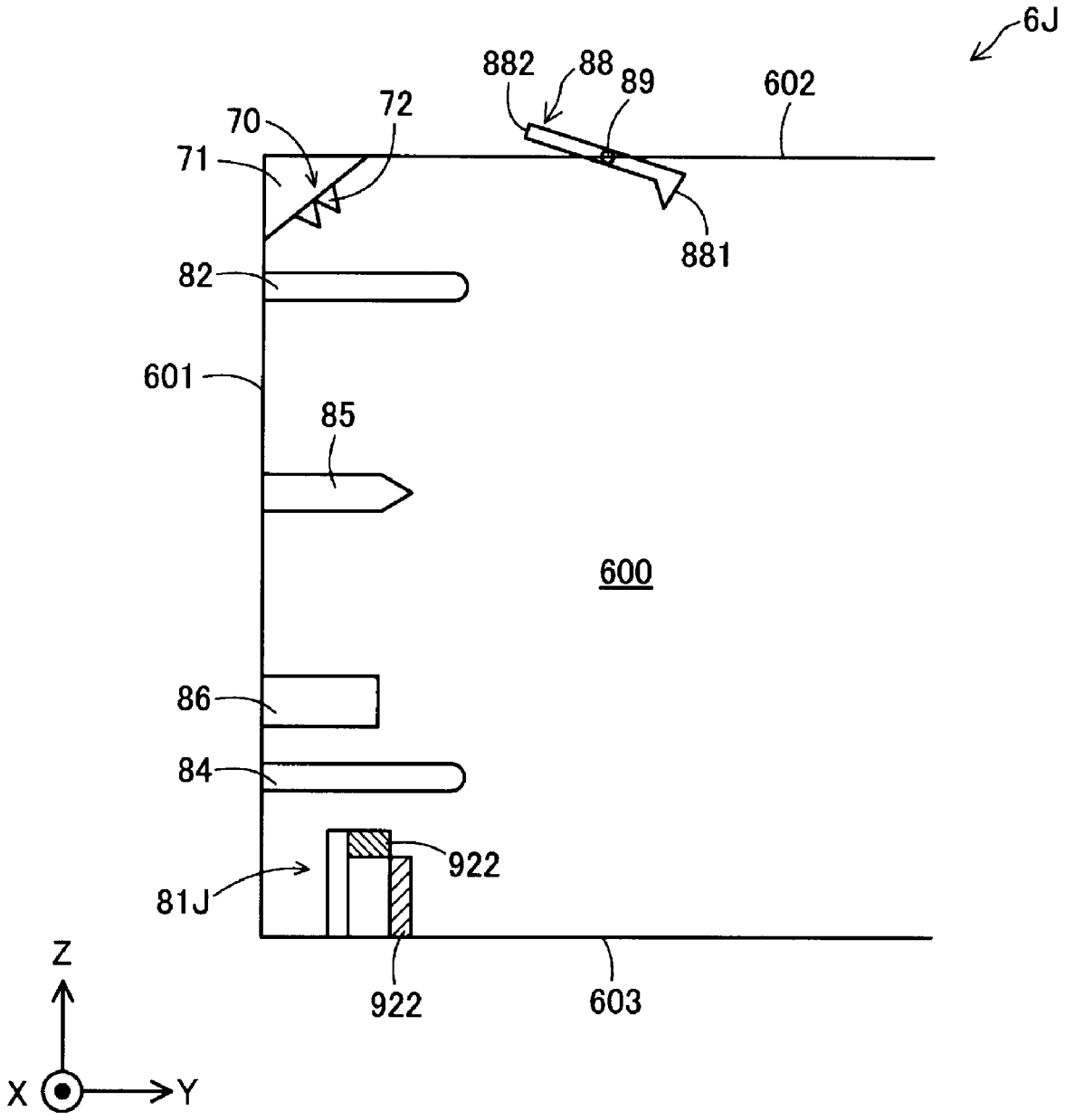
FIG. 57 is a first view for describing a mounting section according to another embodiment.
Figure 58:
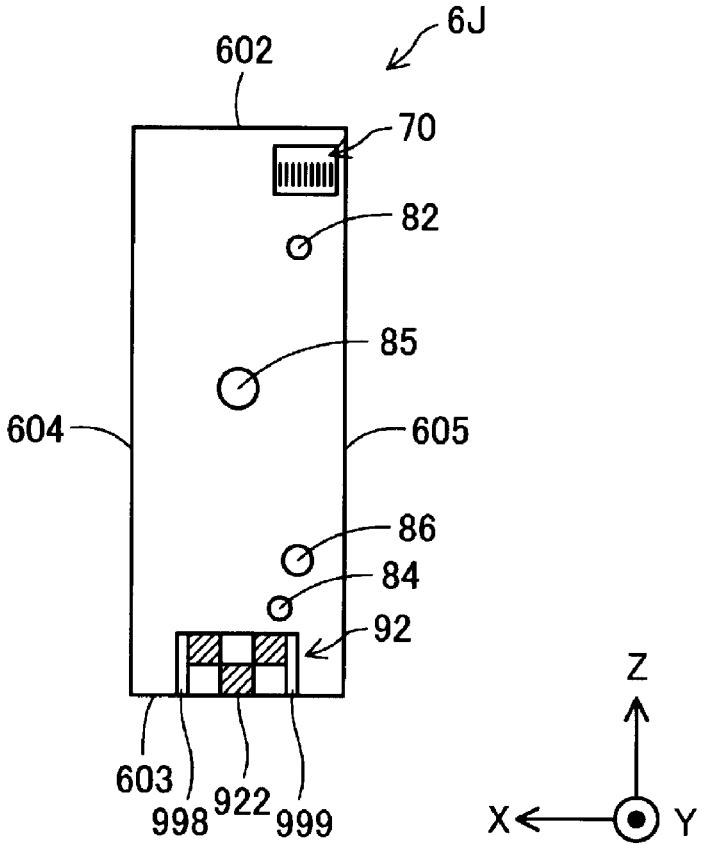
FIG. 58 is a second view for describing a mounting section according to another embodiment.
Figure 59:
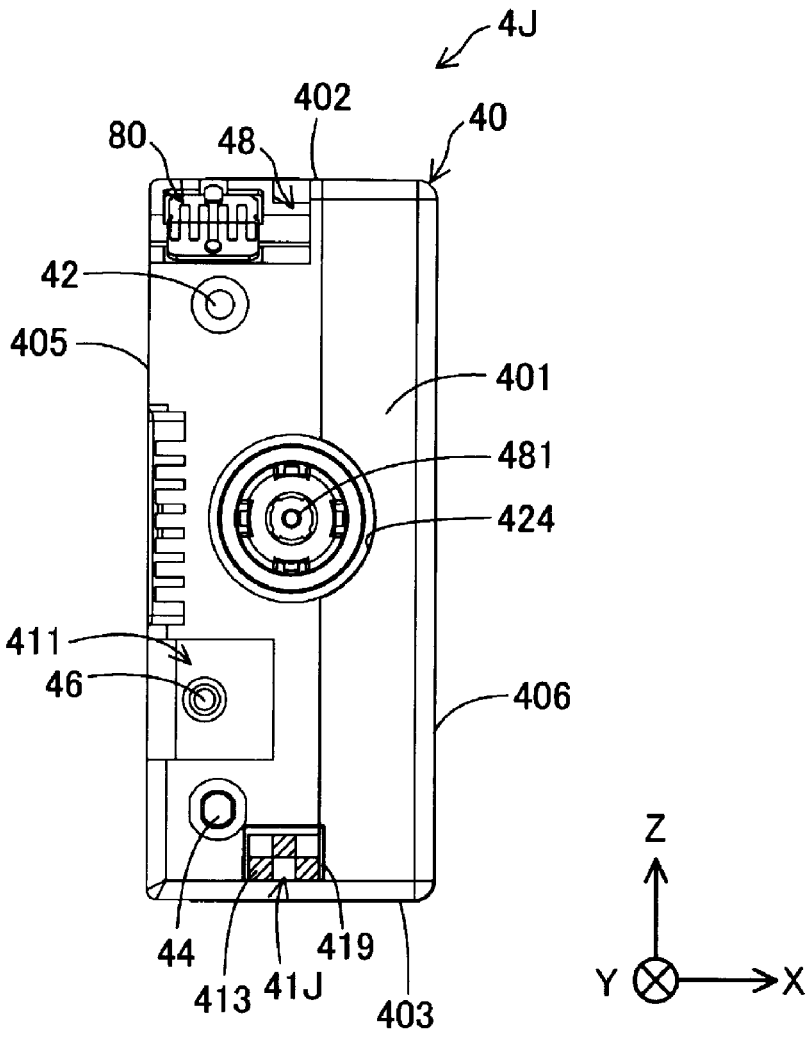
FIG. 59 is a view for describing a cartridge according to another embodiment.

FIG. 57 is a first view for describing a mounting section 6J according to another embodiment. FIG. 58 is a second view for describing the mounting section 6J according to another embodiment. FIG. 59 is a view for describing a cartridge 4J according to another embodiment. The difference between the mounting section 6J and the mounting section 6 of the first embodiment is the position of an apparatus-side identification member 81J. Since other configurations are the same as those of the mounting section 6 of the first embodiment, the same configurations will be given the same reference numerals and the description thereof will be omitted.

The apparatus-side identification member 81J (FIGS. 57 and 58) is provided below the liquid introduction section 85. In the present embodiment, the apparatus-side identification member 81J is provided on the mounting section bottom wall 603. The apparatus-side identification member 81J is formed by at least one or more ribs 922, and the pattern determined by the number and position of the ribs 922 differs depending on the type (ink color in the present example) of the cartridge 4J. In the present embodiment, the mounting section 6J has regulating members 998 and 999 (FIG. 58) on both sides in the X axis direction of the apparatus-side identification member 81J. The regulating members 998 and 999 abut against the cartridge 4J, and it is possible to reduce the possibility that the cartridge 4J is pushed into the mounting section 6J. The regulating members 998 and 999 are plate-like members that extend from the mounting section bottom wall 603 in the +Z axis direction. In addition, the regulating members 998 and 999 may be omitted.

The cartridge-side identification member 41J (FIG. 59) has the same configuration as that of the above-described first embodiment, and is formed by at least one or more ribs 413. The cartridge-side identification member 41J is disposed below the liquid supply port 481 in the height direction (Z axis direction) of the cartridge 4J. In the present embodiment, the cartridge-side identification member 41J is disposed in a recessed portion 419 adjacent to the bottom surface 403 on the front surface 401.

G. Other Embodiments of Engagement Mechanism

In the above-described first embodiment, the engagement of the cartridge 4 with the mounting section 6 is performed by the engagement mechanism 88 (FIG. 2) as a lever and the cartridge-side engaging section 426 provided on the top surface 402 of the cartridge 4, but the present disclosure is not limited thereto. The engagement of the cartridge 4 with the mounting section 6 may be another mechanism as long as the engagement can be released.

Figure 60:
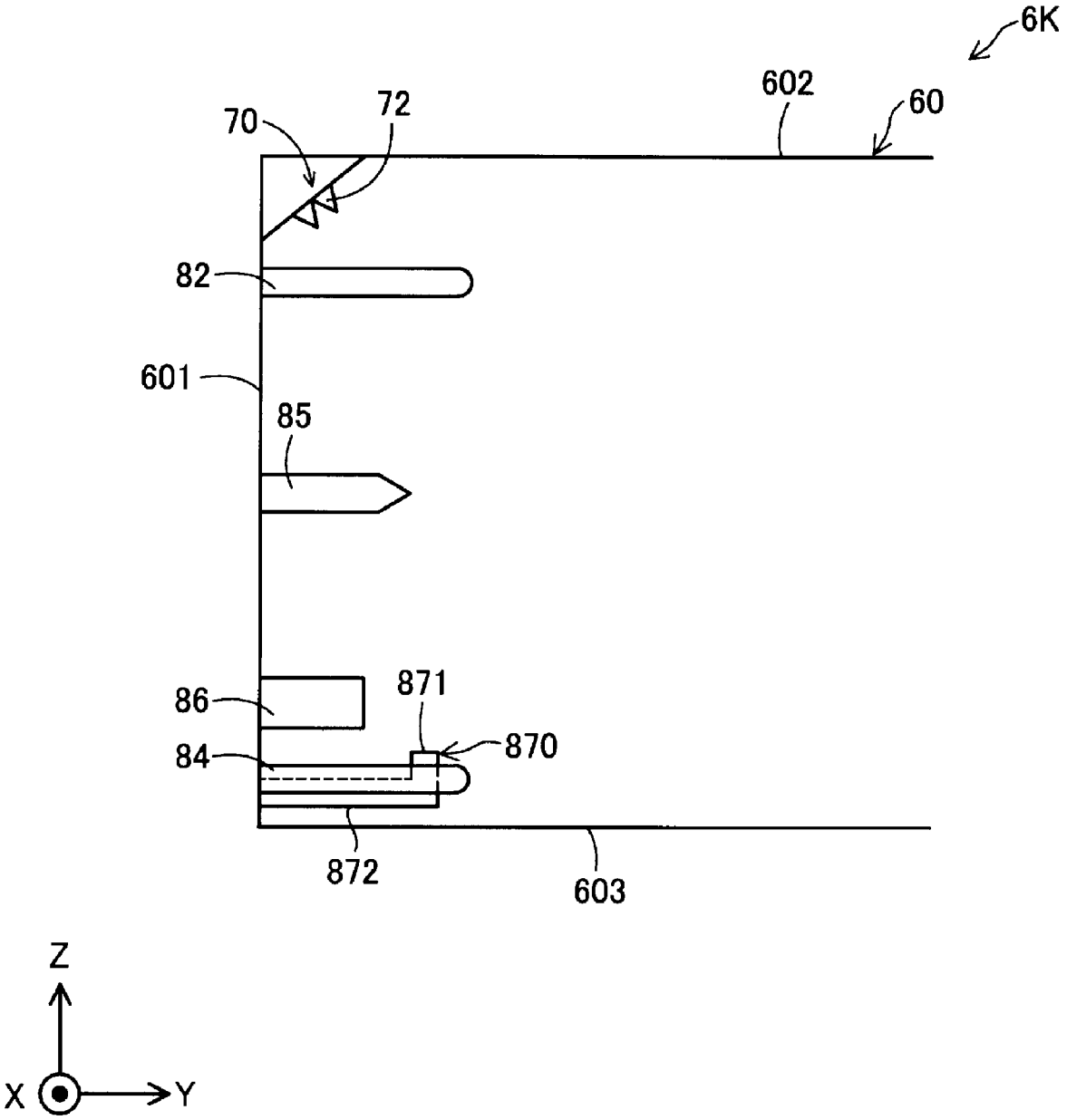
FIG. 60 is a view for describing another embodiment of an engagement mechanism of the mounting section.

FIG. 60 is a view for describing another embodiment of an engagement mechanism 870 of a mounting section 6K. The difference from the mounting section 6 (FIG. 2) of the first embodiment is that the mounting section 6K has the engagement mechanism 870 instead of the engagement mechanism 88. Since other configurations are the same as those of the first embodiment, the same configurations will be given the same reference numerals and the description thereof will be omitted.

The engagement mechanism 870 is disposed at a position where at least a part thereof overlaps the second apparatus-side positioning section 84 in the height direction (Z axis direction). In the present embodiment, the engagement mechanism 870 is positioned on the −X axis direction side of the second apparatus-side positioning section 84. The engagement mechanism 870 has a plate-like main body portion 8872 and a projection portion 871 that is provided at the distal end of the main body portion 872 and protrudes on the +Z axis direction side. The projection portion 871 side part of the main body portion 872 can be elastically deformed in the +Z axis direction with the base end portion of the main body portion 872 as a fulcrum. The projection portion 871 side part of the main body portion 872 is configured to be biased in the +X axis direction by a coil spring (not illustrated) by being displaced in the −X axis direction side. The projection portion 871 is a part that is engaged with the cartridge-side engaging section of the cartridge which will be described later.

Figure 61:
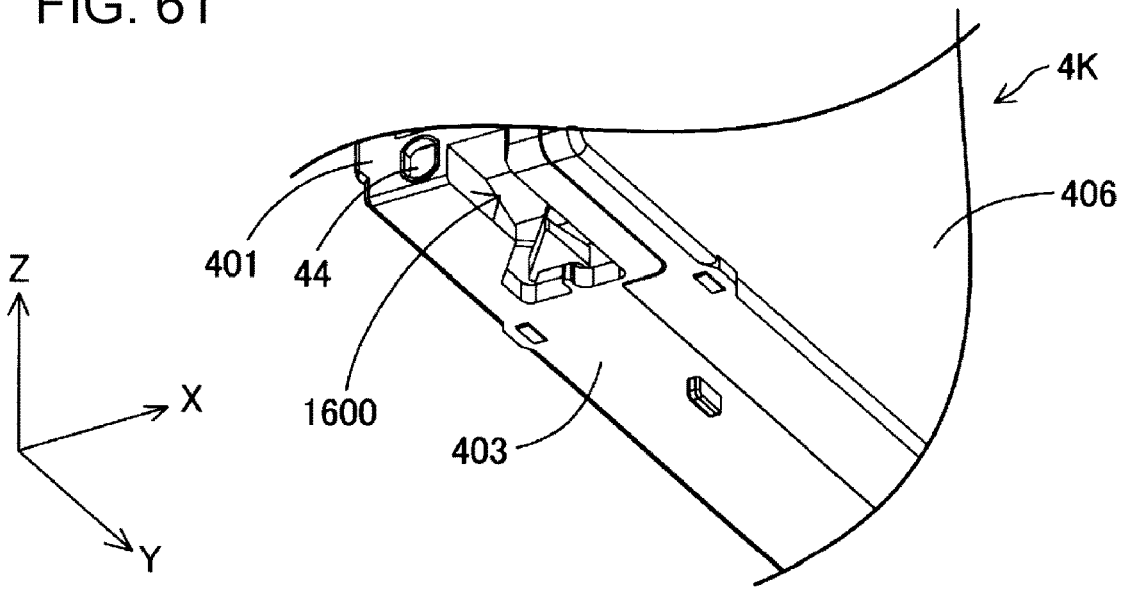
FIG. 61 is a view for describing another embodiment of a cartridge-side engaging section.
Figure 62:
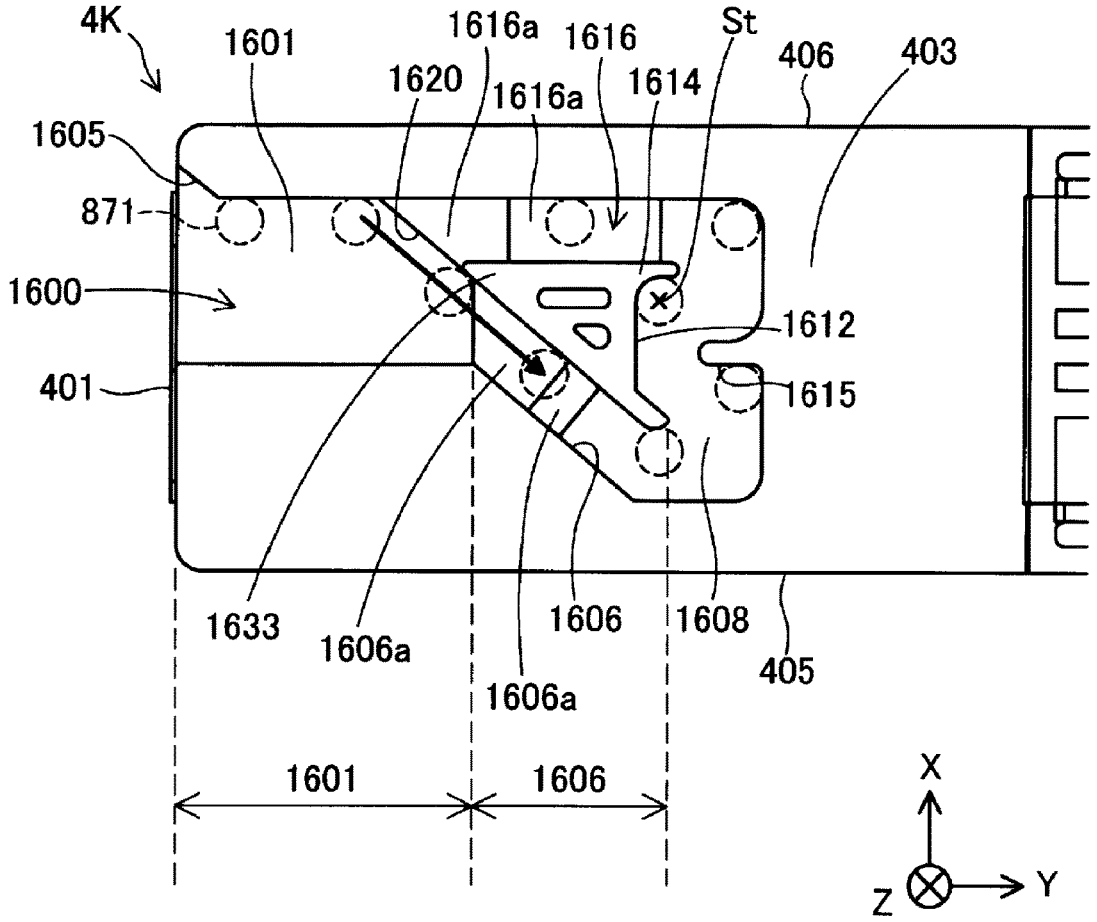
FIG. 62 is a view for describing the detailed configuration of a cartridge-side engagement mechanism.

FIG. 61 is a view for describing another embodiment of the cartridge-side engaging section. FIG. 62 is a view for describing the detailed configuration of a cartridge-side engagement mechanism. The difference between a cartridge 4K of the present embodiment and the cartridge 4 of the first embodiment is that the cartridge 4K has a cartridge-side engagement mechanism 1600 instead of the cartridge-side engaging section 426. Since other configurations are the same as those of the first embodiment, the same configurations will be given the same reference numerals and the description thereof will be omitted.

The cartridge-side engagement mechanism 1600 (FIG. 61) is a groove portion formed on the bottom surface 403. The cartridge-side engagement mechanism 1600 extends from the front surface 401 to the +Y axis direction side.

As illustrated in FIG. 62, the cartridge-side engagement mechanism 1600 includes a receiving section 1601, a guide section 1606, a coupling section 1608, a cartridge-side engaging section 1612, and an outlet portion 1616. When the cartridge 4K is mounted on the mounting section 6K, the projection portion 871 moves in the order of the receiving section 1601, the guide section 1606, the coupling section 1608, and the cartridge-side engaging section 1612. In the mounted state, the projection portion 871 is engaged with the cartridge-side engaging section 1612 at a predetermined engaging position St of the cartridge-side engaging section 1612. When removing the cartridge 4K from the mounting section 6K, the projection portion 871 moves in the order of the cartridge-side engaging section 1612, the outlet portion 1616, and the receiving section 1601.

The receiving section 1601 extends from the front surface 401 to the back surface 404 side, and receives the projection portion 871 of the engagement mechanism 870. The receiving section 1601 has an opening 1605 formed on a first surface 45. The projection portion 871 is received in the receiving section 1601 through the opening 1605. The receiving section 1601 is deeper than the other parts 1606, 1608, 1612, and 1616 of the cartridge-side engagement mechanism 1600. Accordingly, while the projection portion 871 is positioned at the other parts 1606, 1608, 1612, and 1616, the projection portion 871 side of the main body portion 872 is pushed down. Accordingly, an external force is received in a direction (+Z axis direction) in which the cartridge 4K is pushed up through the projection portion 871 by the elastic force of the main body portion 872.

The guide section 1606 is a part for guiding the projection portion 871 of the engagement mechanism 870 to the engaging position St (the position where the cartridge-side engaging section 1612 is formed). The guide section 1606 is coupled to the receiving section 1601. The guide section 1606 extends in a direction inclined with respect to the mounting direction (−Y axis direction) of the cartridge 4K when the cartridge 4K is mounted on the mounting section 6K. Specifically, the guide section 1606 is inclined in the width direction of the cartridge 4K with respect to the mounting direction. The guide section 1606 has an inclined portion 1606*a* of which a groove becomes shallower as the distance from the receiving section 1601 increases. There is no step at the boundary between the guide section 1606 and the receiving section 1601.

The coupling section 1608 couples the guide section 1606 and the cartridge-side engaging section 1612 to each other. The coupling section 1608 has a projecting wall 1615 that protrudes to the −Y axis direction side from the wall on the +Y axis direction side that defines the groove. The cartridge-side engaging section 1612 opposes the projecting wall 1615. The cartridge-side engaging section 1612 has an engaging wall 614. The engaging wall 614 is formed by a wall portion 633 that is one of a plurality of wall portions that define the groove of the cartridge-side engagement mechanism 1600. The cartridge-side engaging section 1612 is formed at a position passing through a plane C1. The outlet portion 1616 couples the cartridge-side engaging section 1612 and the receiving section 1601 to each other. The outlet portion 1616 has an inclined portion 1616*a* of which a groove becomes deeper as approaching the receiving section 1601. A step 620 is formed at the boundary between the outlet portion 1616 and the receiving section 1601.

Next, the movement of the projection portion 871 in the cartridge-side engagement mechanism 1600 during the operation of attaching and detaching the cartridge 4K will be described with reference to FIG. 62. First, the projection portion 871 moves from the receiving section 1601 to the guide section 1606. When the projection portion 871 moves on the guide section 1606, the main body portion 872 rotates in a direction including the −X axis direction component against a coil spring (not illustrated). By pushing the cartridge 4K in the mounting direction against the biasing force of the coil spring, the projection portion 871 reaches the coupling section 1608. The projection portion 871 that has reached the coupling section 1608 moves in a direction including the +X axis direction component by the biasing force of the coil spring of the engagement mechanism 870. Accordingly, the projection portion 871 collides with the projecting wall 1615 and stops. At this time, a click sound is generated. The click sound makes it possible for the user to confirm that the cartridge 4K has sufficiently advanced in the mounting direction.

When the pressing of the cartridge 4K in the mounting direction by the user is released, by the biasing force of the valve mechanism or the like in the liquid supply section 49, the cartridge 4K is slightly pushed back in the removing direction (+Y axis direction). Accordingly, the engagement by the projecting wall 1615 is released, and the projection portion 871 reaches the cartridge-side engaging section 1612. Finally, the projection portion 871 collides with the engaging wall 614 of the cartridge-side engaging section 1612. When the projection portion 871 collides with the engaging wall 614, a click sound is generated. By the click sound, the user can confirm that the cartridge 4K has reached the engaging position St and that the mounting of the mounting section 6K has been completed. As the projection portion 871 abuts against the engaging wall 614, the movement of the cartridge 4K in the removing direction is regulated.

When removing the cartridge 4K from the mounting section 6K, the following procedure is performed. First, the cartridge 4K in the mounted state is pushed in the mounting direction by the user. Accordingly, the projection portion 871 is separated from the engaging wall 614, and the engagement between the cartridge-side engagement mechanism 1600 and the engagement mechanism 870 is released. Next, by moving the cartridge 4K in the removing direction (+Y axis direction) by an external force by the user, an external force of the valve mechanism or the like of the liquid supply section 49, or the like, the projection portion 871 passes through the outlet portion 1616 and reaches the receiving section 1601. Then, the user grasps and removes the cartridge 4K from the mounting section 6K. The cartridge-side engagement mechanism 1600 may be provided on another surface such as the first side surface 405 or the second side surface 406, for example, instead of the bottom surface 403. In this case, the arrangement position of the engagement mechanism 870 is also changed according to the arrangement position of the cartridge-side engagement mechanism 1600.

H. Other Embodiments

The present disclosure is not limited to the above-described embodiments or the other embodiments described above, and can be implemented in various modes without departing from the gist of the present disclosure, for example, can be implemented as another embodiment as follows.

H-1. First Another Embodiment

In each of the above-described embodiments, two cartridge-side positioning holes are provided (FIG. 4), but one may be provided.

H-2. Second Another Embodiment

The present disclosure can be applied not only to an ink jet printer and a cartridge for supplying ink to the ink jet printer, but also to any liquid ejecting apparatus that ejects liquid other than ink and a cartridge for storing the liquid. For example, the present disclosure can be applied to the following various liquid ejecting apparatuses and cartridges thereof.

(1) Image recording apparatus such as facsimile machines (2) Color material ejecting apparatus used for manufacturing color filters for image display devices such as liquid crystal displays (3) Electrode material ejecting apparatus used for forming electrodes such as organic EL (electro luminescence) displays or surface emitting displays (field emission display, FED)

(4) Consumables consuming device that ejects liquid containing biological organic matter used for biochip production (5) Sample ejecting apparatus as a precision pipette (6) Ejecting apparatus of lubricating oil (7) Ejecting apparatus of resin liquid (8) Liquid ejecting apparatus that ejects lubricating oil into precision machines such as timepieces or cameras in pinpoint (9) Liquid ejecting apparatus that ejects a transparent resin liquid such as an ultraviolet curable resin liquid onto a substrate for forming a micro hemispherical lens (optical lens) used for an optical communication element or the like

(10) Consumables consuming device that ejects an acidic or alkaline etching solution for etching a substrate or the like

(11) Consumables consuming device including a consumables consuming head for discharging any other minute amount of droplets The term "droplets" refers to the state of the liquid discharged from the consumables consuming device, and includes those that leave a tail in a granular shape, a tear shape, or a thread shape. In addition, "liquid" referred here may be any material that can be ejected by the liquid ejecting apparatus. For example, "liquid" may be a substance is in a state of being in a liquid phase, and liquid material having high or low viscosity, sol, gel water, other inorganic solvent, organic solvent, solution, liquid resin, or liquid material such as liquid metal (metallic melt) may be included in "liquid". In addition, not only a liquid as one state of a substance but also a material in which particles of a functional material composed of a solid material, such as a pigment and metal particles, are dissolved, dispersed or mixed in a solvent, and the like may also be included in "liquid". In addition, representative examples of the liquid include ink, liquid crystal, and the like as described in the above embodiment. Here, the ink includes various types of liquid compositions, such as general water-based ink and oil-based ink, gel ink, hot melt ink and the like.

The present disclosure is not limited to the above-described embodiments, examples, and modifications, and can be implemented with various configurations without departing from the spirit thereof. For example, the technical features in the embodiments, examples, and modifications corresponding to the technical features in the each embodiment described in the summary of the invention are to solve some or all of the above-described problems, or in order to achieve some or all of the above-described effects, replacement or combination can be performed as appropriate. Unless the technical features are described as essential in the present specification, deletion is possible as appropriate.

(1) According to one aspect of the present disclosure, there is provided a cartridge detachably mounted on a liquid ejecting apparatus. The cartridge includes: a case including a front surface and a back surface opposing each other, a top surface and a bottom surface intersecting the front surface and the back surface and opposing each other, and a first side surface and a second side surface intersecting the front surface, the back surface, the top surface, and the bottom surface and opposing each other; a liquid supply port that is disposed on the front surface, is coupled to a liquid introduction section of the liquid ejecting apparatus, and supplies a liquid to the liquid introduction section; and a contact portion that is disposed at a corner where the front surface and the top surface intersect each other and is in contact with an apparatus-side terminal of the liquid ejecting apparatus, the liquid supply port is disposed at the center of the case in a width direction in which the first side surface and the second side surface oppose each other, and the contact portion is disposed at a position shifted to one side of the first side surface and the second side surface in the width direction.

According to the aspect, in the width direction, the liquid supply port is disposed at the center of the case, and the contact portion is disposed at a position shifted to any one side of the first side surface side and the second side surface side. Accordingly, since a long distance between the liquid supply port and the contact portion can be ensured, it is possible to reduce the possibility that the leaked liquid reaches the contact portion. For example, even when the liquid leaks from the liquid supply port when a posture where the top surface is a lower side is achieved during the transport of the cartridge, it is possible to reduce the possibility that the leaked liquid adheres to the contact portion.

(2) According to the above-described aspect, the corner may have a recessed shape recessed inward of the case, and be formed at a position shifted to the one side in the width direction, the cartridge may further include a liquid storage bag that stores the liquid and is stored in the case, and a liquid supply section having the liquid supply port that forms a distal end portion and a base end portion attached to the liquid storage bag, the liquid storage bag includes a storage bag end portion to which the base end portion is attached, the storage bag end portion has at least a tapered portion of which a dimension in the width direction gradually decreases as going toward the liquid supply port side, and the contact portion may be disposed on an inclined surface in which the front surface side is positioned closer to the bottom surface side than the back surface side, and which is inclined in a mounting direction of the cartridge which is a direction from the back surface toward the front surface, the inclined surface being disposed at the corner.

According to the aspect, as the contact portion is disposed on the inclined surface inclined with respect to the mounting direction, it is possible to reduce the possibility that impurities such as dust adhere to the contact portion. Accordingly, it is possible to suppress the contact failure between the contact portion and the apparatus-side terminal. According to the aspect, since the liquid storage bag has the tapered portion, a space can be generated between the tapered portion and the inner surface of the case on the inside of the case. Meanwhile, the corner has a recessed shape recessed inward of the case and is disposed at a position shifted to one side in the width direction. In other words, the corner can be provided by effectively using the space generated between the tapered portion and the inner surface of the case. Accordingly, the size of the cartridge can be reduced.

(3) According to the above-described aspect, a cartridge-side positioning hole formed on the front surface for positioning the cartridge by inserting an apparatus-side positioning section of the liquid ejecting apparatus; and a fluid receiving section that is formed on the front surface and receives a pressurized fluid supplied from the liquid ejecting apparatus may further be provided, and the cartridge-side positioning hole and the fluid receiving section may be respectively disposed at positions shifted to the one side in the width direction. According to the aspect, as the cartridge-side positioning hole and the fluid receiving section are arranged to be eccentrically to one side, displacement of the fluid receiving section can be suppressed.

(4) According to the above-described aspect, a plurality of the contact portions are provided may further be provided, and the cartridge-side positioning hole and the fluid receiving section may be positioned within a range where the plurality of contact portions are positioned in the width direction. According to the aspect, in the width direction, as the cartridge-side positioning hole and the fluid receiving section are positioned within a range in which the plurality of contact portions are positioned, the displacement of the fluid receiving section and the contact portion in the mounted state of the cartridge to the liquid ejecting apparatus can be suppressed.

(5) According to the above-described aspect, a cartridge-side identification member that is fitted with an apparatus-side identification member of the liquid ejecting apparatus may further be provided, and the cartridge-side identification member may be disposed in a range including the center in a height direction in which the top surface and the bottom surface oppose each other. According to the aspect, as the cartridge-side identification member is disposed in the range including the center in the height direction, the rotation of the cartridge with the center in the height direction as a fulcrum can be suppressed.

(6) According to the above-described aspect, the cartridge-side identification member may be disposed at a position shifted to the one side in the width direction, and the center of the cartridge-side identification member and the center of the liquid supply port may be disposed at the same position in the height direction. According to the aspect, since the distance between the liquid supply port and the cartridge-side identification member can be arranged closer, it is possible to suppress displacement of the liquid supply port.

(7) According to the above-described aspect, two cartridge-side positioning holes may be provided, a first cartridge-side positioning hole as one of the cartridge-side positioning holes may be positioned closer to the top surface side than the cartridge-side identification member, and a second cartridge-side positioning hole as the other cartridge-side positioning hole may be positioned closer to the bottom surface side than the cartridge-side identification member. According to the aspect, the cartridge can be accurately positioned by using the first cartridge-side positioning holes and the second cartridge-side positioning holes.

(8) According to the above-described aspect, a cartridge-side engaging section that is engaged with an apparatus-side engaging section of the liquid ejecting apparatus on the top surface may further be provided, and the cartridge-side engaging section may be disposed at a position shifted to the one side in the width direction. According to the aspect, with respect to the width direction of the cartridge, as the cartridge-side engaging section is disposed at a position shifted to the same one side as the contact portion, the displacement of the contact portion with respect to the apparatus-side terminal in the mounted state can be suppressed.

(9) According to the above-described aspect, the fluid receiving section may have an inner opening that is formed on an inner surface of the front surface and forms one end portion, and the cartridge may further include a rib that surrounds at least a part of the inner opening. According to the aspect, by providing the rib, it is possible to reduce the possibility that the inner opening is closed by the liquid storage bag.

(10) According to the above-described aspect, at least a part of the case may be formed of polystyrene. According to the aspect, by forming at least a part of the case from polystyrene, the shape change after the case is molded can be suppressed, and the creep resistance can be improved.

(11) According to another aspect of the present disclosure, there is provided a cartridge detachably mounted on a liquid ejecting apparatus. The cartridge includes: a case including a front surface and a back surface opposing each other, a top surface and a bottom surface intersecting the front surface and the back surface and opposing each other, and a first side surface and a second side surface intersecting the front surface, the back surface, the top surface, and the bottom surface and opposing each other; an inclined surface in which the front surface side is positioned closer to the bottom surface side than the back surface side, and which is inclined with respect to a mounting direction of the cartridge that is a direction from the back surface toward the front surface, the inclined surface being disposed at a recessed corner where the front surface and the top surface intersect each other and which is recessed inward of the case; a plurality of contact portions that are disposed on the inclined surface and are in contact with an apparatus-side terminal portion of the liquid ejecting apparatus; a cartridge-side positioning hole that is formed on the front surface for positioning the cartridge by inserting an apparatus-side positioning section of the liquid ejecting apparatus; and a cartridge-side engaging section that is formed on the top surface and engaged with an apparatus-side engaging section of the liquid ejecting apparatus, the plurality of contact portions are formed in a plurality of rows, and when a direction in which the first side surface and the second side surface oppose each other is an X axis direction, a direction in which the front surface and the back surface oppose each other is a Y axis direction, and a direction in which the top surface and the bottom surface oppose each other is a Z axis direction, the cartridge-side engaging section has an engaging surface parallel to the X axis direction and the Z axis direction, the engaging surface and the cartridge-side positioning hole intersect an imaginary plane, and the imaginary plane is a plane that passes through the contact portion positioned at the center in the X axis direction among the plurality of contact portions formed in a row closest to the cartridge-side positioning hole among the plurality of rows, and is parallel to the Y axis direction and the Z axis direction. According to the aspect, the distance from the contact portion positioned at the center in the X axis direction to each of the engaging surface and the first cartridge-side positioning hole can be shortened. Accordingly, the positioning accuracy of the cartridge with respect to the liquid ejecting apparatus performed by the engaging surface and the first cartridge-side positioning hole can be improved.

(11) According to another aspect of the present disclosure, there is provided a liquid ejecting apparatus having the cartridge described in any one of the above-described aspects mounted thereon. According to the aspect, even when the liquid leaks from the liquid supply port, it is possible to reduce the possibility that the leaked liquid adheres to the contact portion. Accordingly, it is possible to suppress the contact failure between the contact portion and the apparatus-side terminal.

The present disclosure can be realized in various forms, and can be realized in a form of a cartridge manufacturing method, a liquid ejection system including a cartridge and a liquid ejecting apparatus, and the like, in addition to the cartridge.

The present application is based on, and claims priority from JP Application Serial Number 2017-222387, filed Nov. 20, 2017, the disclosure of which is hereby incorporated by reference herein in its entirety.

REFERENCE SIGNS LIST

1 liquid ejection system
2 printing paper sheet
4, 4A, 4B, 4C, 4D, 4E, 4F, 4G, 4H, 41, 4J, 4*a*, 4*b* cartridge
6, 6J, 6K mounting section
6CP center
8 cap member

10 printer
13 replacement cover
15 operation button
20 carriage
22 head
24 tube
30 driving mechanism
31 control section
32 timing belt
34 drive motor
40, 40A, 40*a* case
40*sp* space
41, 41J cartridge-side identification member
42 first cartridge-side positioning hole
44 second cartridge-side positioning hole
45 first surface
46, 46A, 46B, 46C fluid receiving section
46*h* inner opening
48, 48*a*, 48*b* corner
48*fa* inclined wall (inclined surface)
49 liquid supply section
50 liquid storage bag
51 bag top surface
52 bag bottom surface
53 tapered portion
54 storage bag end portion
55 rear end portion
56 bag left side surface
57 bag right side surface
58 ring member
59 auxiliary member
70, 70*b* apparatus-side terminal portion
70*fa* surface
71 terminal holding section
71*fa* surface
72 apparatus-side terminal
80, 80G circuit substrate
80*fa* surface
81, 81J apparatus-side identification member
82 first apparatus-side positioning section
84 second apparatus-side positioning section
85 liquid introduction section
85Ca cable
85*b* connector
86 pressurizing section
88 engagement mechanism
88*fa* holder inclined surface
89 rotation shaft
95 terminal coupling portion
103 liquid supply section
401 front surface
402 top surface
403 bottom surface
404 back surface
405 first side surface
406 second side surface
411 arrangement recessed portion
412 recessed bottom surface
413 rib
421 first case
422 engaging surface
423 sheet member
424 arrangement hole
425 cover member
426 cartridge-side engaging section
427 second case
428 direction identification section
429 opening
430 internal chamber
442 engagement claw
449 inclined rib portion
452 rib
472, 474 stirring bag
476, 478 tube
481 liquid supply port
482 base end portion
515 godet portion
541 distal end side
600 storage space
601 mounting section back wall
602 mounting section upper wall
603 mounting section bottom wall
604 mounting section left side wall
605 mounting section right side wall
606 mounting section opening
614 engaging wall
620 step
633 wall portion
724 terminal block
724*fa* surface
724*fc* surface
750 terminal holder
752 wall portion
752*t* first wall portion
752*w* second wall portion
753 surface
754 positioning recessed portion
756 apparatus-side regulating section
756*t* first apparatus-side regulating section
756*ta* contact surface
756*tc* contact surface
756*td* contact surface
756*w* second apparatus-side regulating section
756*wa*, 756*wc*, 756*ed* contact surface
777, 777*t*, 777*w* recessed portion
820, 820G storage device
822 substrate
830 cartridge-side terminal
831 mounting detection terminal
832 reset terminal
833 clock terminal
836 power supply terminal
837 ground terminal
838 data terminal
870 engagement mechanism
871 projection portion
872 main body portion
880 substrate holder
881 apparatus-side engaging section
882 operating section
900A, 900B, 900C, 900D, 900E, 900F corner
902 side wall
902*t* first side wall
902*ta* side wall
902*tb* first side wall
902*tc* first side wall
902*td* first side wall
902*te* first side wall
902*w* second side wall
902*wb* second side wall
902*wc* second side wall
902*wd* second side wall
902*we* second side wall
906*t* first contact regulating section

906*ta* second contact regulating section
906*tb* projected portion
906*tc* projected portion
906*td* projected portion
906*te* projected portion
906*w* second contact regulating section
906*wb* projected portion
906*wc* projected portion
906*wd* projected portion
906*we* projected portion
908 groove
908*t* first groove
908*w* second groove
915 projected portion
915A projected portion
915At first projected portion
915Aw second projected portion
915C projected portion
915Ct first projected portion
915Cw second projected portion
915D projected portion
915Df first projected portion
915Du third projected portion
915E projected portion
915Et first protrusion portion
915Ew second protrusion portion
915F projected portion
915Fa projected portion
915Fb projected portion
915Fc projected portion
915*a* lower portion
915*b* upper portion
915*t* first side portion
915*w* second side portion
916*a* entrance part
916*b* entrance part
917, 917C, 917Ct, 917Cw, 917*t*, 917*w*, 918, 918C, 918Ct, 918Cw, 918*t*, 918*ta*, 918*tb*, 918*w*, 918*wa*, 918*wb* member
919C, 919Ct, 919Cw, 919Dt, 919Dw protrusion portion
922 rib
982 opening
984 opening
986 back surface
988 bottom surface
998, 999 regulating member
1000 liquid supply device
1002 liquid supply source
1003 circulation pipe
1600 cartridge-side engagement mechanism
1601 receiving section
1606 guide section
1606*a* inclined portion
1608 coupling section
1612 cartridge-side engaging section
1615 projecting wall
1616 outlet portion
1616*a* inclined portion
8872 main body portion
St engaging position
TP center
WP center
cp contact portion
VP imaginary plane
Ln1, Ln2 row

The invention claimed is:

1. A cartridge detachably mounted on a liquid ejecting apparatus, comprising:

a case including a front surface and a back surface opposing each other, a top surface and a bottom surface intersecting the front surface and the back surface and opposing each other, and a first side surface and a second side surface intersecting the front surface, the back surface, the top surface, and the bottom surface and opposing each other;

a liquid supply port that is disposed on the front surface, is coupled to a liquid introduction section of the liquid ejecting apparatus, and supplies a liquid to the liquid introduction section;

a contact portion that is disposed at a corner where the front surface and the top surface intersect each other and is in contact with an apparatus-side terminal of the liquid ejecting apparatus;

a liquid storage bag that stores the liquid and is stored in the case; and a liquid supply section having the liquid supply port that forms a distal end portion and a base end portion attached to the liquid storage bag, wherein the liquid supply port is disposed at the center of the case in a width direction in which the first side surface and the second side surface oppose each other, the contact portion is disposed at a position shifted to one side of the first side surface and the second side surface in the width direction, the corner has a recessed shape recessed inward of the case, and is formed at a position shifted to the one side in the width direction, the liquid storage bag includes a storage bag end portion to which the base end portion is attached, the storage bag end portion has at least a tapered portion of which a dimension in the width direction gradually decreases as going toward the liquid supply port side, and the contact portion is disposed on an inclined surface in which the front surface side is positioned closer to the bottom surface side than the back surface side, and which is inclined with respect to a mounting direction of the cartridge which is a direction from the back surface toward the front surface, the inclined surface being disposed at the corner, the cartridge further comprising:

at least one cartridge-side positioning hole formed on the front surface for positioning the cartridge by inserting an apparatus-side positioning section of the liquid ejecting apparatus;

a fluid receiving section that is formed on the front surface and receives a pressurized fluid supplied from the liquid ejecting apparatus; and a cartridge-side identification member that is fitted with an apparatus-side identification member of the liquid ejecting apparatus, wherein the at least one cartridge-side positioning hole and the fluid receiving section are respectively disposed at positions shifted to the one side in the width direction, the cartridge-side identification member is disposed in a range including the center in a height direction in which the top surface and the bottom surface oppose each other, and the at least one cartridge-side positioning hole includes:

a first cartridge-side positioning hole positioned closer to the top surface side than the cartridge-side identification member, and a second cartridge-side positioning hole positioned closer to the bottom surface side than the cartridge-side identification member.

2. The cartridge according to claim 1, wherein a plurality of the contact portions are provided, and the at least one cartridge-side positioning hole and the fluid receiving section are positioned within a range where the plurality of contact portions are positioned in the width direction.

3. The cartridge according to claim 1, wherein the cartridge-side identification member is disposed at a position shifted to the one side in the width direction, and the center of the cartridge-side identification member and the center of the liquid supply port are disposed at the same position in the height direction.

4. The cartridge according to claim 1, further comprising:

a cartridge-side engaging section that is engaged with an apparatus-side engaging section of the liquid ejecting apparatus on the top surface, wherein the cartridge-side engaging section is disposed at a position shifted to the one side in the width direction.

5. The cartridge according to claim 1, wherein the fluid receiving section has an inner opening that is formed on an inner surface of the front surface and forms one end portion, and the cartridge further comprises a rib that surrounds at least a part of the inner opening.

6. The cartridge according to claim 1, wherein at least a part of the case is formed of polystyrene.

7. A liquid ejecting apparatus comprising:

the cartridge according to claim 1 mounted thereon.

8. A cartridge detachably mounted on a liquid ejecting apparatus, comprising:

a case including a front surface and a back surface opposing each other, a top surface and a bottom surface intersecting the front surface and the back surface and opposing each other, and a first side surface and a second side surface intersecting the front surface, the back surface, the top surface, and the bottom surface and opposing each other;

an inclined surface in which the front surface side is positioned closer to the bottom surface side than the back surface side, and which is inclined with respect to a mounting direction of the cartridge that is a direction from the back surface toward the front surface, the inclined surface being disposed at a recessed corner where the front surface and the top surface intersect each other and which is recessed inward of the case;

a plurality of contact portions that are disposed on the inclined surface and are in contact with an apparatus-side terminal portion of the liquid ejecting apparatus;

at least one cartridge-side positioning hole that is formed on the front surface for positioning the cartridge by inserting an apparatus-side positioning section of the liquid ejecting apparatus;

a cartridge-side engaging section that is formed on the top surface and engaged with an apparatus-side engaging section of the liquid ejecting apparatus;

a liquid storage bag that stores a liquid and is stored in the case; and a liquid supply section having a liquid supply port that forms a distal end portion and a base end portion attached to the liquid storage bag, wherein the plurality of contact portions are formed in a plurality of rows, when a direction in which the first side surface and the second side surface oppose each other is an X axis direction, a direction in which the front surface and the back surface oppose each other is a Y axis direction, and a direction in which the top surface and the bottom surface oppose each other is a Z axis direction, the cartridge-side engaging section has an engaging surface parallel to the X axis direction and the Z axis direction, the engaging surface and the at least one cartridge-side positioning hole intersect an imaginary plane, and the imaginary plane is a plane that passes through the contact portion positioned at the center in the X axis direction among the plurality of contact portions formed in a row closest to the at least one cartridge-side positioning hole among the plurality of rows, and is parallel to the Y axis direction and the Z axis direction, the corner is formed at a position shifted to one side of the first side surface and the second side surface in the width direction, the liquid storage bag includes a storage bag end portion to which the base end portion is attached, and the storage bag end portion has at least a tapered portion of which a dimension in the width direction gradually decreases as going toward the liquid supply port side, the cartridge further comprising:

a fluid receiving section that is formed on the front surface and receives a pressurized fluid supplied from the liquid ejecting apparatus; and a cartridge-side identification member that is fitted with an apparatus-side identification member of the liquid ejecting apparatus, wherein the at least one cartridge-side positioning hole and the fluid receiving section are respectively disposed at positions shifted to the one side in the width direction, the cartridge-side identification member is disposed in a range including the center in a height direction in which the top surface and the bottom surface oppose each other, and the at least one cartridge-side positioning hole includes:

a first cartridge-side positioning hole positioned closer to the top surface side than the cartridge-side identification member, and a second cartridge-side positioning hole positioned closer to the bottom surface side than the cartridge-side identification member.

* * * * *